US010202217B2

(12) United States Patent
Hanan et al.

(10) Patent No.: US 10,202,217 B2
(45) Date of Patent: Feb. 12, 2019

(54) PLASTIC CONTAINER WITH STRAPPED BASE

(71) Applicants: Jay Clarke Hanan, Ontario, CA (US); Jochen Forsthovel, Regensburg (DE); Alexander Schau, Regensburg (DE)

(72) Inventors: Jay Clarke Hanan, Ontario, CA (US); Jochen Forsthovel, Regensburg (DE); Alexander Schau, Regensburg (DE)

(73) Assignee: Niagara Bottling, LLC, Ontario, CA (US)

( * ) Notice: Subject to any disclaimer, the term of this patent is extended or adjusted under 35 U.S.C. 154(b) by 0 days.

(21) Appl. No.: 14/806,489

(22) Filed: Jul. 22, 2015

(65) Prior Publication Data

US 2015/0329234 A1 Nov. 19, 2015

Related U.S. Application Data

(63) Continuation of application No. 14/157,400, filed on Jan. 16, 2014, now Pat. No. 9,120,589, which is a continuation-in-part of application No. 14/141,224, filed on Dec. 26, 2013, now Pat. No. 9,132,933.

(60) Provisional application No. 61/746,535, filed on Dec. 27, 2012.

(51) Int. Cl.
*B65D 90/02* (2006.01)
*B65D 1/02* (2006.01)

(52) U.S. Cl.
CPC ..... *B65D 1/0223* (2013.01); *B65D 1/0284* (2013.01)

(58) Field of Classification Search
CPC ..... B65D 1/44; B65D 1/0223
USPC ..... 215/382, 370, 381
See application file for complete search history.

(56) References Cited

U.S. PATENT DOCUMENTS

| | | | | |
|---|---|---|---|---|
| 6,112,925 | A | 9/2000 | Nahill et al. | |
| 6,149,024 | A | 11/2000 | Deemer et al. | |
| 8,556,098 | B2 | 10/2013 | Peykoff et al. | |
| 8,567,625 | B2 * | 10/2013 | Nemoto | B65D 1/0223 215/384 |
| 2008/0073315 | A1 | 3/2008 | Hermel et al. | |
| 2008/0223816 | A1 * | 9/2008 | Darr | B65D 1/0223 215/382 |
| 2010/0297375 | A1 | 11/2010 | Protais et al. | |
| 2011/0132863 | A1 | 6/2011 | Dorn | |
| 2013/0140264 | A1 | 6/2013 | Hanan | |
| 2013/0213925 | A1 | 8/2013 | Forsthovel et al. | |

FOREIGN PATENT DOCUMENTS

WO WO 2013/085919 6/2013

* cited by examiner

*Primary Examiner* — Anthony Stashick
*Assistant Examiner* — Raven Collins
(74) *Attorney, Agent, or Firm* — Rutan & Tucker, LLP; Hani Z. Sayed

(57) ABSTRACT

A container may have a base, a sidewall connected to the base, a bell connected to the sidewall, and a finish connected to the bell. The base may have strap ribs to resist deformation of the base. The sidewall may have recessed columns to resist bending, leaning, crumbling, and/or stretching. The strap ribs and recessed columns may vertically line up along a central axis of the container to communicate forces on the container vertically along the container to continuously resist deformation in the base and the sidewall.

17 Claims, 35 Drawing Sheets

PLASTIC CONTAINER WITH STRAPPED BASE

PRIORITY

This application is a continuation of, and claims the benefit of, U.S. patent application Ser. No. 14/157,400, entitled "Plastic Container with Strapped Base," filed on Jan. 16, 2014, which is a continuation in part of, and claims the benefit of, U.S. patent application Ser. No. 14/141,224, entitled "Plastic Container with Strapped Base," filed on Dec. 26, 2013, which claims the benefit of U.S. Provisional Application No. 61/746,535, filed on Dec. 27, 2012, the entirety of both of said applications is incorporated herein by reference.

FIELD

The field of the present disclosure generally relates to plastic containers. More particularly, the field of the present disclosure relates to plastic containers designed to hold liquids while resisting deformation.

BACKGROUND

Plastic containers have been used as a replacement for glass or metal containers in the packaging of beverages for several decades. The most common plastic used in making beverage containers today is polyethylene terephthalate (PET). Containers made of PET are transparent, thin-walled, and have the ability to maintain their shape by withstanding the force exerted on the walls of the container by their contents. PET resins are also reasonably priced and easy to process. PET bottles are generally made by a process that includes the blow-molding of plastic preforms which have been made by injection molding of the PET resin.

Advantages of plastic packaging include lighter weight and decreased breakage as compared to glass, and lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic, while still exhibiting good mechanical properties.

SUMMARY

The bottling industry is moving in the direction of removing auxiliary packaging from cases or pallets. A case of bottles with film only and no paperboard is called a "film only conversion" or "lightweighting" of auxiliary packaging. The removal of supporting elements such as paperboard places additional stress on a bottle, which increases the structural demands on the bottle. In certain embodiments, a bottle design can provide one or more of the benefits of reducing bending and point loading failures. The disclosed design embodiments can alleviate the stresses during shipping and handling (including film only packaging) while maintaining ease of blow molding. In certain embodiments, a bottle design uses less resin for the same or similar mechanical performance, resulting in a lightweight product.

Embodiments of the bottle disclosed herein may use polyethylene terephthalate (PET), which has viscoelastic properties of creep and relaxation. As a plastic, PET and other resins tend to relax at temperatures normally seen during use. This relaxation is a time dependent stress relieving response to strain. Bending can provide exaggerated strains over what would be seen in tensile loading. Due to exaggerated strains, the relaxation in bending can be much more severe. Bending happens at multiple length scales. Bending can happen at the length scale of the bottle or on a small length scale. An example of the bottle length scale bending is a person bending the bottle in his/her hands, or bending experienced during packing in a case on a pallet. An example of the small scale is the flexing or folding of ribs or other small features on the wall of the bottle. In response to loads at the first, larger length scale, ribs flex at the local, smaller length scale. When they are held in this position with time, the ribs will permanently deform through relaxation.

Further, embodiments of the bottles disclosed herein may undergo pressurization. Pressure inside a bottle can be due to the bottle containing a carbonated beverage. Pressure inside a bottle can be due to pressurization procedures or processes performed during bottling and packaging. For example, a bottle can be pressurized to help the bottle retain its shape. As another example, the bottle can be pressurized with certain gases to help preserve a beverage contained in the bottle.

Embodiments of the bottles disclosed herein have varying depth ribs that achieve a balance of strength and rigidity to resist the bending described above while maintaining hoop strength, such as, for example, when pressure is not used or relieved. A collection of flattened and/or shallow depth ribs act as recessed columns in the body of the bottle that distribute bending and top load forces along the wall to resist leaning, stretching, and crumbling. The collection of flattened and/or shallow depth ribs can help the bottle retain its shape during pressurization, such as, for example, help inhibit stretching of the bottle when pressurized. Inhibiting stretching of the bottle helps retain desired bottle shape to aid in packaging of the bottles as discussed herein by, for example, maintaining a substantially constant height of the bottle. Inhibiting stretching of the bottle can help with applying a label to a label portion of the bottle. For example, with a label applied to a bottle, inhibiting stretching of the bottle helps retain a constant length or height of the bottle at the label panel portion, which can help prevent tearing of the label and/or prevent the label from at least partially separating from the bottle (i.e., failure of the adhesive between the bottle and the label). Further details on the features and functions of varying depth ribs are disclosed in U.S. patent application Ser. No. 13/705,040, entitled "Plastic Container with Varying Depth Ribs," filed on Dec. 4, 2012, now U.S. Pat. No. 8,556,098, entitled "Plastic Container Having Sidewall Ribs with Varying Depth," which claims benefit to U.S. Provisional Patent Application Ser. No. 61/567,086, entitled "Plastic Container with Varying Depth Ribs," filed on Dec. 5, 2011, the entirety of each of which is incorporated herein by reference.

A balance may be achieved between flattened and/or shallow ribs and deep ribs to attain a desired resistance to bending, leaning, and/or stretching while maintaining stiffness in a lightweight bottle. In some embodiments, at least some of the aforementioned desired qualities may be further achieved through a steeper bell portion of a bottle. A steeper bell portion can increase top load performance in a lightweight bell. A lightweight bottle body and bell leaves more resin for a thicker base of the bottle, which can increase stability. A thicker base may better resist bending and top load forces and benefits designs with a larger base diameter with respect to the bottle diameter for tolerance even when the base is damaged during packaging, shipping, and/or handling.

Embodiments disclosed herein have a base rib that can function as a strap from a base to a sidewall of the bottle to the help further achieve resistance to bending, leaning, stretching and/or flexing while maintaining stiffness. A strap rib on a base helps the base resist deformation under pressure without necessitating the base being overly heavy in weight relative to the lightweight bottle (i.e., relative to wall thickness of flat foot base that does not resist pressure as well). The strap base rib can be incorporated into a flat foot base. A flat foot base helps retain base foot thickness. Retaining base foot thickness helps retain bottle integrity during packaging and handling using lightweight packaging, such as, for example, film only packaging that requires the base to directly resist forces, including bending and point loading, during packaging, shipping, and/or handling. A flat foot base performs well with or without internal pressure due to, for example, the ability to maintain relative foot thickness in the base in a lightweight bottle. Without strap ribs, the base may have little internal pressure resistance and may rollout (pop out and create a rocker bottom). The strapped base rib helps resist damage and deformation as discussed herein without requiring a relatively heavy footed base. Without requiring a relatively heavy footed base, less material is needed for the lightweight bottle. Further, the strapped base design may allow for a relatively easier blowing process than other known pressure bases. Thus, a base with a strap rib as disclosed herein provides for a material efficient, pressure optional bottle base.

Incorporating a strap base rib into the base with column formations in the sidewall of the bottle as discussed herein offers pressure resistance for internally pressurized bottles while maintaining strength and performance (i.e., resistance to bending and leaning) when without internal pressure (i.e., pressure release by a user opening a closure of a bottle). The strap base rib can act with the column formation on the sidewall of the bottle to form straps around the bottle to communicate stresses along the height of the bottle.

The base with a strap base rib helps maintain strength and performance of the column formations for internally pressurized bottles. With a strap base rib, the resistance to bending, leaning, and/or stretching while maintaining stiffness and hoop strength is maintained without pressure while enhancing these characteristics when the bottle is pressurized. For example, a strap base rib allows the utilization of a flat foot base for better base strength during processing at a plant (i.e., adding beverage contents), while preventing rollout or popping out of the base during pressurization. Rollout of the base bottle leads to what may be called a "rocker bottom." Preventing rollout of the base helps the bottle stay level when resting on a surface and maintains the flat feet as the contact points on the surface. Further, base rollout can also occur without pressurization or low pressurization of the bottle, such as, for example, during shipping and handling or filling at high speed. A strap base rib also helps prevent base rollout without or low internal pressurization. While the specification herein may discuss preventing or inhibiting deformation under external/internal pressures and/or forces, it is to be understood that some deformation of a bottle may occur without straying outside of the scope of this disclosure. Some deformation of the bottle under external/internal pressures and/or forces may occur while retaining excellent structural properties of the features and functions disclosed herein.

Embodiments disclosed herein can be utilized for bottle pressures of a wide range. The strap base rib can help resist pressurization pressures in the bottle of up to 3 bars, including up to 2.5, up to 2, up to 1.5, up to 1, up to 0.5 bars, and up to 0.3 bars, including ranges bordered and including the foregoing values. The preform design also plays a role in resisting pressures such that much higher pressures than already demonstrated can be resisted with greater strap thickness available from the preform. The strap design provides a more efficient way of resisting the pressure in a bottle that also performs well without pressure.

Embodiments disclosed herein can be utilized in bottle volumes of a wide range. For example, features and functions disclosed herein can be utilized with a 3 ounce bottle up to a multiple gallon bottle. As another example, features and functions disclosed herein can be utilized with an 8 ounce (0.24 liter/0.15 liter) bottle up to a 3 liter bottle, including 12 ounces (0.35 liters) to 2 liters, 16 (0.47 liters) ounces to 1 liter, 18 ounces (0.53 liters) to 0.75 liters, and 0.5 liters, including ranges bordered and including the foregoing values.

In some embodiments, a container comprising a flat foot base having strap ribs and a sidewall having recessed columns, the strap ribs and recessed columns vertically lined up to resist deformation in the base and the sidewall, the container can comprise one or more of the following: a flat foot base comprising a gate, a wall, and flat feet, the gate centered on a central axis of the container, the wall extending from the gate toward a resting surface of the container, the flat feet extending from the wall to the resting surface; a sidewall connected to the base, the sidewall extending substantially along the central axis to define at least part of an interior of the container; a bell connected to the sidewall and leading upward and radially inward to a finish connected to the bell; a plurality of strap ribs positioned in the base between the flat feet, the strap ribs extending radially outward from the gate or the wall toward the sidewall, the strap ribs sloping upward relative to the resting surface toward the sidewall from the gate or the wall to resist deformation of the base; a plurality of recessed columns positioned in the sidewall, the recessed columns comprising sidewall ribs extending along a periphery of the sidewall and centered about the central axis, wherein portions of the sidewall between the sidewall ribs are substantially continuous along the periphery of the sidewall, the recessed columns configured to resist at least one of bending, leaning, crumbling, or stretching along the sidewall; and/or wherein the strap ribs and the recessed columns vertically line up along the central axis to form pressure resistance bands such that each pressure resistance band comprises a strap rib vertically lined up along the central axis with a recessed column, the pressure resistance bands configured to communicate forces on the container vertically along the container between the base and the sidewall to continuously resist deformation in the base and the sidewall.

In some embodiments, the strap ribs extend radially outward from the wall of the base; the strap ribs extend radially outward from the gate of the base; the wall of the base comprises a dome extending from the gate toward the resting surface of the container without contacting the resting surface, the dome surrounding the gate about the central axis; at least one of the strap ribs extends radially outward from the dome of the base; the base further comprises a plurality of load ribs positioned between the strap ribs, the load ribs having a depth toward the interior of the container shallower than a depth of the strap ribs, the load ribs configured to resist deformation of the base when external forces are applied to the container; the sidewall comprises a base rib positioned along the periphery of the sidewall at a point of contact for the container with other containers when the container and the other containers are packaged together with central axes of the containers being vertical, the base rib centered about the central axis of the container; the sidewall comprises a base rib positioned along the periphery of the sidewall at a point of contact for the container with other containers when the container and the other containers are packaged together with central axes of the containers being vertical, the base rib centered about the central axis of the container; the strap ribs extend through the base rib substantially up to the recessed columns such that the pressure resistance band is continuous through the base rip, the strap ribs forming discontinuities in the base rib; the sidewall ribs comprise a plurality of varying depth ribs positioned along the periphery of the sidewall, wherein each varying depth rib comprises shallow sections and deep sections, the shallow sections having a rib depth less than a rib depth of the deep sections, wherein the shallow sections of the plurality of varying depth ribs vertically line up along the central axis to form the recessed columns; the shallow sections have a rib depth of substantially zero from the periphery of the sidewall; the sidewall is substantially round about the periphery of the sidewall, and wherein the plurality of recessed columns comprises three recessed columns positioned in the sidewall equidistantly around the periphery of the round sidewall; the sidewall comprises a grip portion and a label portion, and wherein the three recessed columns are positioned in the grip portion, and the plurality of recessed columns further comprises six recessed columns positioned in the label portion equidistantly around the periphery of the round sidewall, the six recess columns in the label portion configured to inhibit triangulation of the container, wherein three of the six recess columns in the label portion and the three recessed columns in the grip portion vertically line along the central axis; the plurality of strap ribs comprises three strap ribs positioned in the base equidistantly from each other, and wherein the three strap ribs and the three recessed columns vertically line up along the central axis; the plurality of strap ribs comprises six strap ribs positioned in the base equidistantly from each other, three of the six strap ribs and the three recessed columns vertically lined up along the central axis, and wherein the six strap ribs are configured to inhibit triangulation of the container; the sidewall is substantially square about the periphery of the sidewall, and wherein the plurality of recessed columns comprises four recessed columns positioned in the sidewall equidistantly around the periphery of the square sidewall such that each pressure resistance band further comprises an other strap rib radially extending 180 degrees opposite the strap rib, the other strap rib vertically lined up along the central axis with an other recessed column; the square sidewall comprises corners and flat portions between the corners, and wherein the strap ribs extend toward the flat portions of the square sidewall, the strap ribs configured to resist rounding of the square sidewall at the flat portions; and/or the sidewall ribs comprise a plurality of varying depth ribs positioned along the periphery of the sidewall, wherein each varying depth rib comprises shallow sections and deep sections, the shallow sections having a rib depth less than a rib depth of the deep sections, wherein the shallow sections of the plurality of varying depth ribs vertically line up along the central axis to form the recessed columns, and wherein the deep sections are positioned at the four corners of the square sidewall, the deep sections configured to resist rounding of the square sidewall at the flat portions.

In some embodiments, a container comprising a flat foot base having strap ribs and a sidewall having recessed columns, the strap ribs and recessed columns vertically lined up to resist deformation in the base and the sidewall, the container can comprise one or more of the following: a flat foot base comprising a gate, a dome, and flat feet, the gate centered on a central axis of the container, the dome extending from the gate toward a resting surface of the container without contacting the resting surface, the dome surrounding the gate about the central axis, the flat feet extending from the dome to the resting surface; a sidewall connected to the base, the sidewall extending substantially along the central axis to define at least part of an interior of the container; a bell connected to the sidewall and leading upward and radially inward to a finish connected to the bell; a plurality of strap ribs positioned in the base between the flat feet, the strap ribs extending radially outward from the gate or the dome toward the sidewall, the strap rib sloping upward relative to the resting surface toward the sidewall from the gate or the dome to resist deformation of the base; a plurality of recessed columns positioned in the sidewall, the recessed columns comprising sidewall ribs extending along a periphery of the sidewall and centered about the central axis, wherein portions of the sidewall between the sidewall ribs are substantially continuous along the periphery of the sidewall, the recessed columns configured to resist at least one of bending, leaning, crumbling, or stretching along the sidewall; and/or wherein the strap ribs and the recessed columns vertically line up along the central axis to form pressure resistance bands such that each pressure resistance band comprises a strap rib vertically lined up along the central axis with a recessed column, the pressure resistance bands configured to communicate forces on the container vertically along the container between the base and the sidewall to continuously resist deformation in the base and the sidewall.

In some embodiments, the strap ribs extend radially outward from the gate of the base; the strap ribs extend radially outward from the dome of the base; the base further comprises a plurality of load ribs positioned between the strap ribs, the load ribs having a depth toward the interior of the container shallower than a depth of the strap ribs, the load ribs configured to resist deformation of the base when external forces are applied to the container; the load ribs extend radially outward from the gate or the dome; the sidewall comprises a base rib positioned along the periphery of the sidewall at a point of contact for the container with other containers when the container and the other containers are packaged together with central axes of the containers being vertical, the base rib centered about the central axis, wherein the strap ribs extend substantially up to the base rib in the sidewall, and the base rib continuously extends along the periphery of the sidewall to resist deformation of the container at the point of contact; the sidewall ribs comprise a plurality of varying depth ribs positioned along the periphery of the sidewall, wherein each varying depth rib comprises shallow sections and deep sections, the shallow sections having a rib depth less than a rib depth of the deep sections, wherein the shallow sections of the plurality of varying depth ribs vertically line up along the central axis to form the recessed columns; the shallow sections have a rib depth of substantially zero from the periphery of the sidewall; the sidewall is substantially round about the periphery of the sidewall, and wherein the plurality of recessed columns comprises three recessed columns positioned in the sidewall around the periphery of the round sidewall; the plurality of strap ribs comprises three strap ribs positioned in the base equidistantly from each other, and wherein the three strap ribs and the three recessed columns vertically line up along the central axis; the plurality of strap ribs comprises six strap ribs positioned in the base equidistantly from each other, three of the six strap ribs vertically lined up along the central axis with the three recessed columns such that each pressure resistance band further comprises an other strap rib radially extending 180 degrees opposite the strap rib, and wherein the six strap ribs are configured to inhibit triangulation of the container; the sidewall is substantially square about the periphery of the sidewall, and wherein the plurality of recessed columns comprises four recessed columns positioned in the sidewall equidistantly around the periphery of the square sidewall such that each pressure resistance band further comprises another strap rib radially extending 180 degrees opposite the strap rib, the other strap rib vertically lined up along the central axis with an other recessed column; the square sidewall comprises corners and flat portions between the corners, and wherein the strap ribs extend toward the flat portions of the square sidewall, the strap ribs configured to resist rounding of the square sidewall at the flat portions; and/or the sidewall ribs comprise a plurality of varying depth ribs positioned along the periphery of the sidewall, wherein each varying depth rib comprises shallow sections and deep sections, the shallow sections having a rib depth less than a rib depth of the deep sections, wherein the shallow sections of the plurality of varying depth ribs vertically line up along the central axis to form the recessed columns, and wherein the deep sections are positioned at the four corners of the square sidewall, the deep sections configured to resist rounding of the square sidewall at the flat portions.

In some embodiments, a container comprises a base. The container can further comprise a grip portion connected to the base through a constant depth base rib and defining a grip portion perimeter that is substantially perpendicular to a central axis. The container can further comprise a label panel portion connected to the grip portion and defining a label portion perimeter that is substantially perpendicular to the central axis. The container can further comprise a bell with an obtuse angle as measured from the central axis to a wall of the bell of at least 120 degrees, the bell connected to the label panel portion through a shoulder and leading upward and radially inward to a finish connected to the bell, the finish adapted to receive a closure. The container can further comprise a plurality of angulating and varying depth ribs positioned substantially along the perimeter of the grip portion wherein each angulating and varying depth rib comprises a plurality of shallow sections, a plurality of middle sections, and a plurality of deep sections. The container can further comprise a plurality of constant depth ribs positioned substantially along the perimeter of the label portion. The shallow sections can have a rib depth less than a rib depth of the middle sections. The deep sections can have a rib depth greater than the rib depth of the middle sections. The shallow sections of the varying depth ribs can substantially vertically line up along the central axis and form recessed columns. The recessed columns can be configured to resist at least one of bending, leaning, or crumbling, or stretching. The plurality of deep sections can be configured to provide hoop strength.

In some embodiments, a container comprises a base. The container can further comprise a grip portion connected to the base through a constant depth base rib and defining a grip portion perimeter that is substantially perpendicular to a central axis. The container can further comprise a label panel portion connected to the grip portion and defining a label portion perimeter that is substantially perpendicular to the central axis. The container can further comprise a bell with an obtuse angle as measured from the central axis to a wall of the bell of at least 120 degrees, the bell connected to the label panel portion through a shoulder and leading upward and radially inward to a finish connected to the bell, the finish adapted to receive a closure. The container can further comprise a plurality of angulating and varying depth ribs positioned substantially along the perimeter of the grip portion wherein each angulating and varying depth rib comprises a plurality of shallow sections, a plurality of middle sections, and a plurality of deep sections. The container can further comprise a plurality of varying depth ribs positioned substantially along the perimeter of the label portion wherein each varying depth rib comprises a plurality of shallow sections, a plurality of middle sections, and a plurality of deep sections. The shallow sections of the angulating and varying depth ribs can have a rib depth less than a rib depth of the middle sections of the angulating and varying depth ribs. The deep sections of the angulating and varying depth ribs can have a rib depth greater than the rib depth of the middle sections of the angulating and varying depth ribs. The shallow sections of the varying depth ribs can have a rib depth less than a rib depth of the middle sections of the varying depth ribs. The deep sections of the varying depth ribs can have a rib depth greater than the rib depth of the middle sections of the varying depth ribs. The shallow sections of the angulating and varying depth ribs can substantially vertically line up along the central axis and form a first plurality of recessed columns. The shallow sections of the varying depth ribs can substantially vertically line up along the central axis and form a second plurality of recessed columns. The first and second plurality of recessed columns can be configured to resist at least one of bending, leaning, crumbling, or stretching. The plurality of deep sections can be configured to provide hoop strength.

In some embodiments, the first plurality of recessed columns substantially vertically line up along the central axis with the second plurality of recessed columns. In some embodiments, the varying depth ribs of the label portion angulate.

In some embodiments, a container comprises a base. The container can further comprise a sidewall connected to the base, the sidewall defining a sidewall perimeter that is substantially perpendicular to a central axis and extending substantially along the central axis to define at least part of an interior of the container. The container can further comprise a bell connected to the sidewall and leading upward and radially inward to a finish connected to the bell, the finish adapted to receive a closure. The container can further comprise a varying depth rib positioned substantially along the sidewall perimeter wherein the varying depth rib comprises a shallow section, a middle section, and a deep section. The shallow section can have a rib depth less than a rib depth the middle section. The deep section can have a rib depth greater than the rib depth of the middle section. The shallow section of the rib can be configured to resist at least one of bending, leaning, or crumbling, or stretching. The deep section can be configured to provide hoop strength.

In some embodiments, the varying depth rib transitions from the shallow section to the middle section to the deep section as at least one of a gradual transition or an abrupt transition. In some embodiments, the varying depth rib has a shape of at least one of trapezoidal, triangular, rounded, squared, oval, or hemispherical. In some embodiments, the varying depth rib angulates around the sidewall perimeter. In some embodiments, the varying depth rib has a plurality of shallow sections, a plurality of middle sections, and a plurality of deep sections. In some embodiments, the contain further comprises a plurality of varying depth ribs wherein at least two shallow sections substantially vertically line up along the central axis and form a recessed column whereby the recessed column is configured to resist at least one of bending, leaning, or crumbling, or stretching. In some embodiments, the plurality varying depth ribs have a plurality of shallow sections, a plurality of middle sections, and a plurality of deep sections. In some embodiments, the container further comprises a rib of a constant depth. In some embodiments, the bell has an obtuse angle as measured from the central axis to a wall of the bell of at least 120 degrees.

In an exemplary embodiment, a container comprising a base, a bell, a sidewall between the base and the bell, a neck and a finish which define an opening to the interior of the container, and a shoulder between the sidewall and the bell, comprises a grip portion of the sidewall comprising a multiplicity of circumferentially positioned grip portion ribs; a label portion of the sidewall comprising a multiplicity of circumferentially positioned label portion ribs; a plurality of strap ribs, wherein each of the strap ribs extends substantially from a central portion of the base and terminates at a sidewall end in the grip portion, and wherein the strap ribs cooperate with recessed columns of the sidewall so as to resist at least one of bending, leaning, crumbling, or stretching along the sidewall and the base; a plurality of load ribs spaced equally between adjacent strap ribs, wherein the load ribs are configured to resist deformation of the base; and a plurality of feet formed between the strap ribs and the load ribs, wherein the plurality of feet comprises a resting surface of the container.

In another exemplary embodiment, the plurality of strap ribs comprises three strap ribs, wherein the strap ribs are equally spaced around the circumference of the base. In another exemplary embodiment, the plurality of load ribs comprises six load ribs, wherein two of the load ribs are equally spaced between two of the strap ribs. In another exemplary embodiment, each of the load ribs comprises a sidewall end which terminates along the base substantially near the sidewall of the container. In another exemplary embodiment, each of the sidewall ends of the load ribs is vertically lower than the sidewall ends of the strap ribs along the central axis. In another exemplary embodiment, the sidewall ends of the load ribs terminate along the sidewall of the container at a height along the central axis which is equal to the height of the sidewall ends of the strap ribs.

In another exemplary embodiment, the base further comprises a base rib extending around the circumference of the base, such that the base rib connects the base to the grip portion of the sidewall. In another exemplary embodiment, each of the strap ribs extends into the sidewall of the container beyond the base rib, thereby breaking the base rib into a plurality of segments. In another exemplary embodiment, the plurality of strap ribs comprises three strap ribs which break the base rib into 120-degree segments.

In another exemplary embodiment, the base further comprises a gate centered on a central axis of the container, a wall extending from the gate toward the resting surface of the container, and a dome immediately surrounding the gate, where the dome is a portion of the wall of the base that slopes more steeply toward the resting surface of the container. In another exemplary embodiment, each of the strap ribs has a base end which terminates in the dome, near the periphery of the gate. In another exemplary embodiment, the base ends terminate substantially at the periphery of the dome. In another exemplary embodiment, the base ends are positioned outside of the dome region.

In another exemplary embodiment, each of the strap ribs further comprises two rib side walls that connect the strap rib to portions of the base and the feet. In another exemplary embodiment, each of the rib side walls smoothly and gradually transitions into the base and the feet, such that the transitions comprise spherical features of the container.

In another exemplary embodiment, the strap ribs have a depth into the base which is greater than a depth of the load ribs into the base. In another exemplary embodiment, each of the strap ribs begins at the base end substantially parallel to the resting surface of the container and then extends along an upward curved path, having a first radius, with an increasingly positive slope, wherein at a first height the first radius of the curved path of the strap rib changes to a second radius with an increasingly positive slope before extending into the straight portion, and wherein at a second height the straight portion connects to the sidewall end of the strap rib. In another exemplary embodiment, the first radius and the second radius cooperate to give the strap rib and the base a smooth and gradual, spherical configuration, such that the container better accommodates internal pressure. In another exemplary embodiment, the spherical configuration accommodates at least twice the internal pressure which may be accommodated by containers having other than the spherical configuration.

In another exemplary embodiment, the first radius has a value between 20 and 85 millimeters, the second radius has a value between 0 and 30 millimeters, and the diameter of the container has a value between 30 and 200 millimeters. In another exemplary embodiment, the first radius is substantially 45 millimeters, and the second radius is substantially 10 millimeters, and the diameter of the container is substantially 66 millimeters. In another exemplary embodiment, the first height has a value between 5 and 35 millimeters, the second height has a value between 10 and 60 millimeters, and the container has a total height between 65 and 300 millimeters. In another exemplary embodiment, the first height is substantially 14.9 millimeters, the second height is substantially 26.5 millimeters, and the container has a total height between substantially 196 and 197 millimeters. In another exemplary embodiment, the strap rib further comprises a first transition curve positioned along the curved path between the first radius and the second radius and/or a second transition curve positioned on the curved path between the second radius and the straight portion, such that the strap rib and the base have a generally spherical cross-sectional shape.

In an exemplary embodiment, a plastic container configured to hold a liquid and resist deformation comprises a base portion comprising a hemispherical configuration and comprising a plurality of strap ribs extending from a central portion of the base to a circular perimeter, a plurality of load ribs disposed between adjacent strap ribs, and a plurality of feet formed between the strap ribs and the load ribs, the plurality of feet comprising a resting surface of the plastic container; a sidewall comprising a grip portion extending from the base to a label panel which extends to a shoulder, the grip portion comprising one or more circumferentially positioned grip portion ribs, and the label panel comprising one or more label panel ribs; a bell comprising a diameter which decreases as the bell extends from the shoulder to a neck; and a finish connected to the neck and configured to receive a closure, the neck and finish defining an opening to an interior of the container.

In another exemplary embodiment, the one or more grip portion ribs comprises a number of grip portion ribs ranging between 1 rib and 30 ribs disposed within a linear distance of 10 centimeters. In another exemplary embodiment, the one or more label panel ribs comprises a number of label panel ribs ranging between 1 rib and 30 ribs disposed within a linear distance of 10 centimeters.

In another exemplary embodiment, the plurality of strap ribs comprises three strap ribs that are equally spaced around a circumference of the base. In another exemplary embodiment, the plurality of load ribs comprises six load ribs, and wherein two load ribs are equally spaced between adjacent strap ribs.

In another exemplary embodiment, the plurality of strap ribs extends to a height along the base which is greater than a height of the plurality of load ribs. In another exemplary embodiment, the plurality of strap ribs extends to a height along the base which is substantially equal to a height of the plurality of load ribs.

In another exemplary embodiment, the base further comprises a base rib circumferentially extending around the circular perimeter and disposed between the base and the grip portion of the sidewall. In another exemplary embodiment, the plurality of strap ribs extends from the base into the sidewall, thereby subdividing the base rib into a plurality of equally-sized segments.

In another exemplary embodiment, the base further comprises a gate centered on a central axis of the container and a wall extending from the gate toward the resting surface of the plastic container. In another exemplary embodiment, the wall comprises a dome surrounding the gate which slopes more steeply toward the resting surface than a portion of the wall surrounding the dome. In another exemplary embodiment, the plurality of strap ribs extend from locations surrounding the periphery of the gate. In another exemplary embodiment, the plurality of strap ribs extend from the periphery of the gate.

In another exemplary embodiment, each of the plurality of strap ribs comprises two rib side walls that extend smoothly into surrounding portions of the base. In another exemplary embodiment, each of the plurality of strap ribs has a depth into the base which is greater than a depth of the plurality of load ribs.

In another exemplary embodiment, each of the plurality of strap ribs is substantially parallel to the resting surface near the central portion of the base and then extends along an upward curved path toward the sidewall of the container. In another exemplary embodiment, the upward curved path comprises at least a first curve and a second curve, both of the first and second curves having an increasingly positive slope. In another exemplary embodiment, a first straight portion is disposed between the first curve and the second curve, and a second straight portion is disposed between the second curve and a terminal end of the strap rib. In another exemplary embodiment, the first curve comprises a first radius, and the second curve comprises a second radius, both of the first and second radii being selected to give the upward curved path a spherical configuration, such that the container better accommodates internal pressure.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter discussed herein will become apparent in the teachings set forth herein. The summary is provided to introduce a selection of concepts in a simplified form that are further described below in the Detailed Description. This summary is not intended to identify key features or essential features of any subject matter discussed herein.

BRIEF DESCRIPTION OF THE DRAWINGS

The drawings refer to embodiments of the present disclosure in which.

Figure 1:
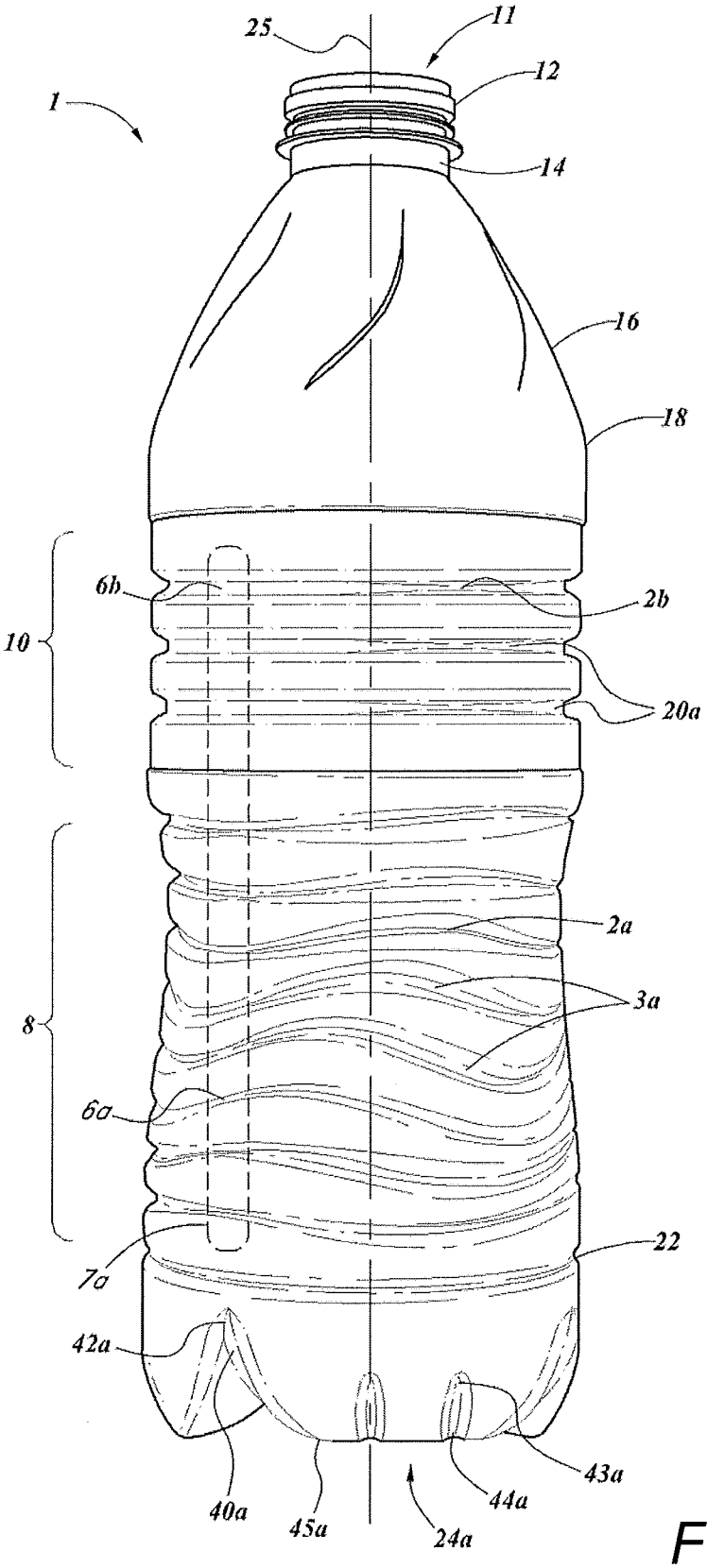
FIG. 1 illustrates a side view of an embodiment of a bottle.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally discussed herein, and illustrated in the Figures, may be arranged, substituted, combined, and designed in a wide variety of different configurations, all of which are explicitly contemplated and made part of this disclosure.

In particular, disclosed herein are articles, including preforms and containers, which utilize less plastic in their construction while maintaining or surpassing the ease of processing and excellent structural properties associated with current commercial designs.

FIG. 1 illustrates a side view of an embodiment of the bottle 1. The bottle 1 has a base 24*a* that extends up into a base rib 22. Connected to the base 24*a*, the grip portion 8 comprises a plurality of grip portion ribs 3*a* (i.e., sidewall ribs). As illustrated in FIG. 1, grip portion ribs 3*a* (positioned in the grip portion 8) may vary in depth by separating or transitioning the rib from a deep rib 2*a* to a flattened and/or shallow rib 6*a* to be discussed in further detail below. In the illustrated embodiment, the grip portion ribs 3*a* swirl or angulate around the grip portion 8.

Referring to FIG. 1, a label portion 10 is connected to the grip portion 8 and comprises one or more label panel ribs 20*a* (i.e., sidewall ribs). The label panel portion 10 transitions into a shoulder 18, which connects to a bell 16. The bell 16 may include scallops (including as illustrated) or other design features or it may be smooth and generally unornamented. The bell 16 connects to a neck 14, which connects to a finish 12. From the label portion 10, the bell 16 leads upward and radially inward, relative to a central axis 25, to the neck 14 and finish 12. The finish 12 can be adapted to receive a closure to seal contents in the bottle 1. The finish 12 defines an opening 11 that leads to an interior of the bottle 1 for containing a beverage and/or other contents. The interior can be defined as at least one of the finish 12, the neck 14, the bell 16, the shoulder 18, the label portion 10, the grip portion 8, or the base 24*a*.

A substantially vertical wall comprising the grip portion 8 and label portion 10 between the base 24*a* and bell 16, extending substantially along the central axis 25 to define at least part of the interior of the bottle 1, can be considered a sidewall of the bottle 1. In some embodiments, the sidewall may include the bell 16, shoulder 18, and/or base 24*a*. The perimeter (i.e., periphery) of the sidewall is substantially perpendicular to the central axis 25 of the interior. The sidewall defines at least part of the interior of the bottle 1. The finish 12, the neck 14, the bell 16, the shoulder 18, the label portion 10, the grip portion 8, and the base 24*a* can each define a respective perimeter or circumference (i.e., periphery) (substantially perpendicular to the central axis 25) corresponding to that portion. For example, the label portion 10 has a label portion perimeter. As another example, the grip portion 8 has a grip portion perimeter.

In the embodiment illustrated in FIG. 1, each of the grip portion ribs 3*a* comprises a deep rib 2*a* section transitioning to a middle section 4*a* then to a flattened and/or shallow rib 6*a* sections. As FIG. 1 illustrates, each of the label panel ribs 20*a* may comprise a deep rib 2*b* section transitioning to a middle section 4*b* then to a flattened and/or shallow rib 6*b* sections. The deep, middle, and shallow rib sections may also be called deep, middle, and shallow ribs as shorthand, but it is to be understood that these terms are meant to define sections of a rib in the grip portion 8, label portion 10, and base rib 22. A varying depth grip portion rib 3*a* transitions from a deep rib 2*a* section to a middle rib/section 4*a* then to a flattened and/or shallow rib 6*a* section. A varying depth label panel rib 20*a* transitions from a deep rib 2*b* to a middle rib/section 4*b* then to a flattened and/or shallow rib 6*b*. The one or more flattened and/or shallow ribs 6*a,b* form an equivalent of recessed columns 7*a* at portions where a plurality flattened and/or shallow ribs 6*a,b* substantially vertically line up along the vertical or central axis 25 of the bottle 1 as illustrated in FIG. 1. A plurality of deep ribs 2*a,b* substantially vertically line up along the vertical or central axis 25 of the bottle 1 as illustrated in FIG. 1.

In some embodiments, the flattened and/or shallow ribs 6*b* of the label panel ribs 20*a* are vertically misaligned with the flattened and/or shallow ribs 6*a* of the grip portion ribs 3*a* such that the label portion 10 has a set of recessed columns and the grip portion 8 has another set of recessed columns. Thus, the recessed column of the label portion 10 can be vertically misaligned from the recessed columns of the grip portion 8. In some embodiments, the bottle 1 can have recessed columns in just the grip portion 8 or just the label panel portion 10.

In the illustrated embodiments with three lined-up flattened and/or shallow ribs 6*a,b*, the bottle respectively has three recessed columns 7*a*. The three recessed columns 7*a* may be equally spaced apart around the circumference of the bottle 1 and located on the opposite side of the bottle circumference from the deep rib 2*a,b* portions. With three equally spaced recessed columns 7*a*, the recessed columns 7*a* are spaced every 120 degrees around the bottle 1 circumference. Any number of recessed columns 7*a* may be incorporated into a design of the bottle 1 by increasing or decreasing the number of flattened and/or shallow ribs 6*a,b* that substantially vertically line up along the vertical or central axis 25. For instance, the bottle may have as few as 1 or up to 10 recessed columns 7*a*, including 2, 3, 4, 5, 6, 7, 8, or 9 recessed columns 7*a*, including ranges bordered and including the foregoing values. The collections of flattened and/or shallow ribs 6*a,b* that form recessed columns 7*a* provide resistance to leaning, load crushing, and/or stretching. Leaning can occur when during and/or after bottle packaging, a bottle experiences top load forces (tangential forces or otherwise) from other bottles and/or other objects stacked on top of the bottle. Similarly, top load crushing can occur due to vertical compression (or otherwise) forces from bottles and/or other objects stacked on top. Stretching can occur when a bottle is pressurized. The recessed columns 7*a* transfer the resulting forces along the wall to the base 24*a* and increase bottle 1 rigidity. Deep ribs 2*a,b* of the grip portion ribs 3*a* and label panel ribs 20*a* provide the hoop strength that can be equivalent to the hoop strength of normal or non-varying depth ribs. The number of ribs, including base ribs 22, grip portion ribs 3*a*, and/or label panel ribs 20*a* may vary from 1 to 30 ribs every 10 centimeters of any rib containing portion of the bottle, such as, but not limited to the grip portion 8 and/or label panel portion 10, including 1, 2, 3, 4, 5, 6, 7, 8, 9, 10, 11, 12, 13, 14, 15, 16, 17, 18, 19, 20, 21, 22, 23, 24, 25, 26, 27, 28, or 29 ribs every 10 centimeters, including ranges bordered and including the foregoing values. The aforementioned 10 centimeter section that is used to measure the number of ribs need not be actually 10 centimeters in length. Rather, 10 centimeters is used illustratively to provide a ratio for the number of ribs.

While discussed above in reference to FIG. 1, as will be apparent, recessed column features, functions, and variations thereof may be applied to any of the embodiments discussed in reference to FIGS. 2-28. For a further discussion of the recessed columns, refer to U.S. Pat. No. 8,556,098, entitled "Plastic Container Having Sidewall Ribs with Varying Depth," the entirety of which is incorporated herein by reference.

With continued reference to FIG. 1, the base 24*a* has a strap rib 40*a*. The strap rib 40*a* has a sidewall end 42*a* that terminates along the sidewall of the bottle 1 as discussed herein. The base has 24*a* has a load rib 44*a*. As illustrated in FIG. 1, the base 24*a* can have two load ribs 44*a* between two strap ribs 40*a*. In some embodiments, the base 24*a* can have 1, 3, 4, and 5 load ribs 44*a* between two strap ribs 40*a*. The load rib 44*a* has a sidewall end 43*a* that terminates along the base 24*a* near or at a transition from the base 24*a* to the sidewall of the bottle 1. As illustrated in FIG. 1, the sidewall end 43*a* of the load rib 44*a* may be vertically lower than the sidewall end 42*a* of the strap rib 40*a* along the central axis 25. In some embodiments, the sidewall end 43*a* of the load rib 44*a* may terminate along the sidewall of the bottle 1 at a same height as to the sidewall end 42*a* of the strap rib 40*a*. The base 24*a* has feet 45*a* formed between the strap ribs 40*a* and the load ribs 44*a*.

The strap rib 40*a* is relatively larger and deeper than the load rib 44*a* as discussed herein. As illustrated in FIG. 1, the strap base rib 40*a* may vertically align with the recessed columns 7*a*. Where a bottle 1 has three recessed columns 7*a*, the base 24*a* can have three strap ribs 40*a*. The strap ribs 40*a* are spaced equally around the circumference of the bottle 1. With three equally spaced strap ribs 40*a*, the strap ribs 40*a* are positioned every 120 degrees around the bottle circumference. The load ribs 44*a* can vertically align with the grip portion rib 3*a* sections between the recessed columns 7*a*. In some embodiments, the strap ribs 40*a* may be vertically misaligned with the recessed columns 7*a*. In some embodiments, the strap ribs 40*a* may be spaced unequally around the bottle circumference. In some embodiments, the base 24*a* may have more or less strap ribs 40*a* than the number of recessed columns 7*a*.

Figure 2:
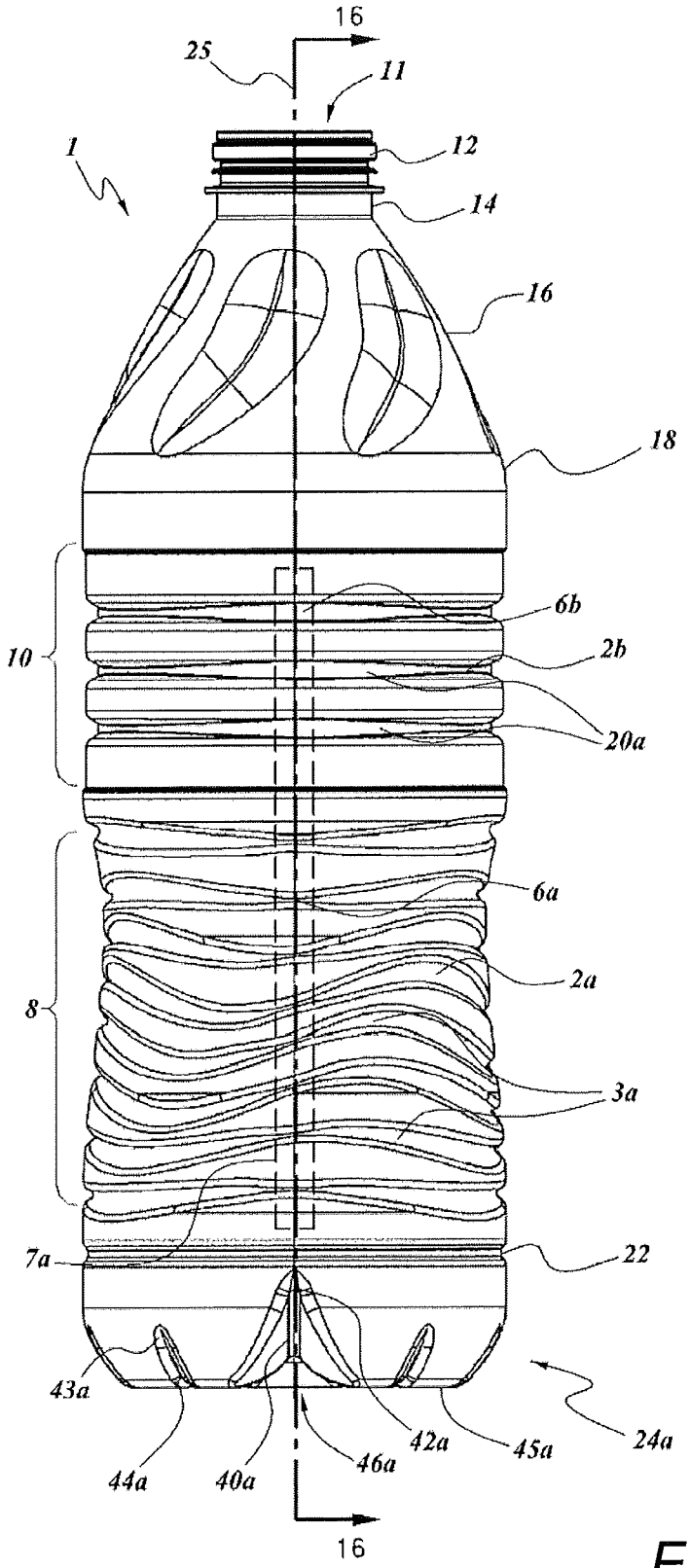
FIG. 2 illustrates a side view of the embodiment shown in FIG. 1 rotated 60 degrees.

FIG. 2 illustrates a side view of the embodiment shown in FIG. 1 rotated 60 degrees. The sidewall end 42*a* of the strap rib 40*a* vertically aligns or points to substantially the center of the recessed columns 7*a* (center point of the shallow and/or flattened ribs 2*a,b*). As illustrated in FIG. 2, the strap rib 40*a* forms a recess 46*a* from a side view perspective. The recess 46*a* is relatively a small area in comparison to feet 45*a* contact area with a resting surface. A small recess 46*a* aids in distributing more resin toward the feet 45*a* during the blowing process. More resin at the feet 45*a* increases the abrasion resistance and strength of the feet 45*a*. Thus, strap ribs 40*a* can function to provide internal pressure resistance while leaving enough resin for the feet 45*a* to achieve the benefits of a flat foot base (i.e., thicker resin feet 45*a* for greater abrasion, deformation, and/or stress resistance; and/or greater foot contact area for stability and load distribution).

The strap rib 40*a* can extend substantially from a central portion of the base 24*a* (from the central axis 25) as discussed herein. The strap rib 40*a* can act as a strap between the recessed columns 7*a* of the sidewall to the central portion of the base 24*a*. As shown in FIG. 2, the strap rib 40*a* provides a more direct and shorter path to the center of the base 24*a* from the sidewall of the bottle 1 without proceeding to the vertical level of the feet 45*a*. As discussed herein, the strap ribs 40*a* thus provide a relatively more pressure resistant base 24*a*. The strap rib 40*a* provides a link for forces and stresses between the sidewall, including the recessed column 7*a*, and the central portion of the base 24*a*.

Figure 3:
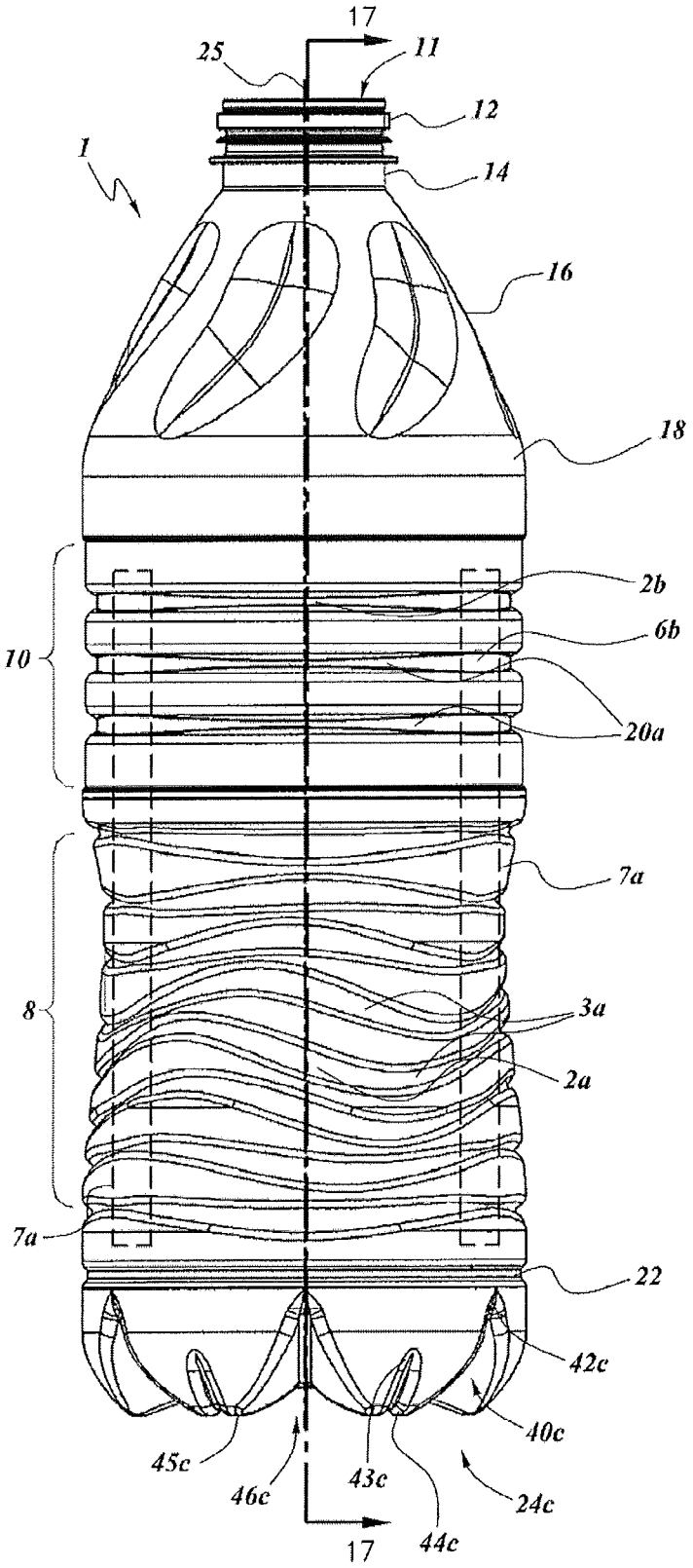
FIG. 3 illustrates a side view of an embodiment of a base having six strap ribs.

FIG. 3 illustrates a side view of an embodiment of a base 24*c* having six strap ribs 40*c*. Three strap ribs 40*c* can vertically align with recessed columns 7*a*. The other three strap ribs 40*c* can vertically align along the central axis substantially at the deep ribs 2*a,b* of the grip portion ribs 3*a* and the label panel ribs 20*a*. The strap ribs 40*c* are equally spaced around the circumference of the bottle 1. With equally spaced strap ribs 40*c*, the strap ribs 40*c* are positioned every 60 degrees around the bottle circumference. Under pressure, the deep rib 2*a,b* sections may flex out, triangulating the bottle 1. Triangulation of the bottle 1 can occur in the grip portion 8 and/or label portion 10. The strap ribs 40*a* vertically aligned with the deep rib 2*a,b* sections can at least partially prevent the flexing out of the deep ribs 2*a,b*. The strap ribs 40*a* vertically aligned with the deep ribs 2*a,b* resist outward radial expansion, which in turn can help prevent outward radial expansion at the grip portion 8 and/or the label portion 10. Preventing outward radial expansion at the grip portion 8 and/or the label portion 10 helps prevent triangulation of the bottle 1. Preventing triangulation helps retain bottle roundness for consumer appeal. Further, maintaining bottle roundness aids in ensuring a labeler during the bottling process correctly labels the bottle. The labeler may not be able to properly label a triangulated bottle.

Figure 4:
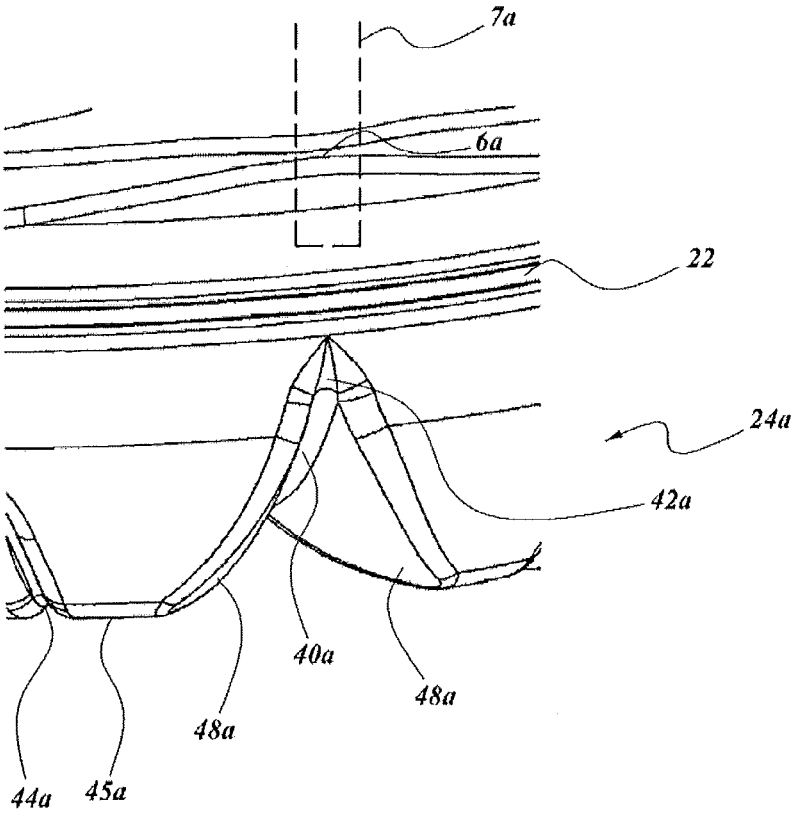
FIG. 4 illustrates a top perspective view of an embodiment of a strap rib.

FIG. 4 illustrates a top perspective view of an embodiment of a strap rib 40*a*. As shown in FIG. 4, the strap rib 40*a* has a sidewall end 42*a* that terminates at substantially the edge or boundary of the base rib 22. The illustrated sidewall end 42*a* terminating at or near the base rib 22 still allows for the strap rib 40*a* to communicate with the recessed column 7*a* through the base rib 22 as discussed herein. By the strap rib 40*a* not proceeding beyond the base rib 22, the base rib 22 is maintained as an unbroken rib around the perimeter of the bottle 1. As discussed herein, the base rib 22 can act as a contact point with other bottles during packaging, shipping, and/or handling. An unbroken base rib 22 can better resist stresses and deformation placed on the bottle when contacted by or bumped against other bottles or structures. Thus, where retaining contact point integrity is desired, such as for example unpressurized or relatively low pressurized bottle applications, the base rib 22 can remain unbroken with the sidewall end 42*a* of the strap rib 40*a* terminating at or near the base rib 22.

Figure 5:
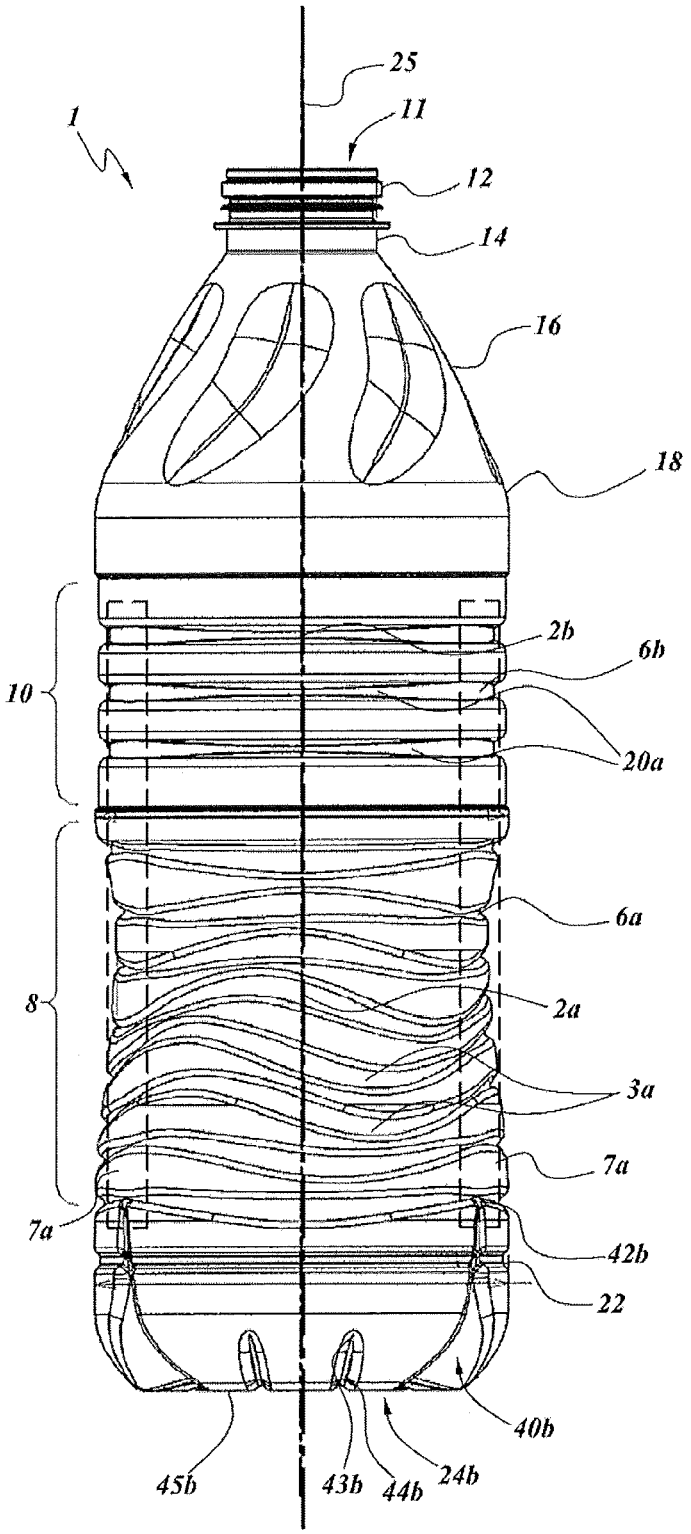
FIG. 5 illustrates a side view of another embodiment of a bottle.

FIG. 5 illustrates a side view of an embodiment of a base 24*b* with a strap rib 40*b* leading into the sidewall of the bottle 1 beyond the base rib 22. As shown in FIG. 5, the sidewall end 42*b* of the strap rib 40*b* may terminate in the grip portion 8, such as at a first flattened and/or shallow rib 6*a* (first from the base 24*b*) when the strap rib 40*b* vertically aligns with the recessed column 7*a*. In some embodiments, the strap rib 40*b* may vertically align with the deep ribs 2*a,b* and may terminate into a first deep rib 2*a* (first from the base 24*b*). In some embodiments, the strap rib 40*b* may have a sidewall end 42*a* that terminates past the first shallow rib 6*a* and/or the first deep rib 2*a*, such as for example at the second, third, and/or third fourth grip portion ribs 3*a*.

Figure 5A:
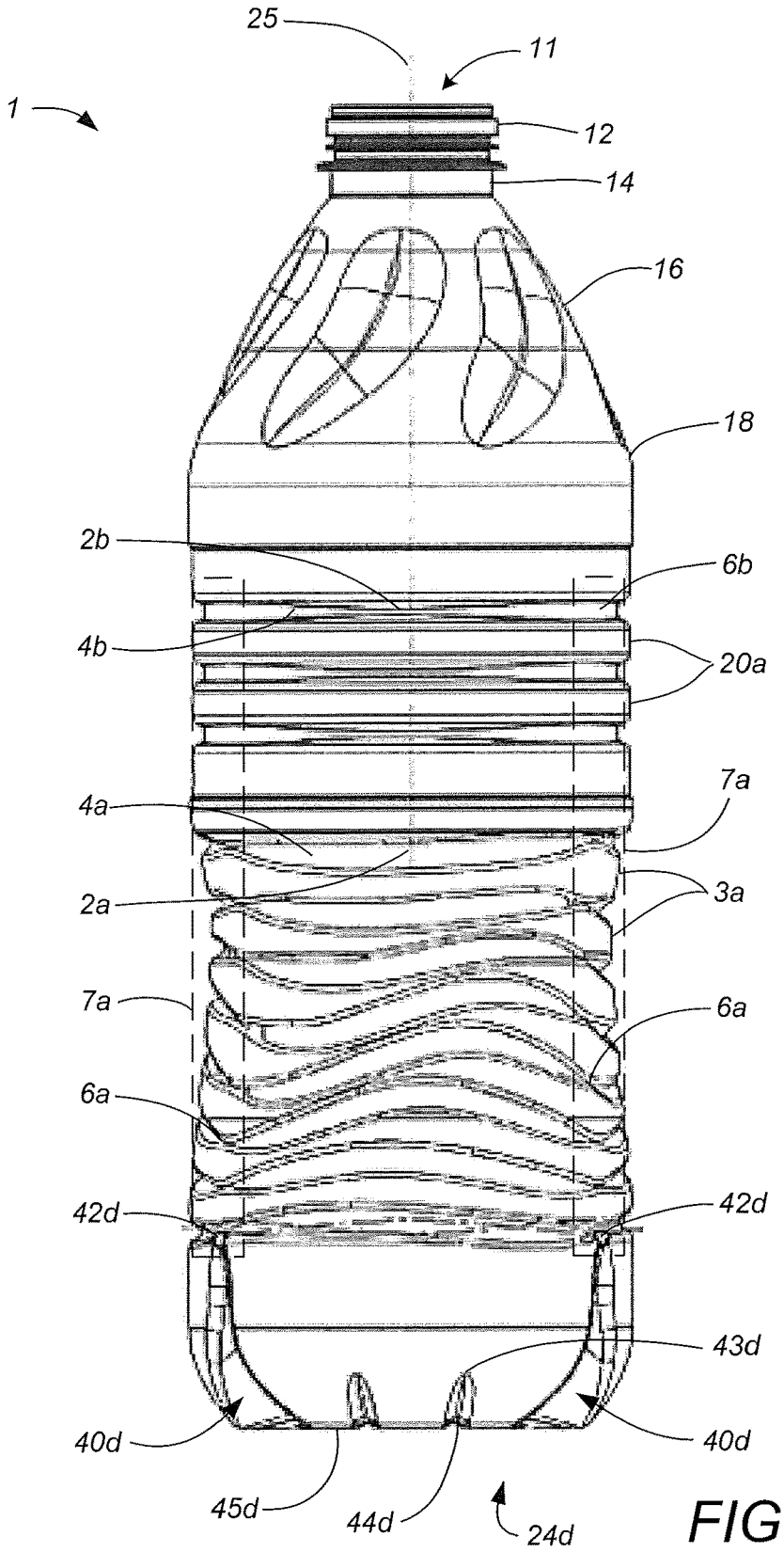
FIG. 5A illustrates a side view of another embodiment of the bottle.

FIG. 5A illustrates a side view of another embodiment of the bottle 1 comprising a base 24*d*, three strap ribs 40*d*, and six load ribs 44*d*. The base 24*d* has feet 45*d* formed between the strap ribs 40*d* and the load ribs 44*d*. Each of the strap ribs 40*d* extends substantially from a central portion of the base 24*d* and terminates at a sidewall end 42*d* in the grip portion 8, as discussed in connection with embodiments illustrated in FIGS. 1-2. The strap ribs 40*d* cooperate with the recessed columns 7*a* of the sidewall to resist bending, leaning, crumbling, or stretching along the sidewall and the central portion of the base 24*d*. In the embodiment illustrated in FIG. 5A, two load ribs 44*d* are spaced equally between two of the strap ribs 40*d*. In other embodiments, the base 24*d* may have more or less than two of the load ribs 44*d* positioned between two of the strap ribs 40*d*. Each of the load ribs 44*d* has a sidewall end 43*d* which terminates along the base 24*d* near or at a transition from the base 24*d* to the sidewall of the bottle 1. As illustrated in FIG. 5A, each of the sidewall ends 43*d* is vertically lower than the sidewall ends 42*d* along the central axis 25. In other embodiments, however, the sidewall ends 43*d* of the load rib 44*d* may terminate along the sidewall of the bottle 1 at a height along the central axis 25 which is equal to the sidewall ends 42*d* of the strap ribs 40*d*.

Figure 6:
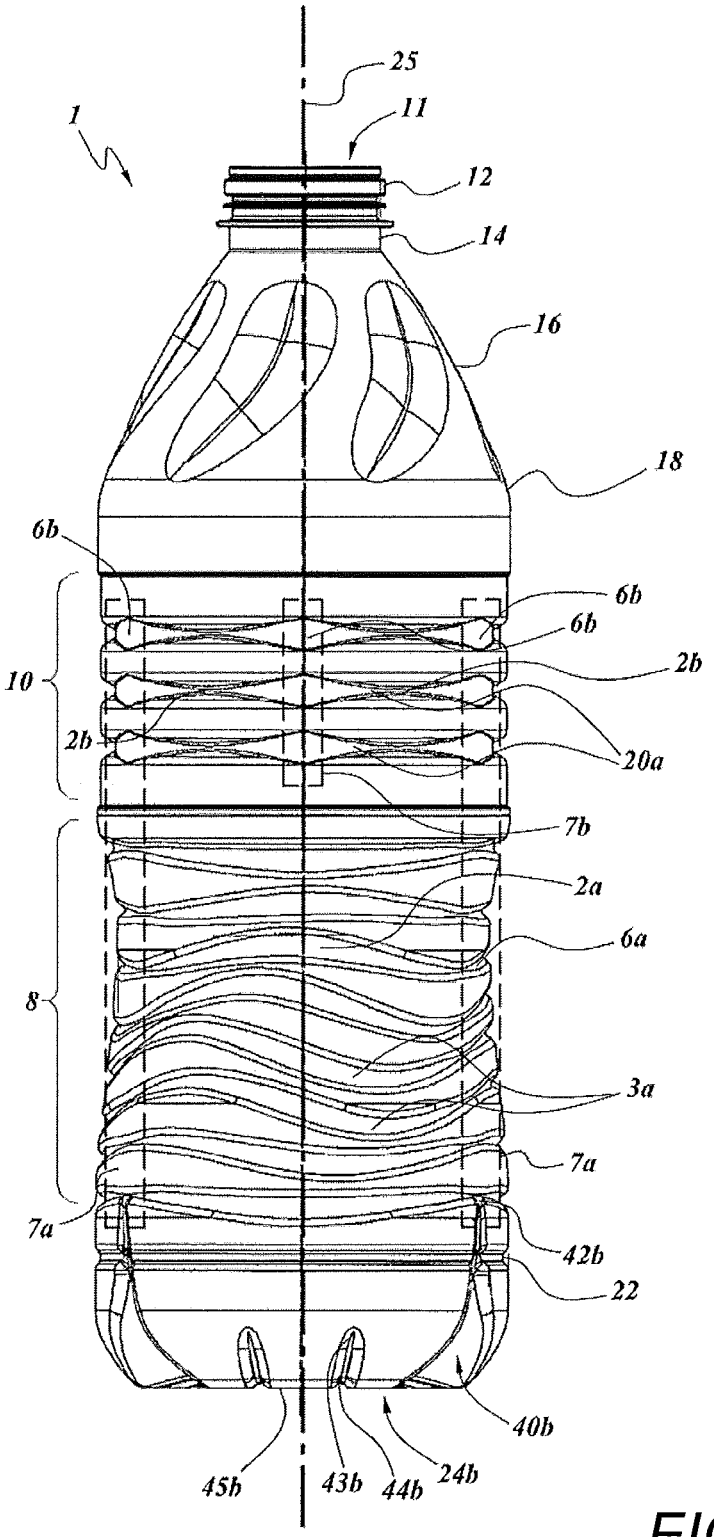
FIG. 6 illustrates a side view of an embodiment of a bottle with six recessed columns in a label portion.

FIG. 6 illustrates a side view of an embodiment of a label portion 10 with six recessed columns 7*b*. As shown in FIG. 6, the label portion 10 may have six shallow ribs 6*b* that align vertically. Each vertical alignment of the shallow ribs 6*b* forms a recessed column 7*b*. The recessed columns 7*b* are equally spaced around the circumference of the bottle 1. With six equally spaced recessed columns 7*b* around the bottle circumference, the recessed column 7*b* are positioned every 60 degrees around the bottle circumference. More recessed columns 7*b* can help prevent triangulation of the bottle 1, including in the label portion 10, as discussed herein. Shallow ribs 6*a,b* and/or recessed columns 7*a,b* better resist radially outward flexing, at least partially because shallower ribs have less radial depth to provide a range for flexing. Correspondingly, shallow ribs 6*a,b* and/or recessed columns 7*a,b* have better resistance to internal pressure relative to the deep ribs 2*a,b*. Thus, more frequent shallow ribs 6*a,b* and/or recessed columns 7*a,b* around the bottle circumference helps inhibit triangulation of the bottle 1. In some embodiments, the six recessed column 7*b* may be combined with embodiments illustrated in FIG. 3 with six strap ribs 40*c*. Accordingly, such embodiments may better resist triangulation in both label portion 10 and the grip portion 8 as discussed herein. As shown in FIG. 6, having three recessed columns 7*a* in the grip portion 8 with six recessed column 7*b* in the grip portion 10 helps achieve rigidity in the grip portion 8 with the three regions of deep ribs 2*a* providing hoop strength while avoiding triangulation in the label portion 10 with six recessed columns 7*b* inhibiting flexing out of the sidewalls, particularly at the label portion 10.

Figure 6A:
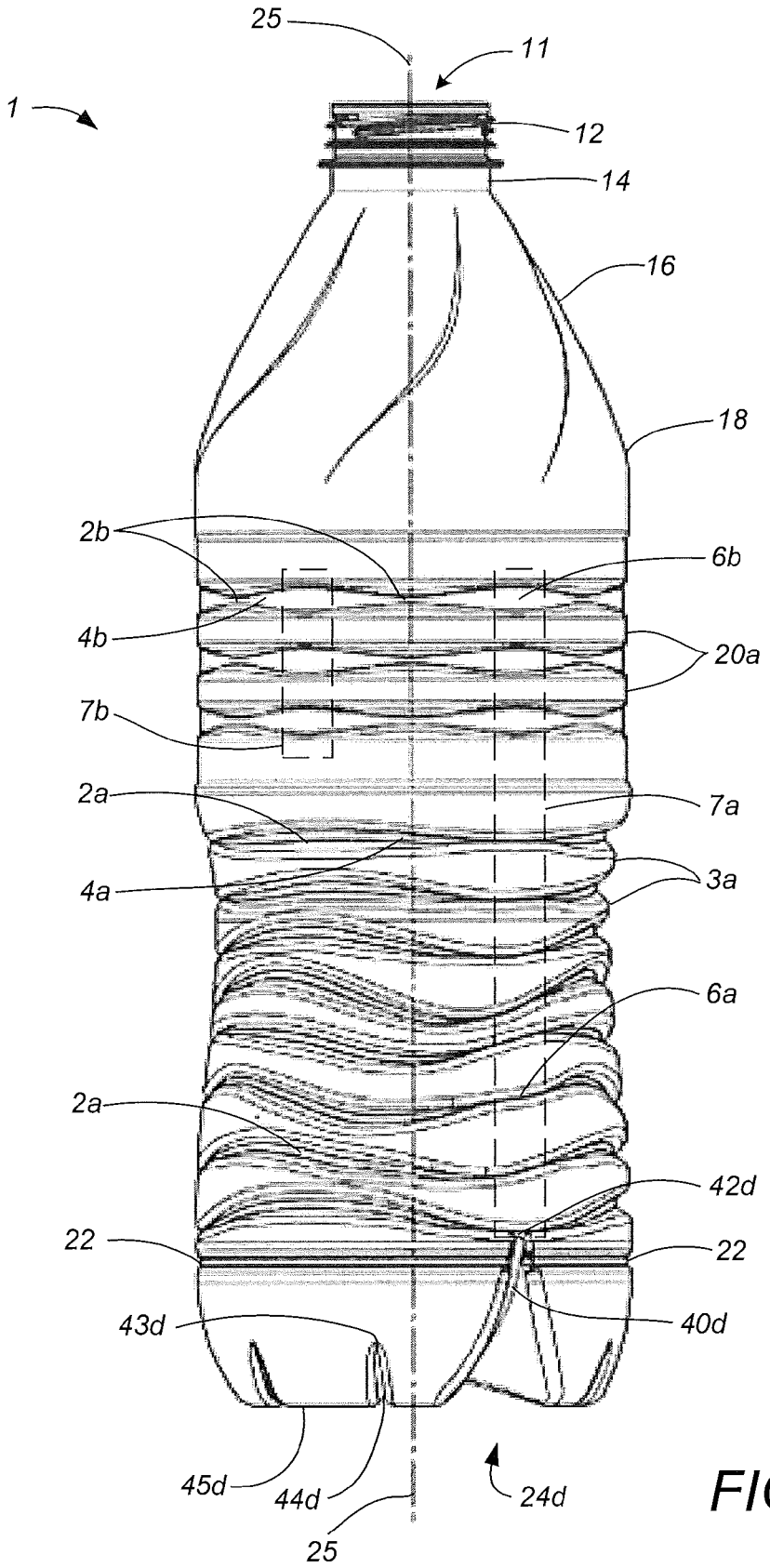
FIG. 6A illustrates a side view of another embodiment of the bottle with columns in the label portion.

FIG. 6A illustrates a side view of another embodiment of the bottle 1 comprising a label portion 10 with six recessed columns 7*b* equally spaced around the circumference of the bottle 1. It will be appreciated by those skilled in the art that three of the recessed columns 7*b* are aligned with the recessed columns 7*a* in the grip portion 8 of the bottle 1, and thereby function as extensions of the columns 7*a*. Furthermore, the embodiment of the bottle 1 illustrated in FIG. 6A is substantially similar to the embodiment illustrated in FIG. 5A, with the exception that the bottle 1 illustrated in FIG. 6A further comprises a base rib 22. Each of the three strap ribs 40*d* extends into the sidewall of the bottle 1 beyond the base rib 22, thereby breaking the base rib 22 into 120-degree segments. It will be apparent to those of ordinary skill that the numbers of the recessed columns 7*a,b*, the strap ribs 40*d*, and the load ribs 44*d*, as well as the specific implementation of the base rib 22, may be varied from those shown herein without deviating from the spirit and scope of the present invention.

Figure 7:
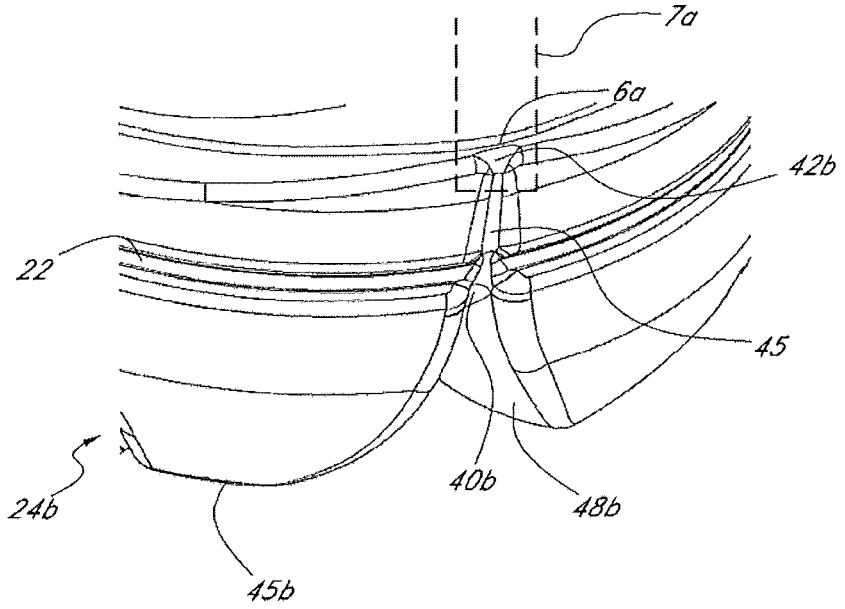
FIG. 7 illustrates a top perspective view of another embodiment of a strap rib.

FIG. 7 illustrates a top perspective view of an embodiment of a strap rib 40*b*. As shown in FIG. 7, the strap rib 40*b* has a sidewall end 42*b* that terminates substantially at or in the first shallow rib 6*a* (first from the base 24*b*) via a straight portion 45 as discussed herein, and in particular, as discussed in reference to FIG. 19. A sidewall end 42*b* that proceeds into the grip portion 8 of the bottle, such as into the grip portion ribs 3*a*, allows the strap rib 40*b* to directly connect or communicate with a recessed column 7*a*. The direct communication of the strap rib 40*b* and the recessed column 7*a* can help achieve resistance to internal pressure as discussed herein. The direct communication between the strap rib 40*b* and the recessed column 7*a* can help achieve better transfer and resistance to stresses placed on a bottle as discussed herein.

Figure 7A:
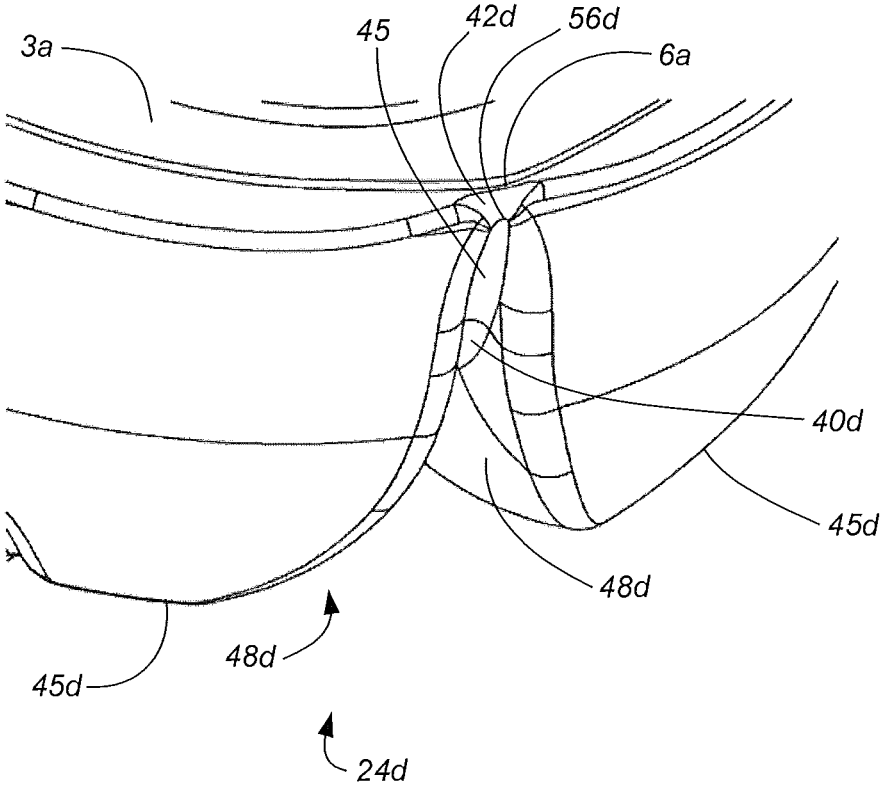
FIG. 7A illustrates a top perspective view of an embodiment of a strap rib.

FIG. 7A illustrates a top perspective view of an embodiment of the strap rib 40*d*, as illustrated in FIG. 5A. In the illustrated embodiment of FIG. 7A, the strap rib 40*d* comprises the straight portion 45 and a sidewall end 42*d* which terminates substantially at or in the first shallow rib 6*a*. As discussed herein, extending the sidewall ends 42*d* into the grip portion 8 of the bottle 1, such as into the grip portion ribs 3*a*, enables the strap ribs 40*d* to operate in conjunction with the recessed columns 7*a* to achieve resistance to internal pressure as discussed herein. The direct communication between the strap ribs 40*d* and the recessed columns 7*a* achieves a better transfer of, and resistance to, stresses placed on a bottle as discussed herein.

Figure 8A:
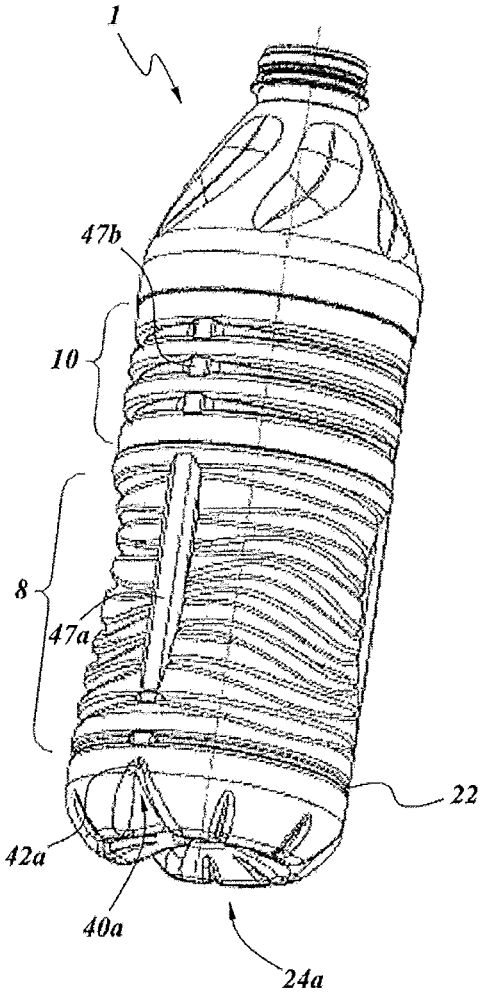
FIGS. 8A and 8B illustrate bottom perspective views of embodiments of bottles with columns in the sidewalls.
Figure 8B:
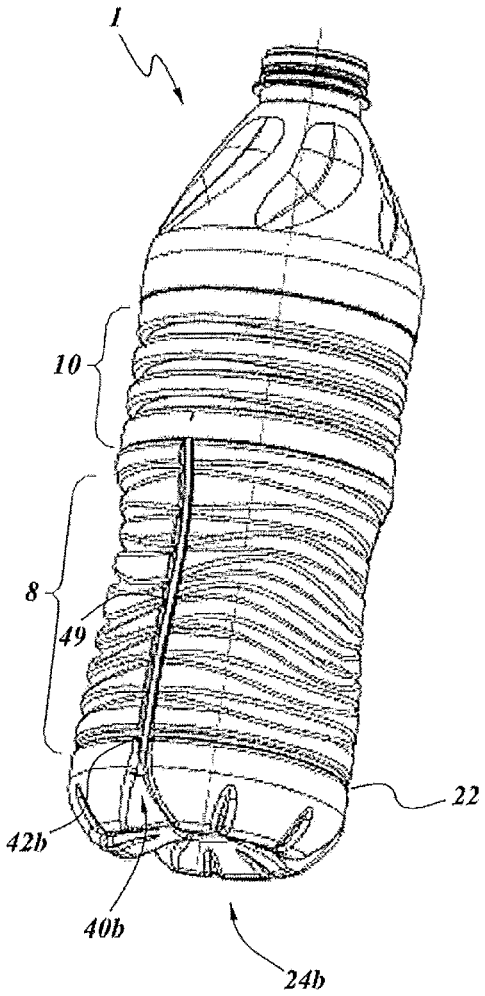

FIGS. 8A and 8B illustrate a bottom perspective view of embodiments of the bottle 1 with columns in the sidewalls. As shown in FIG. 8A, the bottle 1 may have a protruding column 47*a,b*. A protruding column may be considered a column that radially protrudes outward from an immediately surrounding surface formed by, for example, the sidewall of the bottle 1. The protruding column has a grip portion 8 (including the base rib 22) protruding column 47*a* and a label portion 10 protruding column 47*b*. The protruding column 47*a,b* can resist bending, leaning, and/or stretching as discussed herein. The protruding column 47*a,b* can also resist radially outward flexing at and near the protruding column 47*a,b*. The protruding column 47*a,b* is formed substantially along the entire length or height of the bottle sidewall without breaking the continuity of other bottle contact points of the bottle as discussed herein, such as, for example, at or near the base rib 22. As shown in FIG. 8A, the base 24*a* has a strap rib 40*a* that substantially vertically aligns with the protruding column 47*a,b*. The alignment of the protruding column 47*a,b* with the strap rib 40*a* achieves substantially the same resistance to bending, leaning, stretching, and/or base rollout as discussed herein in reference to the base rib 40*a* vertically aligning with a recessed column 7*a*.

As shown in FIG. 8B, the bottle 1 may have an indented column 49. An indented column may be considered a column that radially indents inwardly from an immediately surrounding surface formed by, for example, the sidewall of the bottle 1. The indented column 40 is positioned in the grip portion 8 (including the base rib 22). The indented column 49 can resist bending, leaning, and/or stretching as discussed herein. The indented column 49 can also resist radially outward flexing at and near the indented column 49. The indented column 49 can achieve the desired function discussed herein while avoiding protruding from a perimeter of the sidewall of the bottle 1. The indented column 49 can project through, for example, the base rib 22, making the base rib 22 discontinuous. A discontinuous rib 22 can be utilized in pressurized bottle applications where at least some of the contact point resistance as discussed herein is provided due the bottle being pressurized. As shown in FIG. 8A, the base 24*b* has a strap rib 40*b* that substantially vertically aligns with the intended column 49. The strap rib 40*b* transitions into the indented column 49 continuously for potentially better functionality. The strap rib 40*b* can directly communicate with the indented column 49 by the strap rib 40*b* directly transitioning into the indented column 49, through, for example, the base rib 22 as illustrated in FIG. 8B. The alignment and direct communication of the strap rib 40*b* with the indented column 49 helps form a pressure resistance strap as discussed herein, and in particular, in reference to FIGS. 16, 17, and 25. The alignment and direct communication of the indented column 49 with the strap rib 40*b* achieves substantially the same resistance to bending, leaning, stretching, and/or base rollout as discussed herein in reference to the base rib 40*b* vertically aligning with a recessed column 7*a*.

Figure 9:
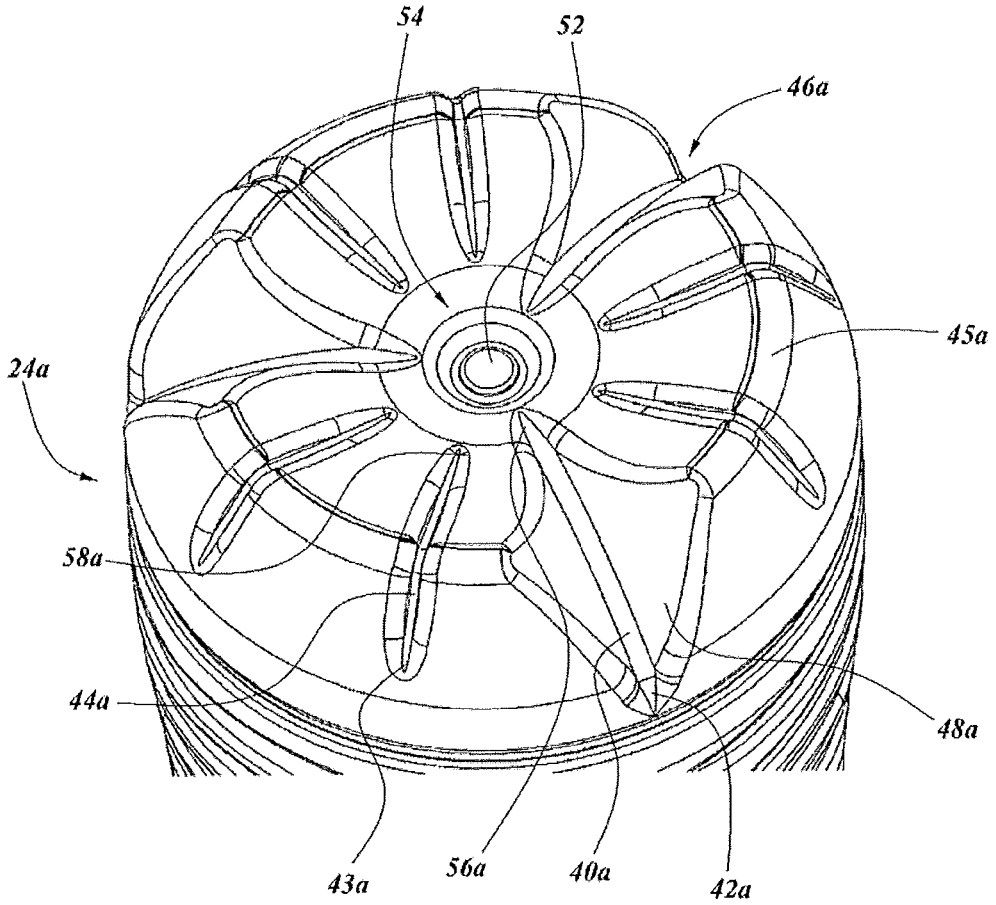
FIG. 9 illustrates a bottom perspective view of an embodiment of a base.

FIG. 9 illustrates a bottom perspective view of an embodiment of the base 24*a*. The base 24*a* has a strap rib 40*a* and a load rib 44*a* as discussed herein. The base 24*a* has a gate 52. As shown in FIG. 9, the base 24*a* may have a dome 54. The dome 54 may be considered the area generally or immediately around the gate 52. The dome 54 may be termed as a push up of the base 24*a*. For example, the dome 54 is a wall of the base 24*a* that slopes more steeply toward a resting surface when the bottle is vertically placed on the resting surface relative to the rest of the wall of the base 24*a* leading to legs the 45*a* of the base 24*a*.

The strap rib 40*a* has a base end 56*a* that terminates near, at, or in the dome 54. In some embodiments, the base end 56*a* for a strap rib 40*a* can be positioned outside of the dome 54 region similarly to base ends 58*a* for load ribs 44*a*. The strap rib 40*a* has a petal side wall (i.e., rib side or valley wall) 48*a* that connects that strap rib 40*a* to portions of the base 24*a* and the feet 45*a* of the base 24*a*. The rib side wall 48*a* smoothly and gradually transitions into the base 24*a* and the feet 45*a*. The smooth and gradual transition provides internal pressure resistance at and near the rib side wall 48*a* since more spherical features of the bottle 1 can better accommodate internal pressure. The strap rib 40*a* is relatively deeper in the base 24*a* than the load rib 58*a* to provide stress transfer and pressure resistance as discussed herein.

The load rib 44*a* has a base end 58*a* that terminates at, near, or at the dome 54. As shown in FIG. 9, the base end 58*a* of the load rib 44*a* may terminate before the base end 56*a* of the strap rib 40*a*. The load rib 44*a* is shallow relative to the strap rib 40*a*. As show in FIG. 9, the load rib 44*a* may not have or may have a smaller rib side wall 48*a* feature as discussed herein reference to the strap rib 40*a*. The transition from the load rib 44*a* to the base 24*a* and the feet 45*a* is more abrupt or sharper. The sharper transition provides external stress resistance relative to a shallow rib side 48*a*. When the bottle 1 is top loaded during packaging, shipping, and/or handling, sharper transitions of the load ribs 44*a* help resist bending and/or leaning as discussed herein by, for example, maintaining the integrity and shape of the base 24*a*.

The sharper transitions provide for faster transitions into the feet 45*a* of the base 24*a*. Faster transitions lead to more area of the base 24*a* being available for relatively larger feet 45*a*. Larger feet 45*a* of a flat foot base 24*a* as discussed herein and as illustrated in FIG. 9 provide more resin contact area with a resting surface. More resin contacting the resting surface provides better abrasion resistance and stability of the base 24*a*.

As shown in FIG. 9, the rib side wall 48*a* may transition into the strap rib 40*a* itself more abruptly or sharply relative to the transition from the wall 48*a* to the feet 45*a*. The sharper transitions at the strap rib 40*a* itself may provide more rigidity to the strap rib 40*a* to resist or inhibit flexing due to internal pressures as discussed herein.

Figure 10:
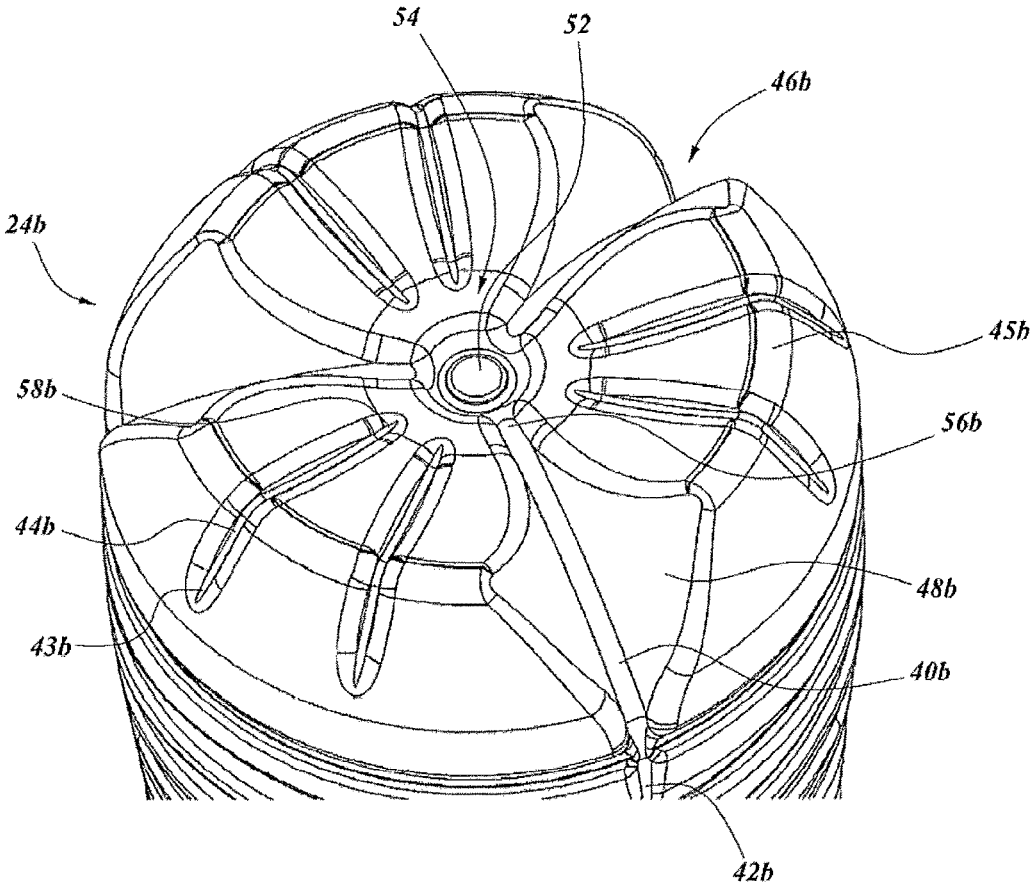
FIG. 10 illustrates a bottom perspective view of another embodiment of a base.

FIG. 10 illustrates a bottom perspective view of an embodiment of the base 24*b*. The base 24*b* has a strap rib 40*b* and a load rib 44*b* as discussed herein. The strap rib 40*b* has a base end 56*b* that terminates near, at, or in the dome 54. As shown in FIG. 10, the base end 56*b* of the strap rib 40*b* may terminate substantially near or at the gate 52. The load rib 44*b* has a base end 58*b* that terminates near, at, or in the dome 54. As shown in FIG. 10, the base end 58*b* of the load rib 44*b* may terminate before the base end 56*b* of the strap rib 40*b*. Terminating the base ends 56*b* of the strap rib 40*b* and/or the base end 58*b* of the load rib 44*b* substantially near or at the gate 52 can provide more internal pressure resistance to the base 24*b* as discussed herein, helping prevent, for example, base 24*b* rollout. Terminating the base ends 56*b* of the strap rib 40*b* substantially near or at the gate 52 provides a strap rib 40*b* that is continuous from (or near) the gate 52 to the sidewall end 42*b*. As shown in FIG. 7 and FIG. 10, the sidewall end 42*b* may terminate at the first shallow rib 6*a* and communicate directly with a recessed column 7*a*. The continuity from the recessed column 7*a* to the gate 52 provides a substantially continuous pressure resistance band or strap from a top of the label portion 10 to the gate 52. A pressure resistance strap 9*a,b* (FIGS. 16 and 17) that is substantially continuous can provide greater resistance to internal pressure as discussed herein.

Figure 11:
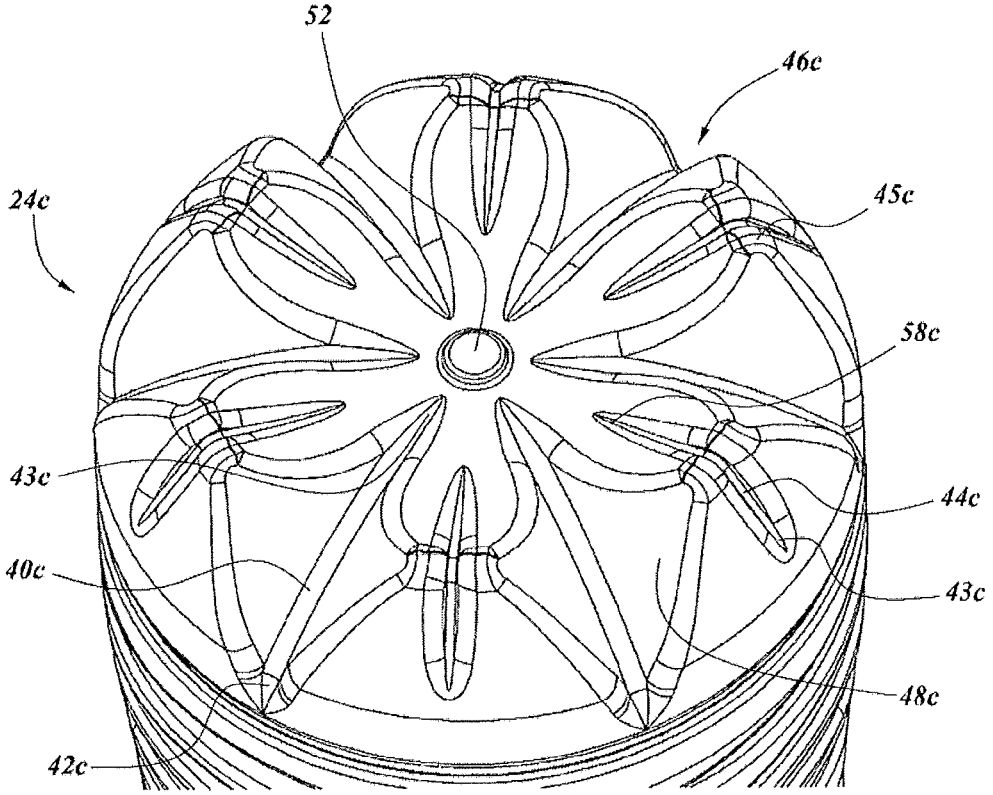
FIG. 11 illustrates a bottom perspective view of another embodiment of a base.

FIG. 11 illustrates a bottom perspective view of an embodiment of the base 24*c*. The base 24*c* has a strap rib 40*c* and a load rib 44*c* as discussed herein. As shown in FIG. 11, the base 24*c* does not have a dome. The walls of the base 24*c* radially extend directly from the gate 52. Not having a dome helps prevent puddle formation of resin near the gate 52. Avoiding puddle formation can reduce wasted resin. As shown in FIG. 11, without a dome 54, the strap rib 40*c* can extend directly or nearly continuously to the gate 52. The strap rib 40*c* can terminate near or at the gate 52 with a smooth transition into the wall near the gate 52 or the gate itself 52. The smooth transitions from the gate 52, the wall around the gate 52, the base end 43*c*, and/or strap rib 40*c* create a more uniform wall or surface of the base 24*c*, particularly around the gate 52 where a majority of the flexing due to base rollout occurs. The more uniform wall feature is better able to resist internal pressure as discussed herein, and in particular, resistance to bottle stretching and base rollout. The resistance to internal pressure is further enhanced by providing six strap ribs 43*c* that inhibit base 24*c* rollout. With more strap ribs 40*c* resisting internal pressure, the less likely the base 24*c* is to rollout under increased pressure. Further, more of the base 24*c* is formed by the rib side walls 48*c*, which increases internal pressure resistance due to an increased surface area being provided by a spherical surface of the rib side walls 48*c* as discussed herein.

Figure 11A:
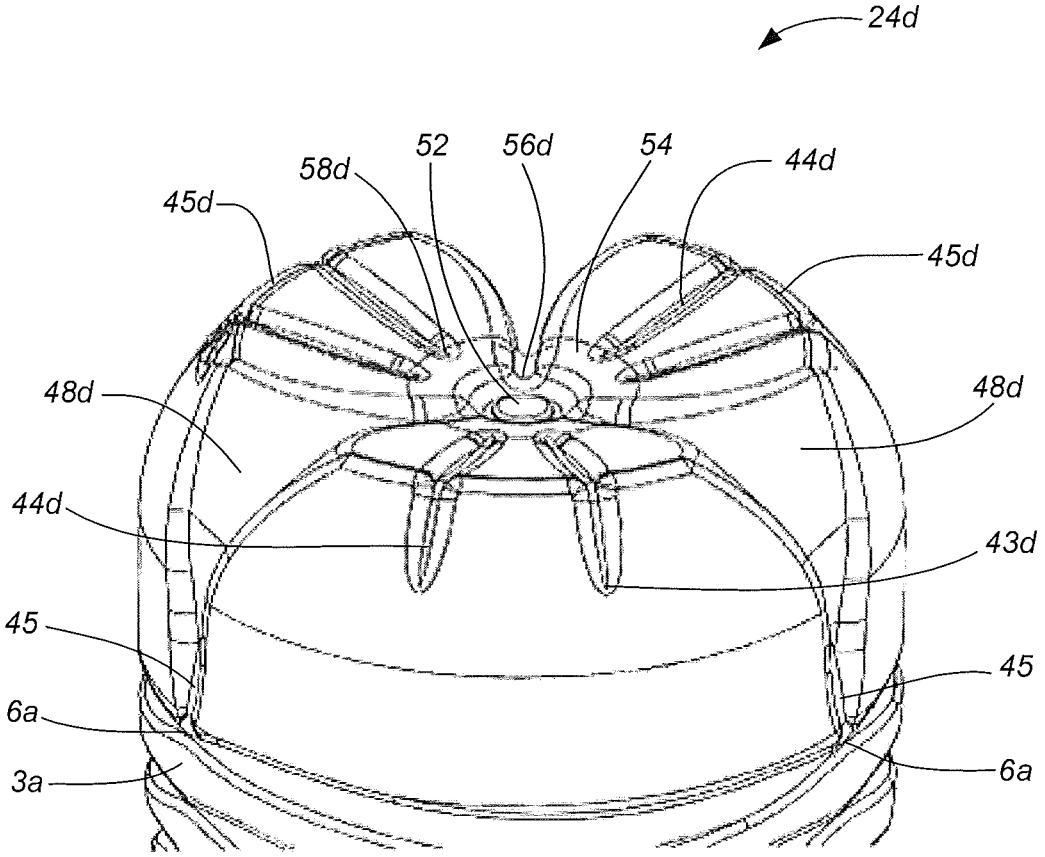
FIG. 11A illustrates a bottom perspective view of another embodiment of a base.

FIG. 11A illustrates a bottom perspective view of an embodiment of the base 24*d*, as illustrated in FIG. 5A. The base 24*d* comprises the strap ribs 40*d* and the load ribs 44*d* as discussed herein. The base 24*d* shown in FIG. 11A further comprises the gate 52 and the dome 54. The walls of the base 24*d* radially extend directly from the gate 52. Each of the strap ribs 40*d* has a base end 56*d* which terminates in the dome 54, near the periphery of the gate 52. In other embodiments, the base ends 56*d* may terminate near or at the periphery of the dome 54. In still other embodiments, the base ends 56*d* may be positioned outside of the dome 54 region, similarly to base ends 58*d* of the load ribs 44*d*. Each of the strap ribs 40*d* has two rib side walls (i.e., valley walls) 48*d* that connect the strap rib 40*d* to portions of the base 24*d* and the feet 45*d*. Each of the rib side walls 48*d* smoothly and gradually transitions into the base 24*d* and the feet 45*d*. The smooth and gradual transitions provide internal pressure resistance at and near the rib side walls 48*d* since more spherical features of the bottle 1 can better accommodate internal pressure. The strap ribs 40*d* are relatively deeper in the base 24*d* than the load ribs 44*d* to provide stress transfer and pressure resistance as discussed herein.

As mentioned above, each of the load ribs 44*d* comprises a base end 58*d* which terminates at, near, or within the dome 54. As shown in the embodiment of FIG. 11A, the base ends 58*d* of the load ribs 44*d* terminate before the base ends 56*d* of the strap ribs 40*d*. The load ribs 44*d* are shallow relative to the strap ribs 40*d*. As further shown in FIG. 11A, the load ribs 44*d* have a smaller rib side wall 48*d* feature as discussed with reference to the strap ribs 40*d*. Thus, the transition from each of the load ribs 44*d* to the feet 45*d* of the base 24*d* is more abrupt or sharper, thereby providing greater external stress resistance than possible with a larger rib side wall 48*d* feature. As will be appreciated by those skilled in the art, sharper transitions of the load ribs 44*d* helps resist bending and/or leaning as discussed herein by, for example, maintaining the integrity and shape of the base 24*d* when the bottle 1 is top loaded during packaging, shipping, and/or handling.

Figure 12:
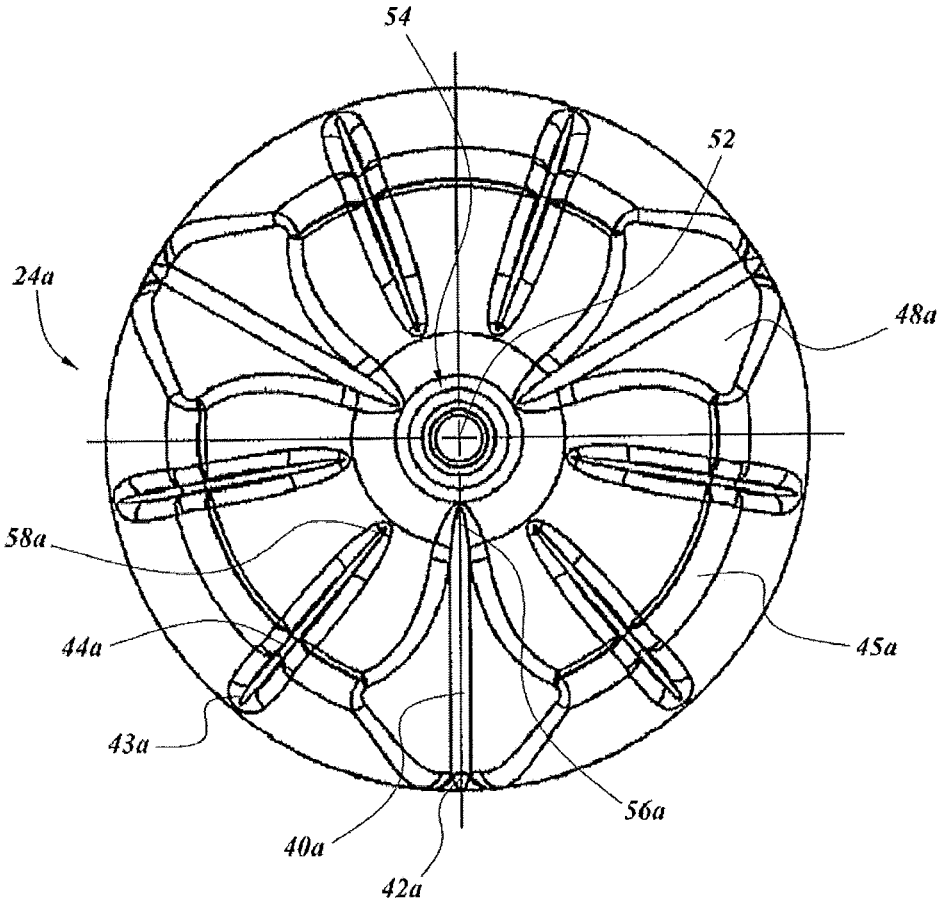
FIG. 12 illustrates a bottom view of an embodiment of a base.
Figure 13:
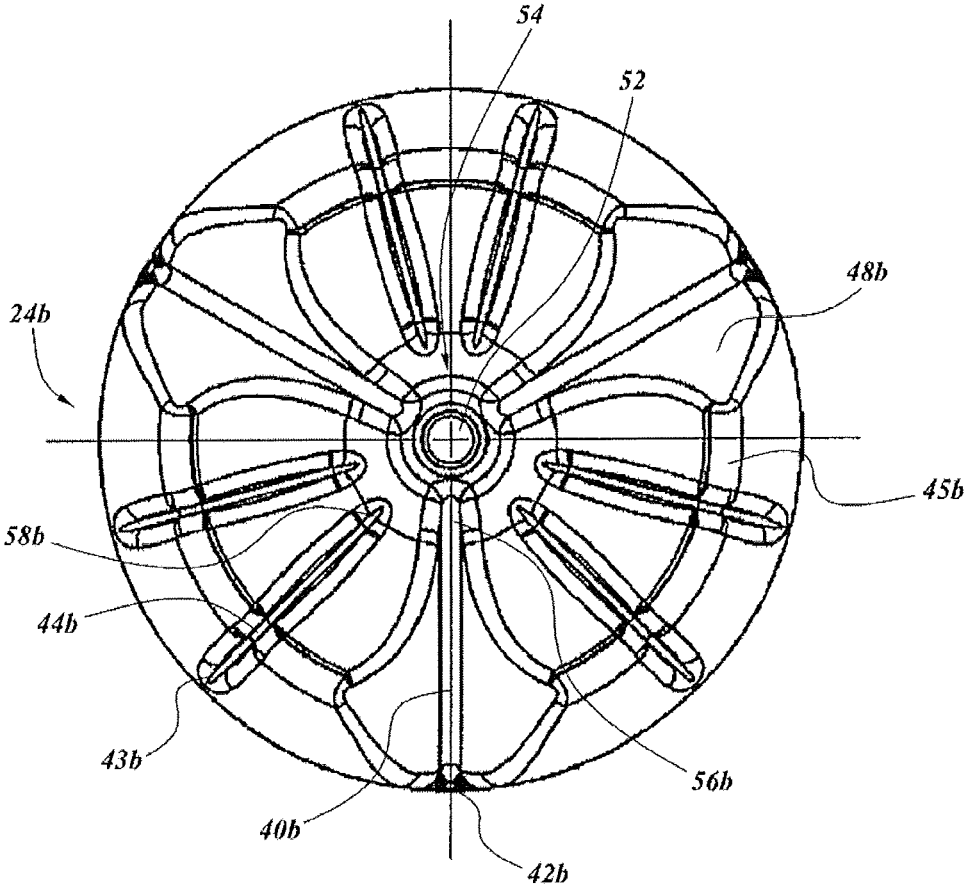
FIG. 13 illustrates a bottom view of another embodiment of a base.
Figure 14:
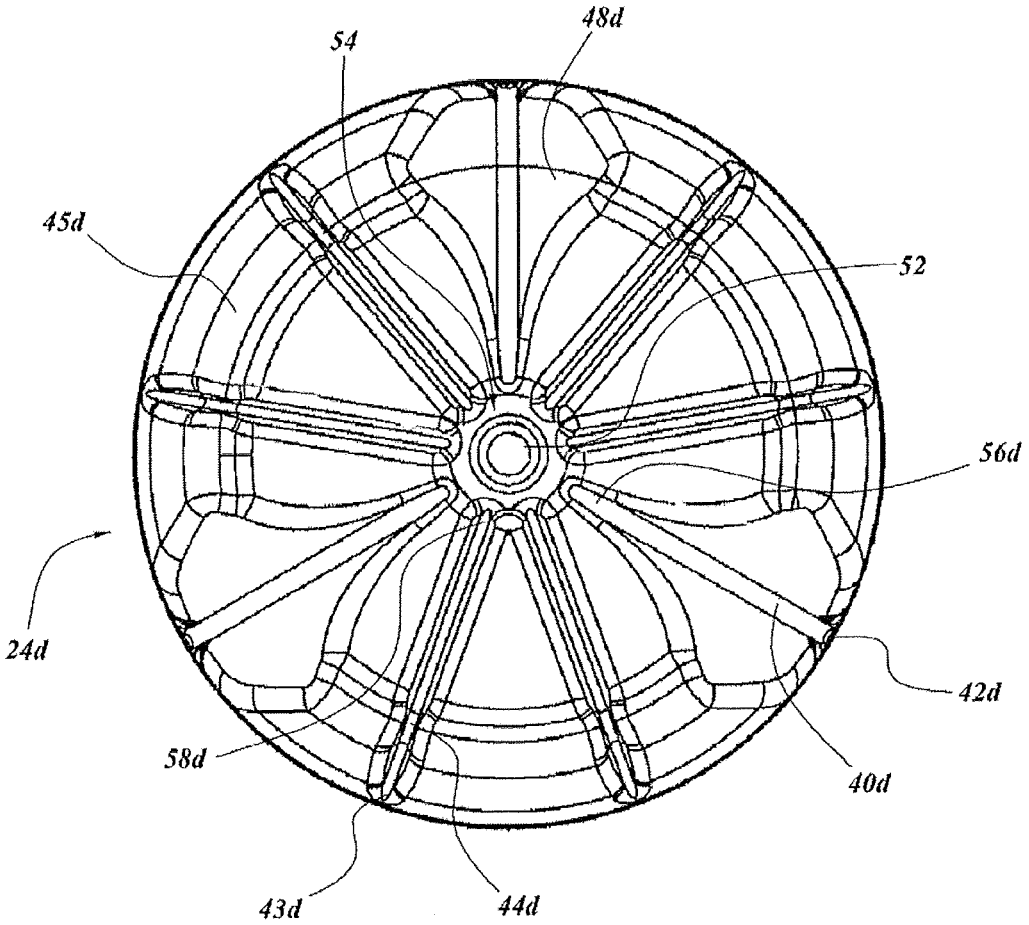
FIG. 14 illustrates a bottom view of another embodiment of a base.

FIGS. 12-15 illustrate bottom views of embodiments of the various bases discussed herein. FIGS. 12-14 show a series of bases that illustrate a gradual progression of some of the base ends 56*a-d*, 58*a-d* closer toward the gate 52. For example, as discussed herein, the base end 56*b* of the load rib 40*b* is closer to the gate 52 in the dome 54 than the base end 56*a* of the load rib 40*a*. As another example, as discussed herein, the base end 58*b* of the load rib 44*b* is closer to the gate 52 in the dome 54 than the base end 58*a* of the load rib 44*a*. As shown, in FIGS. 12 and 13, the base ends 58*a,b* of the load ribs 44*a,b* may be radially further away from the gate 52 than the base ends 56*a,b* of the strap ribs 40*a,b*. As shown in FIG. 14, the base ends 58*d* of the load ribs 44*d* may be radially equidistant from the gate 52 with the base ends 56*d* of the strap ribs 40*d*. In some embodiments, a closer proximity of the base ends 56*a,b,c,d* of the strap ribs 40*a,b,c,d* to the gate 52 may provide better internal pressure resistance, as discussed herein. In some embodiments, a closer proximity of the base ends 58*a,b,c,d* of the load ribs 44*a,b,c,d* to the gate 52 may provide further better internal pressure resistance as discussed herein, although the primary internal pressure resistance is still provided by the strap ribs 40*a,b,c,d*. The base ends 58*a,b,c,d* of the load ribs 44*a,b,c,d* extending closer to the gate 52 with the base ends 56*a,b,c,d* of the strap ribs 40*a,b,c,d* may complement the pressure resistance provided by the strap ribs 40*a,b,c,d*.

Figure 15:
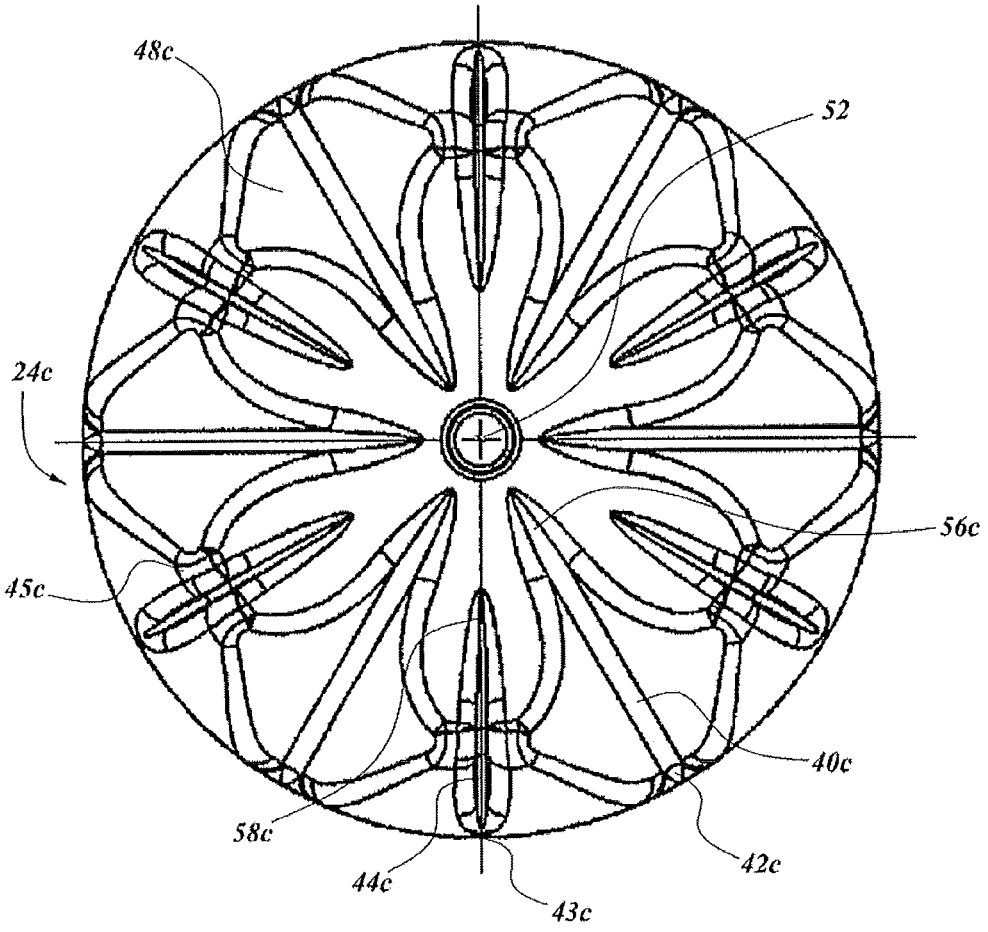
FIG. 15 illustrates a bottom view of another embodiment of a base.

As shown in FIG. 15, an embodiment of the base 24*c* without a dome 54*c* forms a more uniform wall around the gate 52. The strap ribs 40*c* can be a more smooth or continuous extension from or around the gate 52. The continuous extension from or around the gate 52 helps form a pressure resistance strap 9*c* (FIG. 17) that extends from the gate 52 to a top of the label portion 10. The continuous pressure resistance strap 9*c* is better able to resist internal pressure as discussed herein, and in particular, resistance to bottle stretching and base rollout.

Figure 16A:
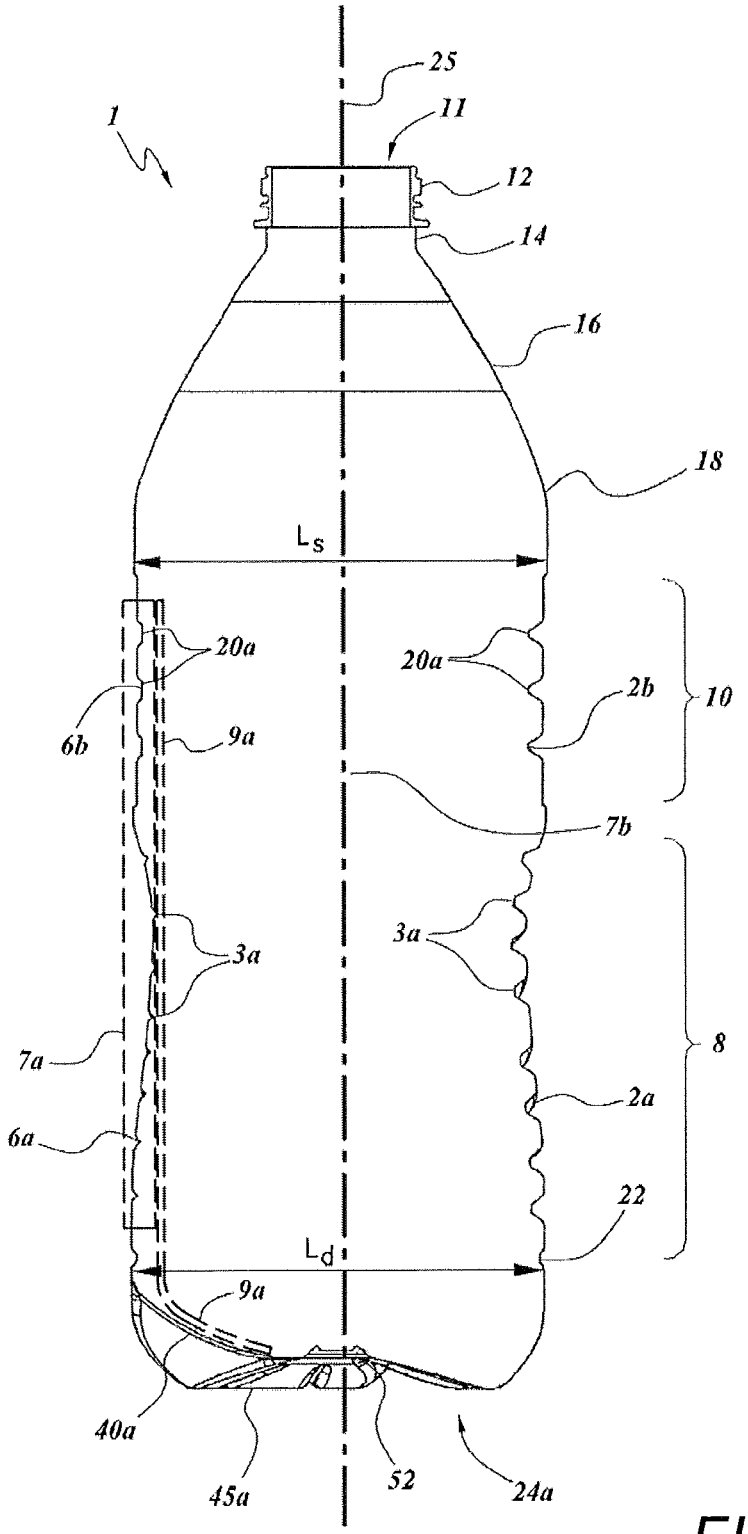
FIG. 16A illustrates a cross-section along a central axis of an embodiment of a bottle.

FIG. 16A illustrates a cross-section along the central axis 25 of an embodiment of the bottle 1 as illustrated in FIG. 2. As shown in FIG. 16A, the flat rib or recessed column 7*a* is located on the opposite side of the bottle circumference of the deep rib 2*a,b* portions (with, for example, an embodiment having three recessed columns 7*a*). In the illustrated embodiment, the base rib 22 has a constant cross-section throughout the circumference of the bottle 1. In some embodiments, the diameter Ld of the base 24 is larger by 0.5 to 2 millimeters, 0.6, 0.7, 0.8, 0.9, 1, 1.1, 1.2, 1.3, 1.4, 1.5, 1.6, 1.7, 1.8, or 1.9 millimeters, including ranges bordered and including the foregoing values, than any other diameter of the bottle 1. In an embodiment with the largest diameter of the bottle 1 being Ld, the bottle 1 has a single point of contact at just the base 24*a* with other substantially similar bottles in a production line and/or packaging. Further, a larger base 24*a* diameter Ld may improve stability when there is any damage to the base 24*a*. As shown in FIG. 16A, the diameter Ls at the shoulder 18 may be equal to the diameter Ld, which provides for two points of contact, at the shoulder 18 and base 24*a*, with other substantially similar bottles in a production line and/or packaging. In some embodiments, the diameter(s) in any portion of the bottle 1 varies, where the largest diameters create points of contact in a production line and/or packaging. The bottles may have either a single point of contact or multiple points of contact.

As shown in FIG. 16A, a strap rib 40*a* may vertically align with a recessed column 7*a*. The strap rib 40*a* and recessed column 7*a* in combination can form a pressure resistance band 9*a* that substantially extends from the gate 52 to a top portion of the label portion 10 or a top portion of the recessed column 7*a*. The pressure resistance band 9*a* provides resistance against internal pressure substantially for the base 24*a* and sidewall of the bottle 1 to, for example, inhibit stretching and/or base rollout as discussed herein.

Figure 16B:
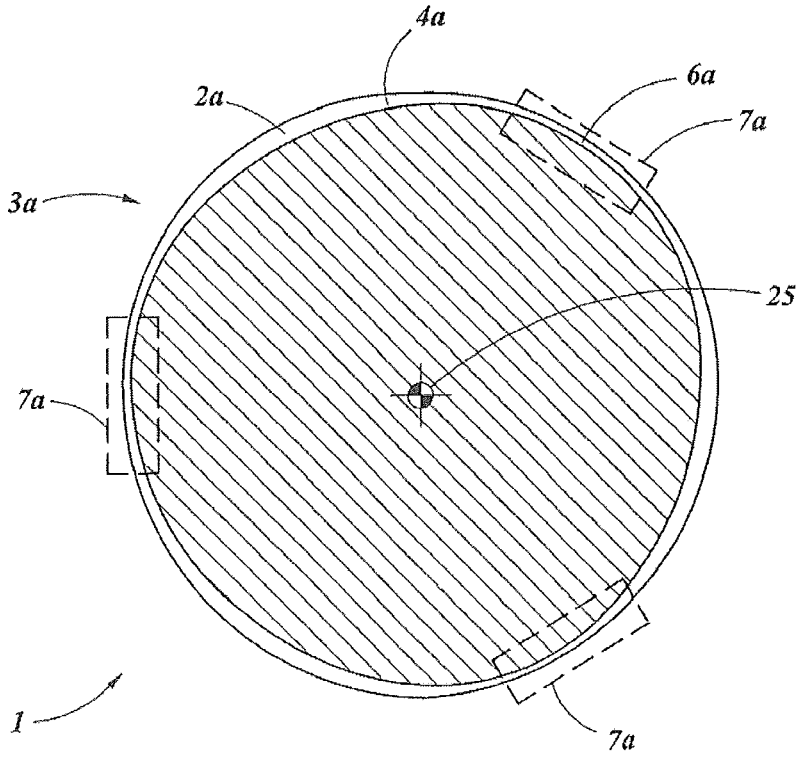
FIG. 16B illustrates an embodiment showing a cross-section of a bottle.
Figure 16C:
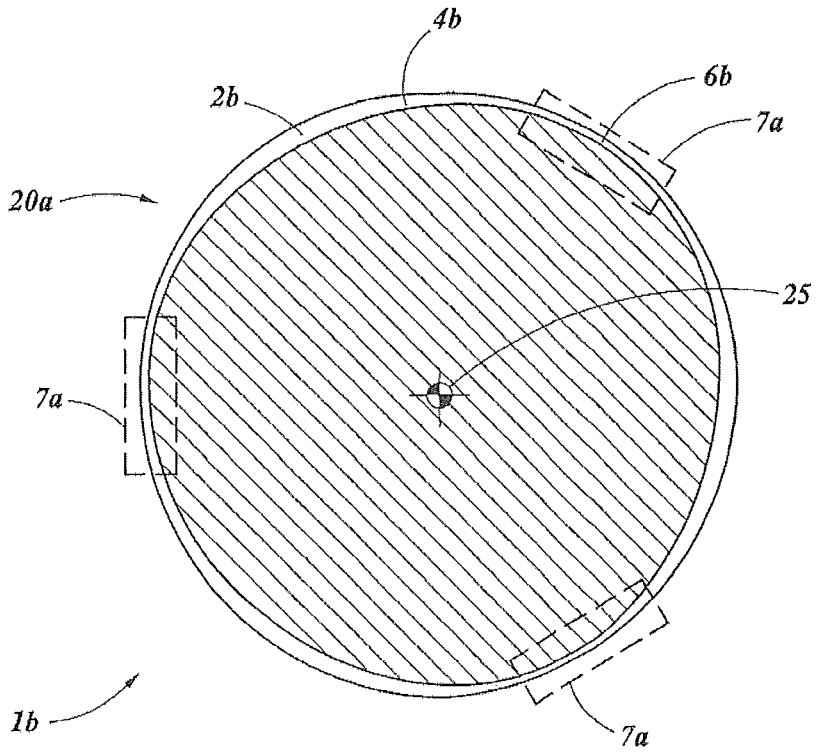
FIG. 16C illustrates an embodiment showing a cross-section of a bottle.

FIGS. 16B and 16C illustrate embodiments where the deep rib 2*a,b* is a depth that is larger than a depth of the middle rib 4*a,b* which is larger than a depth of the flattened and/or shallow rib 6*a,b*. The transition between the varying depths is smooth as depicted in FIG. 1A. In some embodiments, the transition may be some other form such as a step change connecting the varying depth portions or sections. In the illustrated embodiments, a grip portion rib 3*a* (i.e., sidewall ribs) has three deep rib 2*a* portions, six middle rib 4*a* portions, and three flattened and/or shallow rib 6*a* portions. As disclosed herein, the term "portions" can be equivalent to the term "sections" in reference to varying depth ribs.

Referring to FIG. 16B, an embodiment showing a cross-section of the bottle 1, looking down the vertical or central axis 25, illustrates a cross-section of a grip portion rib 3*a*. As disclosed herein, the term "vertical axis" can be equivalent of the term "central axis". The depth of the grip portion rib 3*a* varies from deep ribs 2*a* to flattened and/or shallow ribs 6*a*. The one or more flattened and/or shallow ribs 6*a* form an equivalent of recessed columns 7*a* at portions where a plurality flattened and/or shallow ribs 6*a* substantially vertically line up along the vertical or central axis 25 of the bottle 1 as illustrated in FIGS. 1 and 2. A plurality of deep ribs 2*a* substantially vertically line up along the vertical or central axis 25 of the bottle 1 as illustrated in FIGS. 1 and 2. A plurality of middle ribs 4*a* substantially vertically line up along the vertical or central axis 25 of the bottle 1 as illustrated in FIGS. 1 and 2.

In the illustrated embodiment with three lined-up flattened and/or shallow rib 6*a* portion, the bottle 1 respectively has three recessed columns 7*a*. The three recessed columns 7*a* are equally spaced apart around the circumference of the bottle and located on the opposite side of the bottle circumference from the deep rib 2*a* portions. However, the flattened and/or shallow ribs 6*a* may be unequally spaced apart around the circumference of the bottle 1. Further, any number of recessed columns 7*a* may be incorporated into a design of the bottle 1 by increasing or decreasing the number of flattened and/or shallow ribs 6*a* that substantially vertically line up along the vertical or central axis 25. For instance, the bottle may have as few as 1 or up to 10 recessed columns 7*a*, including 2, 3, 4, 5, 6, 7, 8, or 9 recessed columns 7, including ranges bordered and including the foregoing values. In the illustrated embodiment, the collections of flattened and/or shallow ribs 6*a* that form recessed columns 7*a* provide resistance to leaning, and/or load crushing, and/or stretching. Leaning can occur when during and/or after bottle packaging, a bottle experiences top load forces (tangential forces or otherwise) from other bottles and/or other objects stacked on top of the bottle. Similarly, top load crushing can occur due to vertical compression (or otherwise) forces from bottles and/or other objects stacked on top. Stretching can occur when a bottle is pressurized. In the illustrated embodiment, the recessed columns 7*a* transfer the resulting tangential or compression forces along the wall to the base 24*a* and increase bottle 1 rigidity. Deep ribs 2*a* of the grip label rib 3*a* provide the hoop strength that can be equivalent to the hoop strength of normal depth ribs. As with the flattened and/or shallow rib 6*a* portions, the deep rib 2*a* portions may vary from 1 to 10 in number on the grip panel ribs 3*a*, including 2, 3, 4, 5, 6, 7, 8, or 9 deep rib 2 portions, including ranges bordered and including the foregoing values.

As FIG. 16B illustrates, certain embodiments may minimize the triangle-shaped or flattened and/or shallow ribs 6*a* to 20-30%, including 21, 22, 23, 24, 25, 26, 27, 28, or 29%, of the bottle circumference, resulting in a respective 70-80%, including 71, 72, 73, 74, 75, 76, 77, 78, or 79%, of the bottle circumference being trapezoid-shaped or deep ribs 2*a* and middle ribs 4*a*, including ranges bordered and including the foregoing values. However, any ratio of triangle-shaped to trapezoidal ribs, or other shapes known in the art, may be utilized.

Referring to FIG. 16B, an embodiment showing a cross-section of the bottle 1, looking down the vertical or central axis 25, illustrates a cross-section of a label panel rib 20*a* (i.e., sidewall ribs). The depth of the label panel rib 20*a* varies from deep ribs 2*b* to flattened and/or shallow ribs 6*b*. The one or more flattened and/or shallow ribs 6*b* form an equivalent of recessed columns 7*a* at portions where a plurality flattened and/or shallow ribs 6*b* substantially vertically line up along the vertical or central axis 25 of the bottle 1 as illustrated in FIGS. 1 and 2. The recessed columns 7*a* can include one or more flattened and/or shallow ribs 6*a* of the grip portion 8 as discussed herein. A plurality of deep ribs 2*b* substantially vertically line up along the vertical or central axis 25 of the bottle 1 as illustrated in FIGS. 1 and 2. A plurality of middle ribs 4*b* substantially vertically line up along the vertical or central axis 25 of the bottle 1 as illustrated in FIGS. 1 and 2.

In the illustrated embodiment, with three lined-up flattened and/or shallow rib 6*b* portions, the bottle 1 respectively has three recessed columns 7*a*. The flattened and/or shallow ribs 6*b* of the label panel ribs 20*a* can vertically line up along the vertical or central axis 25 with the flattened and/or shallow ribs 6*a* of the grip portion ribs 3*a* to form the three recessed columns 7*a*. Thus, in some embodiments, the recessed columns 7*a* can extend along a majority or substantial entirety of the sidewall (e.g., height and/or length) of the bottle 1 as, for example, illustrated in FIG. 1.

In some embodiments, the flattened and/or shallow ribs 6*b* of the label panel ribs 20*a* are vertically misaligned with the flattened and/or shallow ribs 6*a* of the grip portion ribs 3*a* such that the label portion 10 has a set of recessed columns and the grip portion 8 has another set of recessed columns. Thus, the recessed column of the label portion 10 can be vertically misaligned from the recessed columns of the grip portion 8.

The plurality of deep ribs 2*b* of the label portion 10 can substantially vertically line up along the vertical or central axis 25 with the plurality of deep ribs 2*a* of the grip portion 8 as illustrated in FIGS. 1 and 2. In some embodiments, the plurality of deep ribs 2*b* of the label portion 10 can be vertically misaligned with the plurality of deep ribs 2*a* of the grip portion 8. The plurality of middle ribs 4*b* label portion 10 can substantially vertically line up along the vertical or central axis 25 with the middle ribs 4*a* of the grip portion 8 as illustrated in FIGS. 1 and 2. In some embodiments, the plurality of middle ribs 4*b* label portion 10 can be vertically misaligned with the middle ribs 4*a* of the grip portion 8.

In the illustrated embodiment, the three recessed columns 7*a* are equally spaced apart around the circumference of the bottle and located on the opposite side of the bottle circumference from the deep rib 2*b* portions. However, the flattened and/or shallow ribs 6*a,b* may be unequally spaced apart around the circumference of the bottle 1. Further, any number of recessed columns 7*a* may be incorporated into a design of the bottle 1 by increasing or decreasing the number of flattened and/or shallow ribs 6*a,b* that substantially vertically line up along the vertical or central axis 25. For instance, the bottle 1 may have as few as 1 or up to 10 recessed columns 7*a*, including 2, 3, 4, 5, 6, 7, 8, or 9 recessed columns 7*a*, including ranges bordered and including the foregoing values. In the illustrated embodiment, the collections of flattened and/or shallow ribs 6*b* that form recessed columns 7*a* provide resistance to leaning, load crushing, and/or stretching as discussed herein. In the illustrated embodiment, the recessed columns 7*a* transfer the resulting tangential or compression forces along the wall to the base 24*a* and increase bottle 1 rigidity. Deep ribs 2*b* of the label panel rib 20*a* provide the hoop strength that can be equivalent to the hoop strength of normal depth ribs. As with the flattened and/or shallow rib 6*b* portions, the deep rib 2*b* portions may vary from 1 to 10 in number on the label panel rib 20*a*, including 2, 3, 4, 5, 6, 7, 8, or 9 deep rib 2*b* portions, including ranges bordered and including the foregoing values.

A depth Dd of a deep rib 2*a* may vary from 1 to 10 millimeters, including 1.1, 1.2, 1.3, 1.4, 1.5, 1.6, 1.7, 1.8, 1.9, 2, 2.1, 2.2, 2.3, 2.4, 2.5, 2.6, 2.7, 2.8, or 2.9 millimeters, or 1 to 9, 1 to 7, 1 to 5, or 1 to 3 millimeters, including ranges bordered and including the foregoing values.

A depth DL of label panel rib 20*a* (i.e., deep rib 2*b*) may vary from 0.5 to 10 millimeters, including 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.9, 4, 4.1, 4.2, 4.3, 4.4, 4.5, 4.6, 4.7, 4.8, or 4.9 millimeters, 0.5 to 9, 0.5 to 7, 0.5 to 5, or 0.5 to 3 millimeters, including ranges bordered and including the foregoing values.

A depth Dm of a middle rib 4*a* may vary from 0 to 5 millimeters, including 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, or 4.9 millimeters, including ranges bordered and including the foregoing values. The ratio of Dd of the deep ribs 2*a* to the Dm of middle ribs 4*a* may vary from 1:1 to 20:1, including 2:1, 3:1, 4:1, 5:1, 6:1, 7:1, 8:1, 9:1, 10:1, 11:1, 12:1, 13:1, 14:1, 15:1, 16:1, 17:1, 18:1, or 19:1, including ranges bordered and including the foregoing values.

A depth Df of a shallow rib 6*a* may vary from 0 to 2.5 millimeters, including 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of Dd of the deep ribs 2*a* to the Df of the flattened and/or shallow ribs 6*a* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where Df is zero, resulting in an infinite ratio. The ratio of Dm of the middle ribs 4*a* to the Df of the flattened and/or shallow ribs 6*a* may vary from 1:1 to 50:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, or 24:1 or 1:1 to 40:1, 1:1 to 30:1, or 1:1 to 20:1, including ranges bordered and including the foregoing values, including where Df is zero, resulting in an infinite ratio.

A depth Ds of a flattened and/or shallow rib 6*b* may vary from 0 to 2.5 millimeters, including 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, or 2.4 millimeters, including ranges bordered and including the foregoing values. The ratio of Dd of the deep ribs 2*a* to the Ds of the flattened and/or shallow ribs 6*b* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where Ds is zero, resulting in an infinite ratio. The ratio of DL of the deep ribs 2*b* to the Ds of the flattened and/or shallow ribs 6*b* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where Ds is zero, resulting in an infinite ratio. The ratio of Dm of the middle ribs 4*a*, 4*b* to the Ds of the flattened and/or shallow ribs 6*b* may vary from 1:1 to 50:1, including 2:1, 3:1, 4:1, 5:1, 6:1, 7:1, 8:1, 9:1, 10:1, 11:1, 12:1, 13:1. 14:1, 15:1, 16:1, 17:1, 18:1, 19:1, 20:1, 21:1, 22:1, 23:1, or 24:1 or 1:1 to 40:1, 1:1 to 30:1, or 1:1 to 20:1, including ranges bordered and including the foregoing values, including where Ds is zero, resulting in an infinite ratio. The ratio of DL of the deep ribs 2*b* to the Ds of the flattened and/or shallow ribs 6*b* may vary from 1:1 to 100:1, including 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, or 29:1, or 1:1 to 90:1, 1:1 to 80:1, 1:1 to 70:1, 1:1 to 60:1, 1:1 to 50:1, 1:1 to 40:1, 1:1 to 30:1 or 1:1 to 20:1, including ranges bordered and including the foregoing values, including where Ds is zero, resulting in an infinite ratio.

Figure 17:
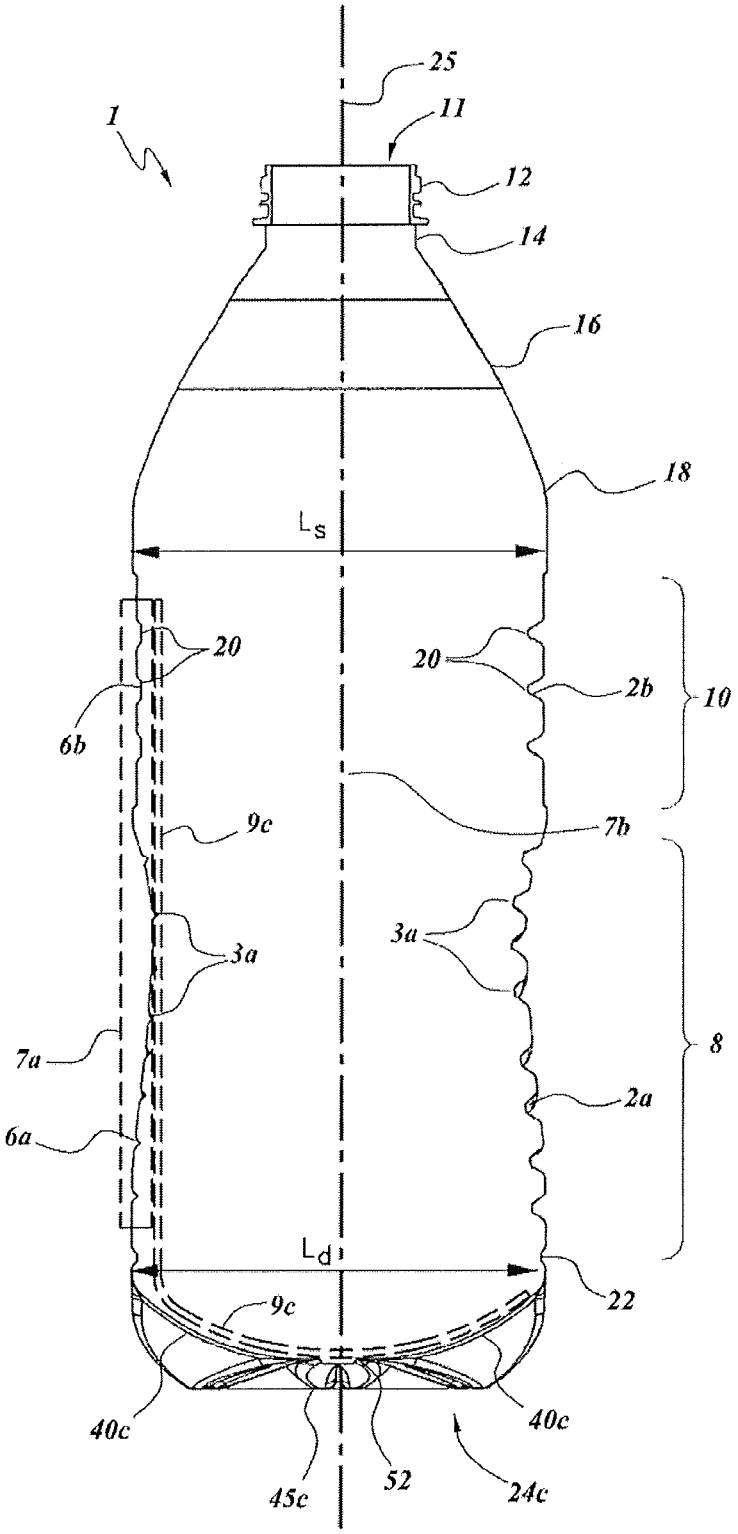
FIG. 17 illustrates a cross-section along the central axis of another embodiment of a bottle.

FIG. 17 illustrates a cross-section along the central axis 25 of an embodiment of the bottle 1 as illustrated in FIG. 3. As shown in FIG. 17, the flat rib or recessed column 7*a* is located on the opposite side of the bottle circumference of the deep rib 2*a* portions (with, for example, an embodiment having three recessed columns 7*a*). In the illustrated embodiment, the base rib 22 has a constant cross-section throughout the circumference of the bottle 1. The features and function of various diameters, including Ld and Ls, can be utilized as discussed herein.

Figure 25:
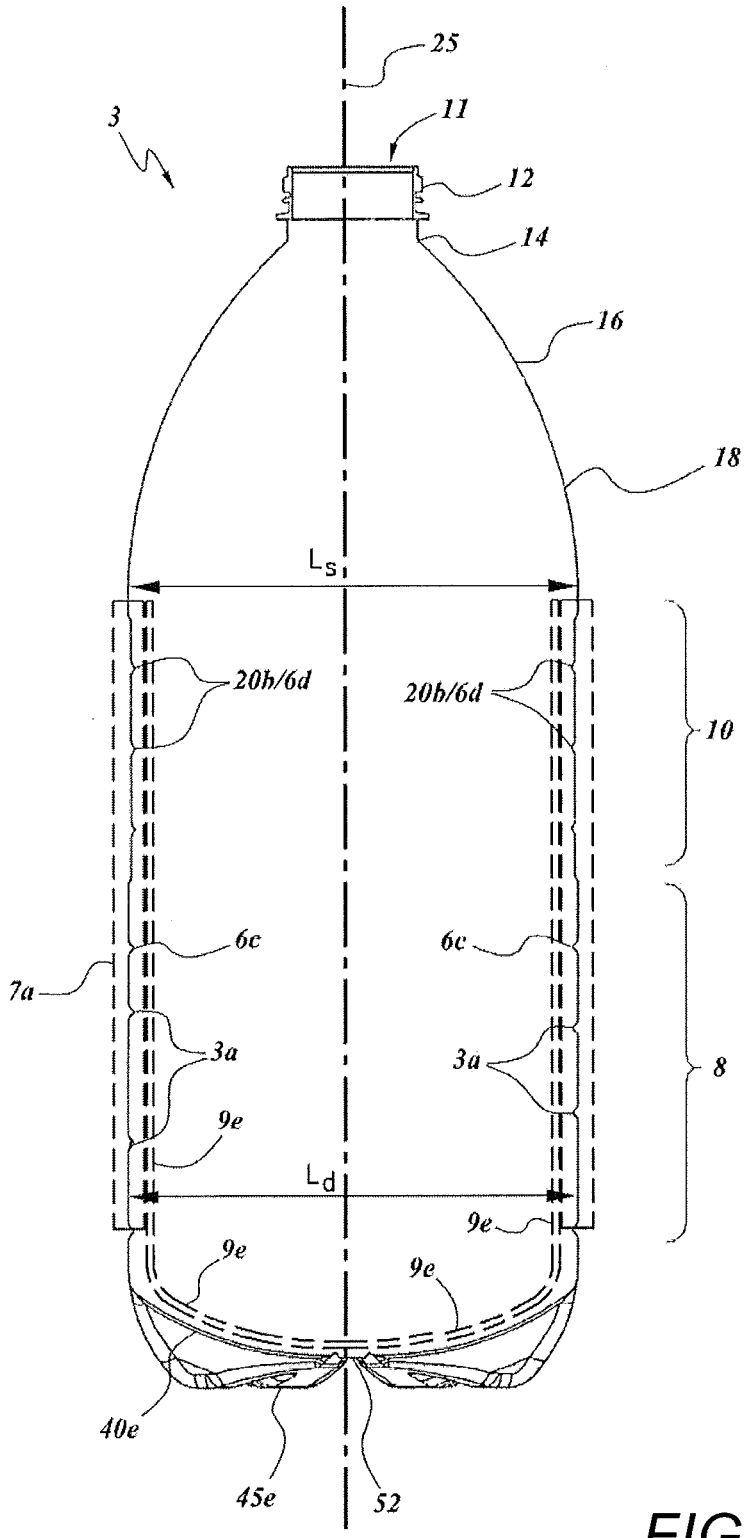
FIG. 25 illustrates a cross-section along the central axis of another embodiment of a bottle.

As shown in FIG. 17, a strap rib 40*c* may vertically align with a recessed column 7*a*. Another strap rib 40*c* may vertically align with the deep rib 2*a,b* portions. In the illustrated embodiment, the two strap ribs 40*c* and recessed column 7*a* in combination can form a pressure resistance band 9*c* that substantially extends from the base rib 22 near the deep ribs 2*a*, through the gate 52, and to a top portion of the label portion 10 or a top portion of the recessed column 7*a*. The pressure resistance band 9*c* provides resistance against internal pressure substantially continuously through the base 24*c* to the sidewall of the bottle 1 to, for example, inhibit stretching and base rollout as discussed herein. In some embodiments, the other strap rib 40*c* may vertically align another recessed column 7*a* where, for example, the bottle 1 has six recessed columns 7*a*. A pressure resistance band may be formed by the combination of two recessed columns and two strap ribs. The pressure resistance band may extend from a top portion of the label portion 10 on one side of the bottle 1, down the sidewall on the one side of the bottle 1 and through the gate 52, up the sidewall on the other side of the bottle 1 to a top portion of the label portion 10 on the other side of the bottle 1 to provide pressure resistance as discussed here and substantially continuously through a longitudinal perimeter of the bottle 1 (along the central axis 25 at the sidewalls and through the central axis at the base 24*c*). For example, FIG. 25 illustrates such an embodiment.

Figure 18:
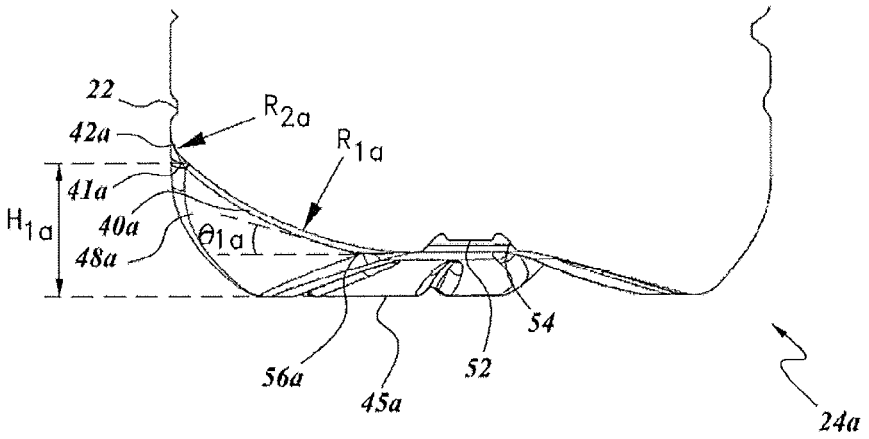
FIG. 18 illustrates a cross-section along the central axis of an embodiment of a base.

FIG. 18 illustrates a cross-section along the central axis 25 of an embodiment of the base 24*a* as illustrated in FIG. 16A. As shown in FIG. 18, the base 24*a* has a strap rib 40*a* that begins from the base end 56*a* with a positive slope upward (relative to a resting surface of the base 24*a* of the bottle 1) at an angle θ1*a* toward the sidewall of the bottle 1. Stated differently, the strap rib 40*a* does not proceed toward or get closer to the resting surface from the base end 56*a* surface before proceeding upwardly to connect to the sidewall of the bottle 1. The immediate or near immediate upward/positive slope at the angle θ1*a* of the strap rib 40*a* relative to the resting surface toward the sidewall of the bottle 1 helps inhibit flexing of the gate 52 and dome 54 due to internal pressures. The upward/positive slope at the angle θ1*a* combined with a connection to a sidewall of the bottle 1 at the sidewall end 42*a* as discussed herein further helps inhibit flexing of the gate 52 and dome 54 due to internal pressures. In some embodiments, the angle θ1*a* may initially be zero and positively increase along radius R1*a* as the strap rib proceeds away from the base end 56*a* toward the sidewall end 42*a*. In some embodiments, the larger the angle θ1*a* is starting from the base end 56*a*, the larger the pressure resistance will be. In some embodiments, angle θ1*a* may vary from 0 to 60 degrees, including 5 to 50, 10 to 55, 15 to 50, 20 to 45, 25 to 35, 20 to 30, including up to 45, up to 40, up to 35, up to 30, up to 25, and up to 20, including ranges bordered and including the foregoing values. In some embodiments, the angle θ1*a* may initially be negative from the base end 56*a* with a radius (curve) of the strap rib 40*a* curving the strap rib 40*a* toward the sidewall end 42*a* as discussed herein without departing from the scope of the features and functions disclosed herein.

The strap rib 40*a* extends from the base end 56*a* to the sidewall end 42*a* along one or more radii. As shown in FIG. 18, the strap rib 40*a* may extend from the base end 56*a* with a radius R1*a* and transition to a radius R2*a* to terminate at the sidewall end 42*a* near or at the base rib 22. In some embodiments, the radius R1*a* may vary from 20 to 80 millimeters, including 25 to 75, 30 to 65, 35 to 60, 40 to 55, and including 50 millimeters, including ranges bordered and including the foregoing values, where for example, the diameter (Ld and/or Ls) of the bottle 1 may vary from 30 to 200 millimeters, including 30 to 40, 30 to 50, 40 to 60, 50 to 70, 60 to 80, 40 to 190, 50 to 180, 60 to 170, 70 to 160, 80 to 150, 90 to 140, 100 to 130, and 110 to 120 millimeters, including ranges bordered and including the foregoing values. The ratio of radius R1 a to bottle diameter can vary from 8:1 to 1:10, including 7:1, 6:1, 5:1, 4:1, 3:1, 2:1, 1:1, 1:2, 1:3, 1:4, 1:5, 1:6, 1:7, 1:8 and 1:9, including ranges bordered and including the foregoing values. In some embodiments, the radius R2*a* may vary from 1 to 25 millimeters, including 5 to 10, 5 to 20, 5 to 10, 1 to 10, 1 to 5, and 10 to 20 millimeters, including ranges bordered and including the foregoing values, where for example, the diameter (Ld and/or Ls) of the bottle 1 may vary from 30 to 200 millimeters, including 30 to 40, 30 to 50, 40 to 60, 50 to 70, 60 to 80, 40 to 190, 50 to 180, 60 to 170, 70 to 160, 80 to 150, 90 to 140, 100 to 130, and 110 to 120 millimeters, including ranges bordered and including the foregoing values. The ratio of radius R2*a* to bottle diameter can vary from 1:1 to 1:200, including 1:10, 1:20, 1:30, 1:40, 1:50, 1:60, 1:70, 1:80, 1:90, 1:100, 1:120, 1:130, 1:140, 1:150, 1:160, 1:170, 1:180, 1:190, including ranges bordered and including the foregoing values. The above ranges and/or ratios are provided as examples. In some embodiments, the radii of the strap rib 40*a* and/or diameter of the bottle or other types of containers may exceed the above stated ranges and/or ratios, such as, for example, in barrel-type containers.

In some embodiments, the radius R1*a* and/or radius R2*a* are relatively large or infinite Stated differently, the strap rib 40*a* can be straight or nearly straight from the base end 56*a* to the sidewall end 42*a*. A straight strap rib can resist more pressure. Providing a curvature with one or more radii to the strap rib can improve the blowing process to help prevent poorly blown bottles, which may reduce pressure resistance. In some embodiments, the strap rib 40*a* is a combination of curved and straight portions, such as, for example, as discussed in reference to FIG. 19.

In some embodiments, a transition 41*a* from radius R1*a* to radius R2*a* (or more than one transition with a strap rib having more than two radii) can occur anywhere along the strap rib 40*a*. As show in FIG. 18, the transition 41*a* from radius R1*a* to radius R2*a* may occur at height H1*a*. In some embodiments, the height H1*a* may vary from 5 to 30 millimeters, including 10 to 25 and 15 to 20, including ranges bordered and including the foregoing values, where for example, the height of the bottle 1 may vary from 65 to 300 millimeters, including 80 to 290, 90 to 270, 100 to 260, 110 to 250, 120 to 240, 130 to 230, 140 to 220, 150 to 210, 160 to 200, 170 to 190, including ranges bordered and including the foregoing values. The ratio of height H1*a* to bottle height can vary from 1:3 to 1:60, including 1:4, 1:5, 1:6, 1:7, 1:8, 1:9, 1:10, 1:11, 1:12, 1:13, 1:14, 1:15, 1:20, 1:25, 1:30, 1:40, 1:45, 1:50, and 1:55, including ranges bordered and including the foregoing values. The above ranges and/or ratios are provided as examples. In some embodiments, height H1*a* and/or height of the bottle or other types of containers may exceed the above stated ranges and/or ratios, such as, for example, in barrel-type containers.

Figure 19:
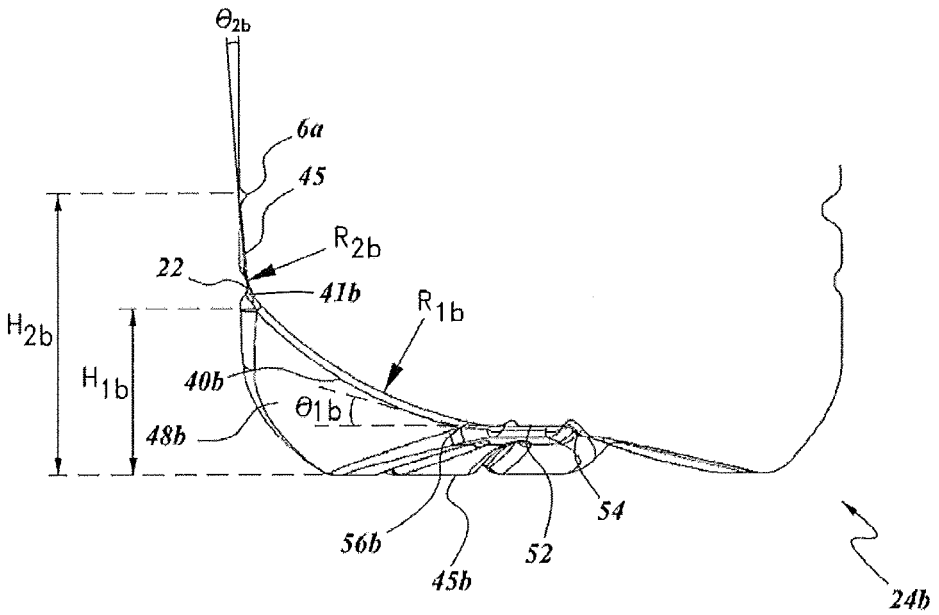
FIG. 19 illustrates a cross-section along the central axis of another embodiment of a base.

FIG. 19 illustrates a cross-section along the central axis 25 of an embodiment of the base 24*b* as illustrated in FIG. 17. As shown in FIG. 19, the base 24*b* has a strap rib 40*b* that begins from the sidewall end 56*b* with a positive slope upward (relative to a resting surface of the base 24*a* of the bottle 1) at an angle θ1*b* toward the sidewall of the bottle 1. Stated differently, the strap rib 40*a* does not proceed toward or get closer to the resting surface before proceeding upwardly to connect to the sidewall of the bottle 1. The immediate or near immediate upward/positive slope at the angle θ1*b* of the strap rib 40*a* relative to the resting surface toward the sidewall of the bottle 1 helps inhibit flexing of the gate 52 and dome 54 due to internal pressures. The upward/positive slope at the angle θ1*b* combined with a connection to a sidewall of the bottle 1 at the sidewall end 42*b* as discussed herein further helps inhibit flexing of the gate 52 and dome 54 due to internal pressures. In some embodiments, the angle θ1*b* may initially be zero and positively increase along radius R1*b* as the strap rib proceeds away from the base end 56*b* toward the sidewall end 42*b*. In some embodiments, the larger the angle θ1*b* is starting from the base end 56*b*, the larger the pressure resistance will be. In some embodiments, angle θ1*b* may vary from 0 to 60 degrees, including 5 to 50, 10 to 55, 15 to 50, 20 to 45, 25 to 35, 20 to 30, including up to 45, up to 40, up to 35, up to 30, up to 25, and up to 20, including ranges bordered and including the foregoing values. In some embodiments, the angle θ1*b* may initially be negative from the base end 56*b* with a radius (curve) of the strap rib 40*b* curving the strap rib 40*b* toward the sidewall end as discussed herein without departing from the scope of the features and functions disclosed herein.

The strap rib 40*b* extends from the base end 56*b* to the sidewall end 42*b* along one or more radii. As shown in FIG. 19, the strap rib 40*b* may extend from the base end 56*b* with a radius R1*b* and a transition 41*b* to a radius R2*b* through the base rib 22, followed by a transition to a straight portion 45 to terminate at the sidewall end 42*b* near, at, in the first shallow rib 6*a* as discussed herein. In some embodiments, the radius R1*b* may vary from 20 to 85 millimeters, including 25 to 80, 30 to 70, 35 to 65, 40 to 60, 45 to 55 and including 50 millimeters, including ranges bordered and including the foregoing values, where for example, the diameter (Ld and/or Ls) of the bottle 1 may vary from 30 to 200 millimeters, including 30 to 40, 30 to 50, 40 to 60, 50 to 70, 60 to 80, 40 to 190, 50 to 180, 60 to 170, 70 to 160, 80 to 150, 90 to 140, 100 to 130, and 110 to 120 millimeters, including ranges bordered and including the foregoing values. The ratio of radius R1*b* to bottle diameter can vary from 9:1 to 1:10, including 8:1, 7:1, 6:1, 5:1, 4:1, 3:1, 2:1, 1:1, 1:2, 1:3, 1:4, 1:5, 1:6, 1:7, 1:8 and 1:9, including ranges bordered and including the foregoing values. In some embodiments, the radius R2*b* may vary from 0 to 30 millimeters, including 5 to 25, 5 to 20, 5 to 10, 1 to 10, and 10 to 20 millimeters, including ranges bordered and including the foregoing values, where for example, the diameter (Ld and/or Ls) of the bottle 1 may vary from 30 to 200 millimeters, including 30 to 40, 30 to 50, 40 to 60, 50 to 70, 60 to 80, 40 to 190, 50 to 180, 60 to 170, 70 to 160, 80 to 150, 90 to 140, 100 to 130, and 110 to 120 millimeters, including ranges bordered and including the foregoing values. The ratio of radius R2*b* to bottle diameter can vary from 1:1 to 1:200, including 1:10, 1:20, 1:30, 1:40, 1:50, 1:60, 1:70, 1:80, 1:90, 1:100, 1:120, 1:130, 1:140, 1:150, 1:160, 1:170, 1:180, 1:190, including ranges bordered and including the foregoing values, or infinite with a radius R2*b* that is zero. The above ranges are provided as examples. In some embodiments, the radii of the strap rib and/or diameter of the bottle or other types of containers may exceed the above stated ranges and/or ratios, such as, for example, in barrel-type containers.

In some embodiments, the radius R1*b* and/or radius R2*b* are relatively large or infinite. Stated differently, the strap rib 40*b* can be straight or nearly straight from the base end 56*b* to the sidewall end 42*b*. A straight strap rib can resist more pressure. Providing a curvature with one or more radii to the strap rib can improve the blowing process to help prevent poorly blown bottles, which may reduce pressure resistance. In some embodiments, the strap rib 40*b* has more than one straight portion 45 as discussed herein positioned anywhere along the strap rib 40*b* from the base sidewall end 42*b* to the base end 56*b*. The straight portions 45 can be positioned to connect with curved portions and/or other straight portions of the strap rib 40*b*. The straight portions 45 can be any length, including substantially an entire length of the strap rib 40*b* from the sidewall end 42*b* to the base end 56*b*.

In some embodiments, the transition 41*b* from radius R1*b* to radius R2*b* (or more than one transition within a strap rib having more than two radii) may be positioned anywhere along the strap rib 40*b*. As shown in FIG. 19, the transition 41*b* from radius R1*b* to radius R2*b* occurs at height H1*b*. In some embodiments, the height H1*b* may vary from 5 to 35 millimeters, including 10 to 30, 15 to 25, and 15 to 20, including ranges bordered and including the foregoing values, where for example, the height of the bottle 1 may vary from 65 to 300 millimeters, including 80 to 290, 90 to 270, 100 to 260, 110 to 250, 120 to 240, 130 to 230, 140 to 220, 150 to 210, 160 to 200, 170 to 190, including ranges bordered and including the foregoing values. The ratio of height H1*b* to bottle height can vary from 1:2 to 1:60, including 1:3, 1:4, 1:5, 1:6, 1:7, 1:8, 1:9, 1:10, 1:11, 1:12, 1:13, 1:14, 1:15, 1:20, 1:25, 1:30, 1:40, 1:45, 1:50, and 1:55, including ranges bordered and including the foregoing values. The above ranges and/or ratios are provided as examples. In some embodiments, height H1*b* and/or height of the bottle or other types of containers may exceed the above stated ranges and/or ratios, such as, for example, in barrel-type containers.

In some embodiments, the transition from radius R2*b* (or R1*b* in some embodiments) to the straight portion 45 may be positioned anywhere along the strap rib 40*b*. As shown in FIG. 19, the transition from the straight portion 45 (or R2*b* in some embodiments) to the sidewall end 42*b* occurs at height H2*b*. In some embodiments, the height H2*b* may vary from 10 to 60 millimeters, including 15 to 55, 20 to 50, 25 to 45, and 30 to 40, including ranges bordered and including the foregoing values, where for example, the height of the bottle 1 may vary from 65 to 300 millimeters, including 80 to 290, 90 to 270, 100 to 260, 110 to 250, 120 to 240, 130 to 230, 140 to 220, 150 to 210, 160 to 200, 170 to 190, including ranges bordered and including the foregoing values. The ratio of height H2*b* to bottle height can vary from 1:2 to 1:60, including 1:3, 1:4, 1:5, 1:6, 1:7, 1:8, 1:9, 1:10, 1:11, 1:12, 1:13, 1:14, 1:15, 1:20, 1:25, 1:30, 1:40, 1:45, 1:50, and 1:55, including ranges bordered and including the foregoing values. In some embodiments, the straight portion 45 may extend into the sidewall of the bottle 1 straight from radius R2*b* at an angle θ2*b* relative to the bottle sidewall (or central axis). The angle θ2*b* may vary from 0 to 15 degrees, including 1, 2, 3, 4, 5, 6, 7, 8, 9, 10, 11, 12, 13, and 14 degrees, including ranges bordered and including the foregoing values. The above ranges and/or ratios are provided as examples. In some embodiments, height H2*b* and/or height of the bottle or other types of containers may exceed the above stated ranges and/or ratios, such as, for example, in barrel-type containers.

Figure 19A:
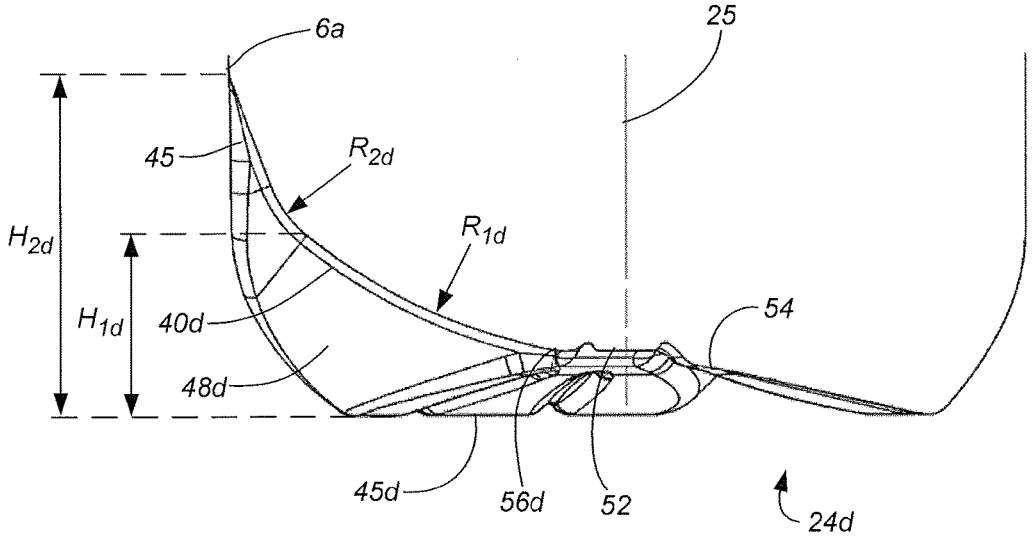
FIG. 19A illustrates a cross-section along the central axis of an embodiment of a base.

FIG. 19A illustrates a cross-section along the central axis 25 of an embodiment of the base 24*d* as illustrated in FIG. 5A. As shown in FIG. 19A, the strap rib 40*d* of the base 24*d* begins at the base end 56*d* substantially parallel to a resting surface of the base 24*d* and then extends along a curved path, having a first radius R1*d*, with an increasingly positive slope. At a height H1*d*, the radius of the curved path of the strap rib 40*d* changes to a second radius R2*d* with an increasingly positive slope before extending into the straight portion 45. At a height H2*d*, the straight portion 45 connects to the sidewall end 42*d* as discussed herein. The first and second radii R1*d*, R2*d*, as well as the corresponding positive slopes, may have dimensional values falling within any of the appropriate foregoing ranges of values. Preferably, however, the combination of the radii R1*d* and R2*d* cooperate to give the strap rib 40*d*, and thus the base 24*d*, a smooth and gradual, spherical configuration. As discussed herein, spherical features of the bottle 1 better accommodate internal pressure. Experimentation has demonstrated that the spherical configuration of the base 24*d* depicted in FIGS. 5A and 19A is capable of withstanding an internal pressure at least twice the internal pressure tolerable by the configuration shown in FIG. 6A.

It will be recognized that the strap rib 40*d* illustrated in FIG. 19A does not include a transition curve between the first radius R1*d* and the second radius R2*d*, nor between the second radius R2*d* and the straight portion 45. In other embodiments, however, a transition curve having a radius other than R1*d* and R2*d* may be positioned between the curved portions of the strap rib 40*d* having radii R1*d* and R2*d*. In still other embodiments, a transition curve may be positioned between the curved portion of the strap rib 40*d* having the second radius R2*d* and the straight portion 45. It is envisioned that the transition curves may have dimensional values falling within any of the appropriate foregoing ranges of values that further produce a spherical configuration of the strap rib 40*d*, and thus the base 24*d*.

Figure 20:
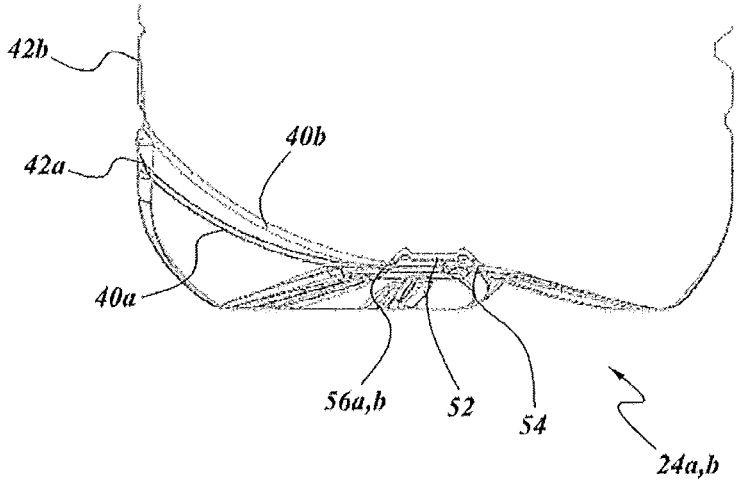
FIG. 20 illustrates overlaid cross-sections along the central axis of embodiments of bases.

FIG. 20 illustrates cross-sections along the central axis 25 of embodiments of overlaid bases 24*a,b* as illustrated in FIGS. 18 and 19. As discussed herein, and in particular, in reference to FIGS. 18 and 19, both strap ribs 40*a,b* extend from the dome 54 and/or gate 52 from base end 56*a,b* at a positive angle sloping upwards toward the sidewall of the bottle 1. As shown in FIG. 20, the strap rib 40*b* that extends further up the bottle sidewall may extend from the base end 56*a,b* at a more positive angle upward toward the bottle sidewall to the sidewall end 42*b* relative to the positive angle upward of the strap rib 40*a*. The strap rib 40*b* has a greater radius of curvature R1*b* than the radius of curvature of R1*a* of the strap rib 40*a* to extend further up the bottle sidewall as discussed herein.

Figure 21:
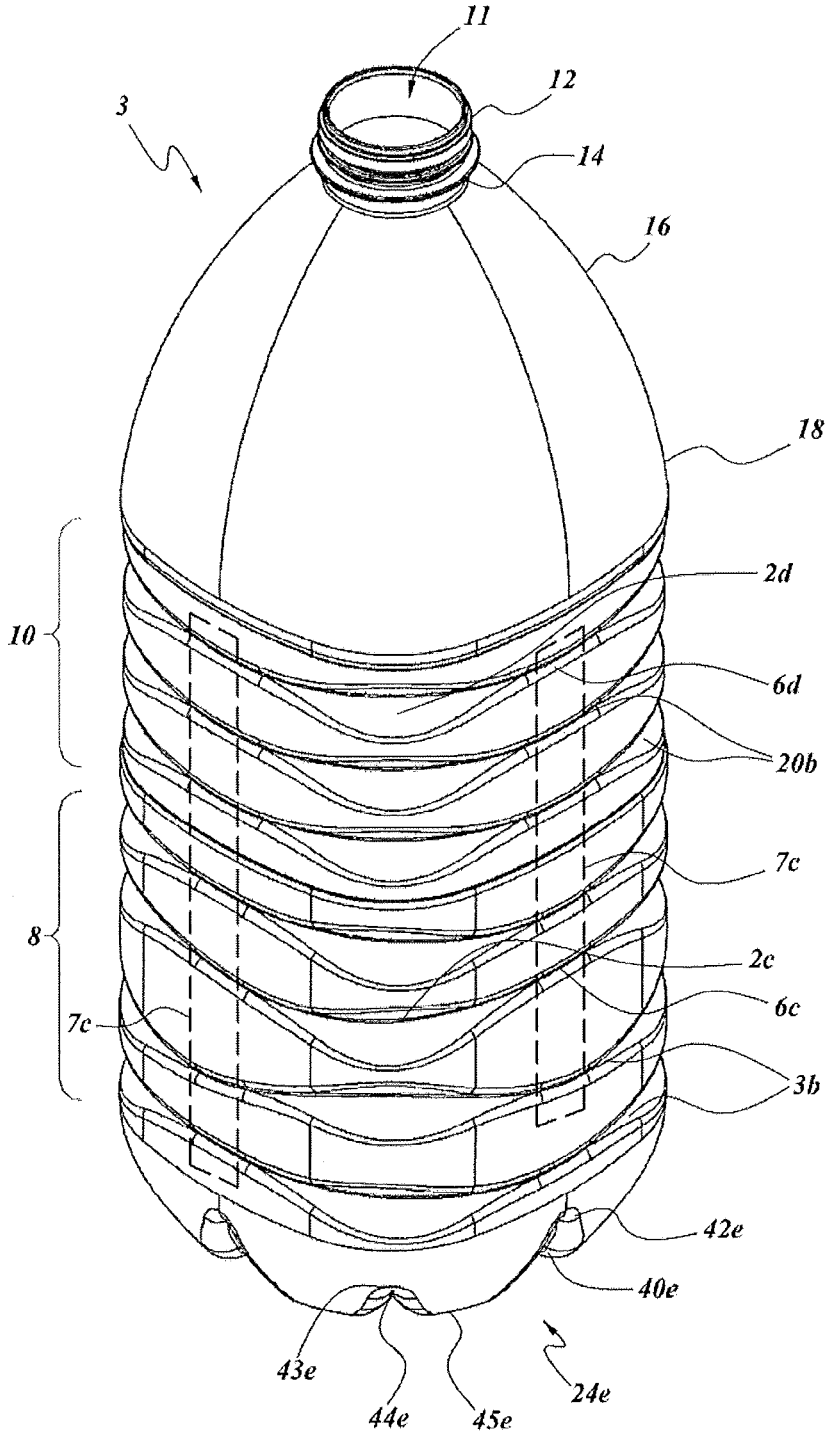
FIG. 21 illustrates a top perspective view of an embodiment of a bottle.

FIG. 21 illustrates a top perspective view of an embodiment of a bottle 3. The bottle 3 is a substantially square bottle with four walls. The four corners of the bottle 3 are rounded for ease of usability and ease of blowing. The bottle 3 has a base 24*e* that extends to a grip portion 8. The grip portion 8 comprises a plurality of grip portion ribs 3*b* (i.e., sidewall ribs). As illustrated in FIG. 21, grip portion ribs 3*b* (positioned in the grip portion 8) may vary in depth by separating or transitioning from the rib a deep rib 2*c* to a flattened and/or shallow rib 6*c* to be discussed in further detail below.

Referring to FIG. 21, a label portion 10 is connected to the grip portion 8 and comprises one or more label panel ribs 20*b* (i.e., sidewall ribs). The label panel portion 10 transitions into a shoulder 18, which connects to a bell 16. The bell 16 may include scallops (including as illustrated) or other design features or it may be smooth and generally unornamented. The bell 16 connects to a neck 14, which connects to a finish 12. From the label portion 10, the bell 16 leads upward and radially inward, relative to a central axis 25, to the neck 14 and finish 12. The finish 12 can be adapted to receive a closure to seal contents in the bottle 3. The finish 12 defines an opening 11 that leads to an interior of the bottle 3 for containing a beverage and/or other contents. The interior can be defined as at least one of the finish 12, the neck 14, the bell 16, the shoulder 18, the label portion 10, the grip portion 8, or the base 24*e*.

A substantially vertical wall (or sidewall) comprising the grip portion 8 and label portion 10 between the base 24*e* and the bell 16, extending substantially along the central axis 25 to define at least part of the interior of the bottle 3, can be considered a sidewall of the bottle 3. In some embodiments, the sidewall may include the bell 16, shoulder 18, and/or base 24*e*. The perimeter of the sidewall is substantially perpendicular to the central axis 25 of the interior. The sidewall defines at least part of the interior of the bottle 3. The finish 12, the neck 14, the bell 16, the shoulder 18, the label portion 10, the grip portion 8, and the base 24*e* can each define a respective perimeter or circumference (substantially perpendicular to the central axis 25) corresponding to that portion. For example, the label portion 10 has a label portion perimeter. As another example, the grip portion 8 has a grip portion perimeter.

In the embodiment illustrated in FIG. 21, each of the grip portion ribs 3*b* comprises a deep rib 2*c* section transitioning to a middle section then to a flattened and/or shallow rib 6*c* sections. As FIG. 21 illustrates, each of the label panel ribs 20*b* can comprise a deep rib 2*d* section transitioning to a middle section then to a flattened and/or shallow rib 6*d* sections. A varying depth grip portion rib 3*b* transitions from a deep rib 2*c* section to a middle rib/section then to a flattened and/or shallow rib 6*b* section. A varying depth label panel rib 20*b* transitions from a deep rib 2*d* to a middle rib/section then to a flattened and/or shallow rib 6*d*. The one or more flattened and/or shallow ribs 6*c,d* form an equivalent of recessed columns 7*c* at portions where a plurality flattened and/or shallow ribs 6*c,d* substantially vertically line up along the vertical or central axis 25 of the bottle 3 as illustrated in FIG. 21. A plurality of deep ribs 2*c,d* substantially vertically line up along the vertical or central axis 25 of the bottle 3 as illustrated in FIG. 21.

In some embodiments, the flattened and/or shallow ribs 6*d* of the label panel ribs 20*b* are vertically misaligned with the flattened and/or shallow ribs 6*a* of the grip portion ribs 3*b* such that the label portion 10 has a set of recessed columns and the grip portion 8 has another set of recessed columns. Thus, the recessed column of the label portion 10 can be vertically misaligned from the recessed columns of the grip portion 8. In some embodiments, the bottle 3 can have recessed columns in just the grip portion 8 or just the label panel portion 10.

In the illustrated embodiment with four lined-up flattened and/or shallow ribs 6*a,b*, the bottle respectively has four recessed columns 7*c* on each flat wall of the square bottle. The four recessed columns 7*c* may be equally spaced apart around the perimeter of the bottle 3 and located on the opposite sides of the bottle 3 with respect to each other. With four equally spaced recessed columns 7*c*, the recessed columns 7*c* are spaced every 90 degrees around the bottle 3 perimeter. The four recessed columns 7*c* are positioned on the flat portions of the sidewalls of the bottle 3. Any number of recessed columns 7*c* may be incorporated into a design of the bottle 3 by increasing or decreasing the number of flattened and/or shallow ribs 6*c,d* that substantially vertically line up along the vertical or central axis 25. For instance, the bottle may have as few as 1 or up to 10 recessed columns 7*c*, including 2, 3, 4, 5, 6, 7, 8, or 9 recessed columns 7*c*, including ranges bordered and including the foregoing values. The collections of flattened and/or shallow ribs 6*c,d* that form recessed columns 7*c* provide resistance to leaning, load crushing, and/or stretching as discussed herein. The recessed columns 7*c* transfer the resulting tangential or compression forces along the wall to the base 24*e* and increase bottle 3 rigidity.

Figure 22:
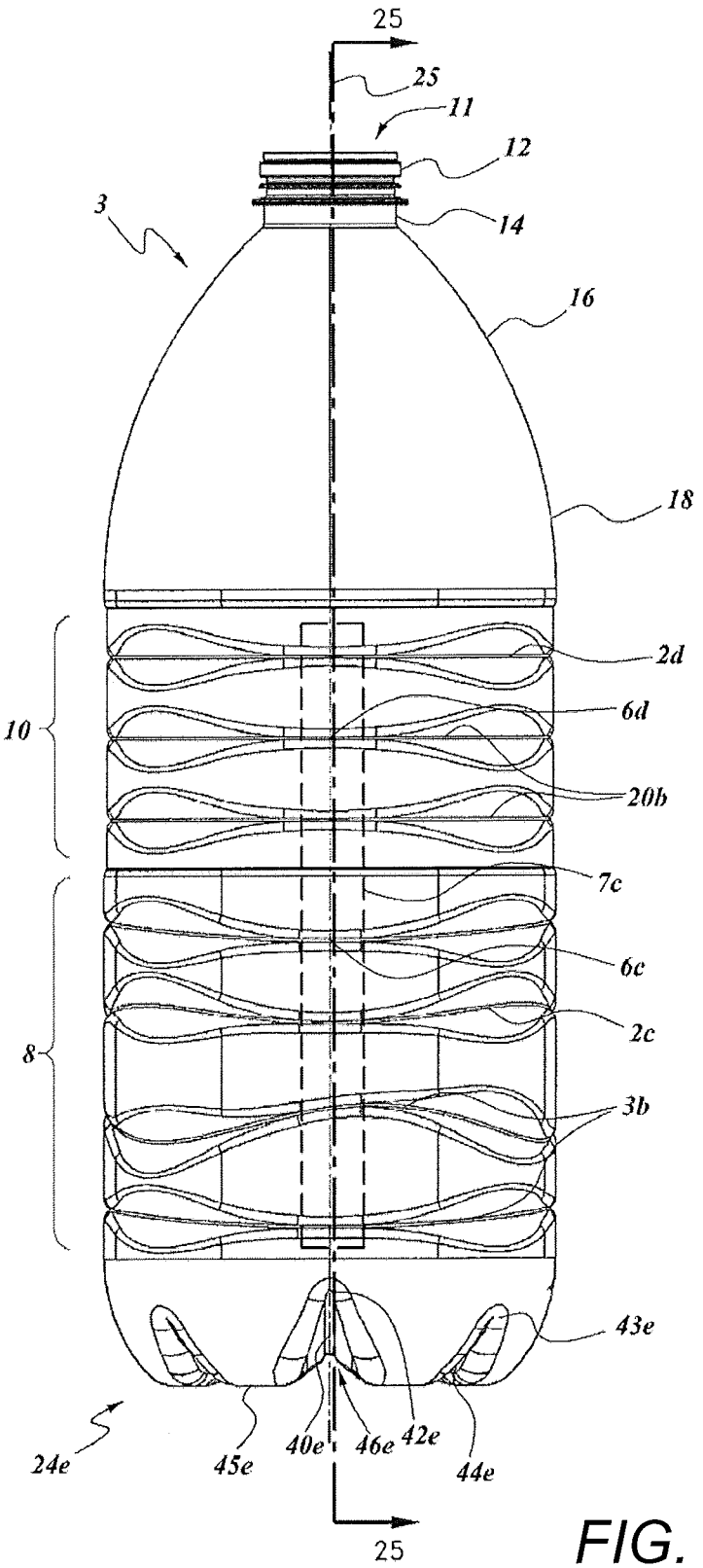
FIG. 22 illustrates a side view of another embodiment of a bottle.

The shape of the square bottle adds hoop strength to the bottle 3 by having four corners. The deep ribs 2*c,d* of the grip portion ribs 3*b* and label panel ribs 20*b* can complement the hoop strength by providing additional hoop strength. As shown in FIG. 22, the deep ribs 2*c,d* may be positioned on the corners of the sidewall of the bottle 3. At the corners, the deep ribs 2*c,d* can inhibit flexing of the flat sidewall portions of the bottle 3. The flat sidewall portions may act as membranes and flex radially outwardly under internal pressurization of the bottle 3. The deep ribs 2*c,d* positioned at the corners of the bottle 3 function as horizontal strap ribs as discussed herein to inhibit deformation due to internal pressure. The deep ribs 2*c,d* positioned at the corners can also inhibit inward radial flexing of the flat portions of the wall from external stresses and/or forces, such as, for example, from a user gripping the bottle. The deep ribs 2*c,d* can inhibit the inward flexing of the flat sidewall portions with or without internal pressurization of the bottle 3. Thus, the deep ribs 2*c,d* can help prevent rounding of the square bottle 3.

The number of ribs, including base ribs 22, grip portion ribs 3*b*, and/or label panel ribs 20*b* may vary from 1 to 30 ribs every 10 centimeters of any rib containing portion of the bottle, such as, but not limited to the grip portion 8 and/or label panel portion 10, including 1, 2, 3, 4, 5, 6, 7, 8, 9, 10, 11, 12, 13, 14, 15, 16, 17, 18, 19, 20, 21, 22, 23, 24, 25, 26, 27, 28, or 29 ribs every 10 centimeters, including ranges bordered and including the foregoing values. The aforementioned 10 centimeter section that is used to measure the number of ribs need not be actually 10 centimeters in length. Rather, 10 centimeters is used illustratively to provide a ratio for the number of ribs.

FIG. 22 illustrates a side view of an embodiment of the bottle 3. As shown in FIG. 22, the grip portion ribs 3*b* may angulate around the perimeter of the bottle 3. The label panel ribs 20*b* may be straight around the perimeter of the bottle 3. The base 24*e* has a strap rib 40*e*. The strap rib 40*e* has a sidewall end 42*e* that terminates along the sidewall of the bottle 3 as discussed herein or near or at a transition from the base 24*e* to the sidewall of the bottle 3. The base has 24*e* has a load rib 44*e*. As illustrated in FIG. 22, the base 24*e* can have one load rib 44*a* for every one strap ribs 40*a*. In some embodiments, the base 24*e* can have 2, 3, 4, and 5 load ribs 44*a* between two strap ribs 40*a*. The load rib 44*e* has a sidewall end 43*e* that terminates in the base 24*e* or near or at a transition from the base 24*e* to the sidewall of the bottle 3. As illustrated in FIG. 22, the sidewall end 43*e* of the load rib 44*e* may be vertically lower than the sidewall end 42*e* of the strap rib 40*e* along the central axis 25. In some embodiments, the sidewall end 43*e* of the load rib 44*e* may terminate along the sidewall of the bottle 3 at a same height as to the sidewall end 42*e* of the strap rib 40*e*. The base 24*e* has feet 45*e* formed between the strap ribs 40*e* and the load ribs 44*e*.

The strap rib 40*e* is relatively larger and deeper than the strap rib 44*e* as discussed herein. As illustrated in FIG. 22, the strap base rib 40*e* may vertically align with the recessed columns 7*c*. Where a bottle 3 has four recessed columns 7*c*, the base 24*e* can have four strap ribs 40*e*. The strap ribs 40*e* are space equally around the circumference of the bottle 1. With four equally spaced strap ribs 40*e*, the strap ribs 40*e* are positioned every 90 degrees around the bottle circumference. The load ribs 44*e* can vertically align with the grip portion ribs 3*b* between the recessed columns 7*c*. As shown in FIG. 22, the load ribs 44*e* may vertically align with the deep ribs 6*c,d*. In some embodiments, the strap ribs 40*e* may be vertically misaligned with the recessed columns 7*c*. In some embodiments, the strap ribs 40*e* may be spaced unequally around the bottle circumference. In some embodiments, the base 24*a* may have more or less strap ribs 40*a* than the number of recessed columns 7*e*.

The sidewall end 42*e* of the strap rib 40*e* vertically aligns or points to substantially the center of the recessed columns 7*c* (center point of the shallow and/or flattened ribs 2*c,d*). As illustrated in FIG. 22, the strap rib 40*e* forms a recess 46*e* from a side view perspective. The strap rib 40*e* can extend substantially from a central portion of the base 24*e* (from the central axis 25) as discussed herein. The strap rib 40*e* can act as a strap between the recessed columns 7*c* of the sidewall to the central portion of the base 24*e*. As shown in FIG. 22, the strap rib 40*e* provides a more direct and shorter path to the center of the base 24*a* from the sidewall of the bottle 3 without proceeding to the vertical level of the feet 45*e*. As discussed herein, strap rib 40*e* thus provides relatively more pressure resistant base 24*e*. The strap rib 40*e* provides a link for forces and stresses between the sidewall, including the recessed column 7*c*, and the central portion of the base 24*e*.

Figure 23:
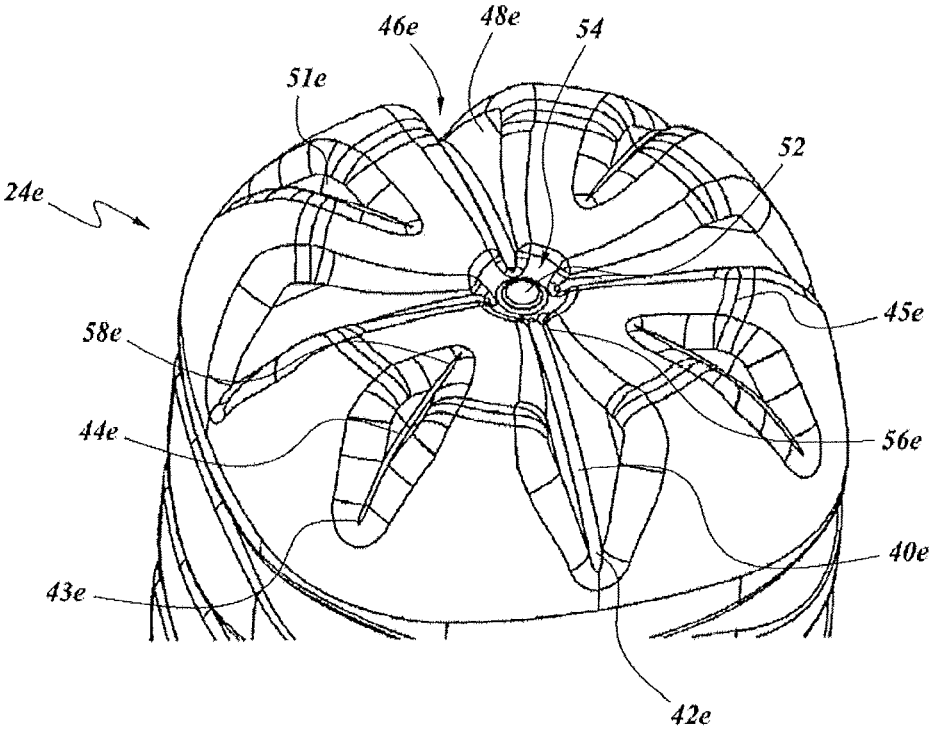
FIG. 23 illustrates a bottom perspective view of another embodiment of a base.

FIG. 23 illustrates a bottom perspective view of an embodiment of the base 24*e*. The base 24*e* has a strap rib 40*e* and a load rib 44*e* as discussed herein. The base 24*e* has a gate 52. As shown in FIG. 22, the base 24*e* may have a dome 54. The strap rib 40*e* has a base end 56*e* that terminates near, at, or in the dome 54. The strap rib 40*e* has a rib side wall (i.e., valley wall) 48*e* that connects that strap rib 40*e* to portions of the base 24*e* and the feet 45*e* of the base 24*a*. The rib side wall 48*a* smoothly and gradually transitions into the base 24*e* and the feet 45*e*. The smooth and gradual transition provides internal pressure resistance at and near the rib side wall 48*e* since more spherical features of the bottle 1 can better accommodate internal pressure. The strap rib 40*a* is relatively deeper in the base 24*e* than the load rib 58*e* to provide stress transfer and pressure resistance as discussed herein.

The load rib 44*e* has a base end 58*e* that terminates at near or at the dome 54. As shown in FIG. 22, the base end 58*e* of the load rib 44*e* may terminate before the base end 56*e* of the strap rib 40*e*. The base end 58*e* of the load rib 44*e* may terminate at wall portion of the base 24*e* before reaching the dome 54. The load rib 44*e* is shallow relative to the strap rib 40*e*. As shown in FIG. 22, the load rib 44*e* may have a rib side 51*e* feature similar as discussed herein with reference to the strap rib 40*a*. The rib side 51*e* of the load rib 44*e* may be relatively smaller than the rib side 48*e* of the strap rib 40*e* as the strap rib 40*e* is designed to mostly resist internal pressure while the load rib 44*e* is designed to resist mostly external pressure or forces. The transition from load rib 44*e* to the base 24*e* and the feet 45*e* is more abrupt or sharper in comparison with the strap rib 44*e* and in particular, the rib side 48*e*. The sharper transition provides external stress resistance. When the bottle 3 is top loaded during packaging, shipping, and/or handling, sharper transitions of the load ribs 44*e* help resist bending and/or leaning as discussed herein by, for example, maintaining the integrity and shape of the base 24*e*.

The sharper transitions provide for faster transitions into the feet 45*e* of the base 24*e*. Faster transitions lead to more area of the base 24*e* being available for relatively larger feet 45*e*. Larger feet 45*e* of a flat foot base 24*e* as discussed herein and as illustrated in FIG. 22 provide more resin contact area with a resting surface. More resin contacting the resting surface provides better abrasion resistance and stability of the base 24*e*.

As shown in FIG. 22, the rib side wall 48*e* may transition into the strap rib 40*e* more abruptly or sharply relative to the transition from the rib side 48*e* to the feet 45*e*. The sharper transitions at the strap rib 40*e* itself may provide more rigidity to the strap rib 40*e* to resist or inhibit flexing due to internal pressures as discussed herein.

Figure 24:
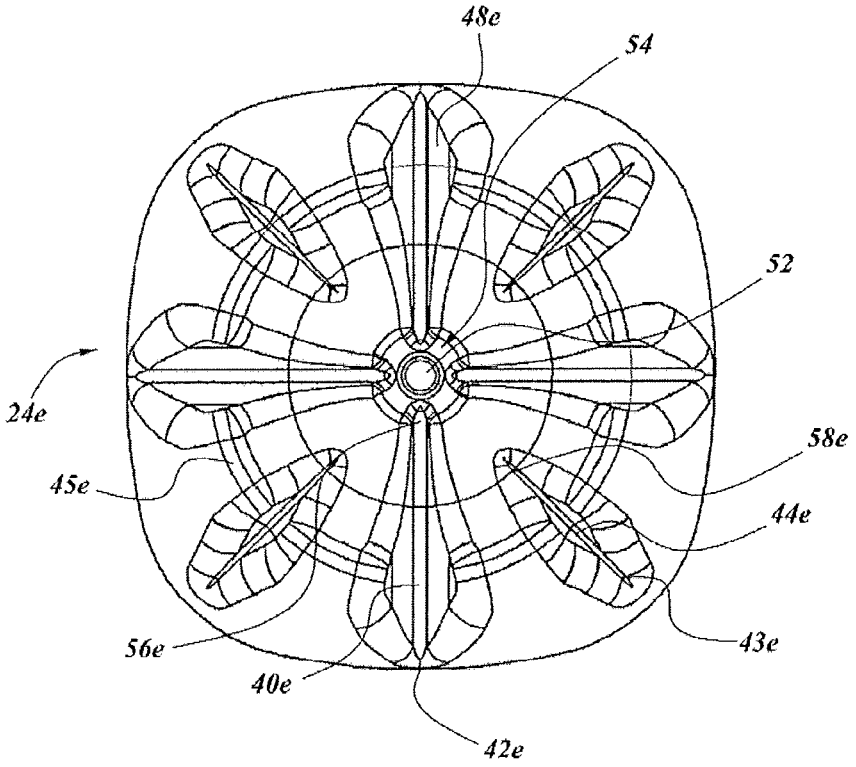
FIG. 24 illustrates a bottom view of another embodiment of a base.

FIG. 24 illustrates a bottom view of an embodiment of the base 24*e*. As shown in FIG. 22, the strap ribs 44*e* may align to provide a resistance strap or band 9*e* (FIG. 25) substantially along middle portions of the flat sidewall segments of the square bottle 3 as discussed herein. The four strap ribs 44*e* complement the deep ribs 2*c,d* at the sidewall corners to help prevent the square bottle 3 from rounding along the flat portions of the sidewalls.

FIG. 25 illustrates a cross-section along the central axis 25 of an embodiment of the bottle 3 as illustrated in FIG. 22. As shown in FIG. 25, a flat rib or recessed column 7*e* is located on an opposite side of the bottle perimeter of another recessed column 7*e*. In some embodiments, the diameter Ld of the base 24 is larger by 0.5 to 2 millimeters, 0.6, 0.7, 0.8, 0.9, 1, 1.1, 1.2, 1.3, 1.4, 1.5, 1.6, 1.7, 1.8, or 1.9 millimeters, including ranges bordered and including the foregoing values, than any other diameter of the bottle 3. In an embodiment with the largest diameter of the bottle 3 being Ld, the bottle 3 has a single point of contact at just the base 24*e* with other substantially similar bottles in a production line and/or packaging. Further, a larger base 24*e* diameter Ld may improve stability when there is any damage to the base 24*e*. As shown in FIG. 22, the diameter Ls at the shoulder 18 may be equal to the diameter Ld, which provides for two points of contact, at the shoulder 18 and base 24*e*, with other substantially similar bottles in a production line and/or packaging. In some embodiments, the diameter(s) in any portion of the bottle 3 varies, where the largest diameters create points of contact in a production line and/or packaging. The bottles may have either a single point of contact or multiple points of contact.

As shown in FIG. 22, the strap ribs 40*e* may vertically align with the recessed columns 7*e*. The strap ribs 40*e* and recessed column 7*e* in combination can form a pressure resistance band 9*e* that substantially extends from a top portion of the label portion 10 or the top portion of the recessed column 7*e* on one side of the bottle 3 to the base 24*e* and through the gate 52 along the base 24*e* to a top portion of the label portion 10 or the top portion of the recessed column 7*e* on the other side of the bottle 3. The pressure resistance band 9*e* provides resistance against internal pressure substantially for the base 24*e* and sidewalls of the bottle 3 such as, for example, inhibit stretching, sidewall flexing, and/or base rollout as discussed herein. Stated differently, the pressure resistance band 9*e* extends from a top portion of the label portion 10 on one side of the bottle 3, down the sidewall on the one side of the bottle 3 and through the gate 52, up the sidewall on the other side of the bottle 3 to a top portion of the label portion 10 on the other side of the bottle 3 to provide pressure resistance as discussed here and substantially continuously through a longitudinal perimeter of the bottle 3 (along the central axis 25 at the sidewalls and through the central axis at the base 24*e*).

Figure 26:
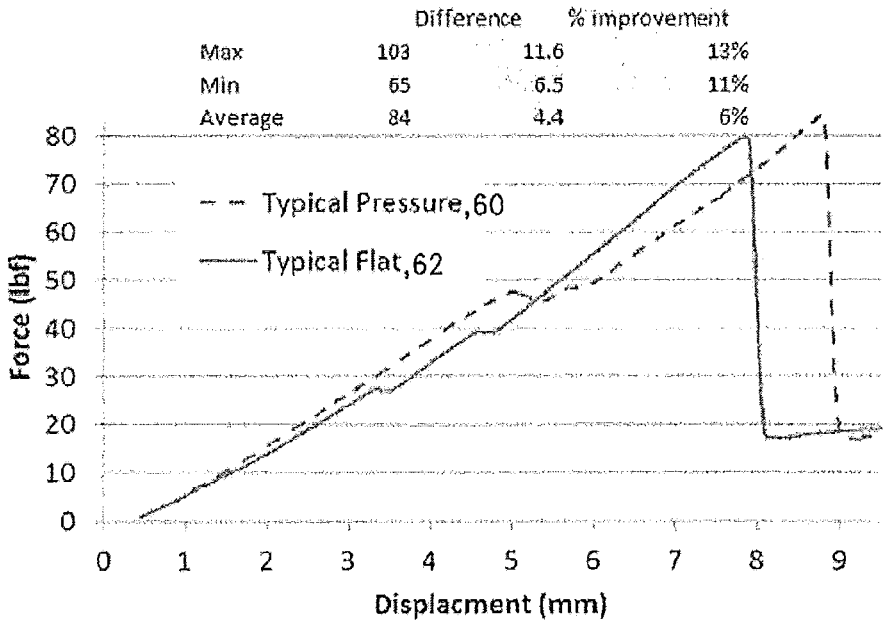
FIG. 26 is a table and graph showing an increase in top load resistance of bottles.

FIG. 26 is a table and graph showing an increase in top load resistance in lbf. with increased pressure in a bottle 1, 3. The maximum top load increased by 13% for certain bottles, and the minimum top load increases by 11% for certain bottles, with an average increase of 6%. The y-axis of the graph shows top load pressure applied to the bottle in lbf. The x-axis of the graph shows the displacement performance of the bottle under the corresponding top load pressure. Curve 60 shows top load performance of the bottle under typical pressure or pressurization inside the bottle. Curve 62 shows top load performance of the bottle under typical flat pressure or no pressurization inside the bottle. The graph illustrates a stiffer initial performance of the bottles (up to about 50, 40, and 30 lbf. (222, 178, 133 Newtons, respectively)) and a delayed reversible failure of some bottle embodiments (at about 50, 40, and 30 lbf. (222, 178, 133 Newtons, respectively)), as disclosed herein. Performance improvements can be greater with some embodiments. At the forces and/or pressures illustrated in the graph, the bottles show minimal or no permanent deformation. The bottles rebound to a desired shape after a deforming force is released. This is beneficial for rough handling during packaging, shipping, and/or handling, such as, for example, in the warehouse or shipping lane.

Figure 27:
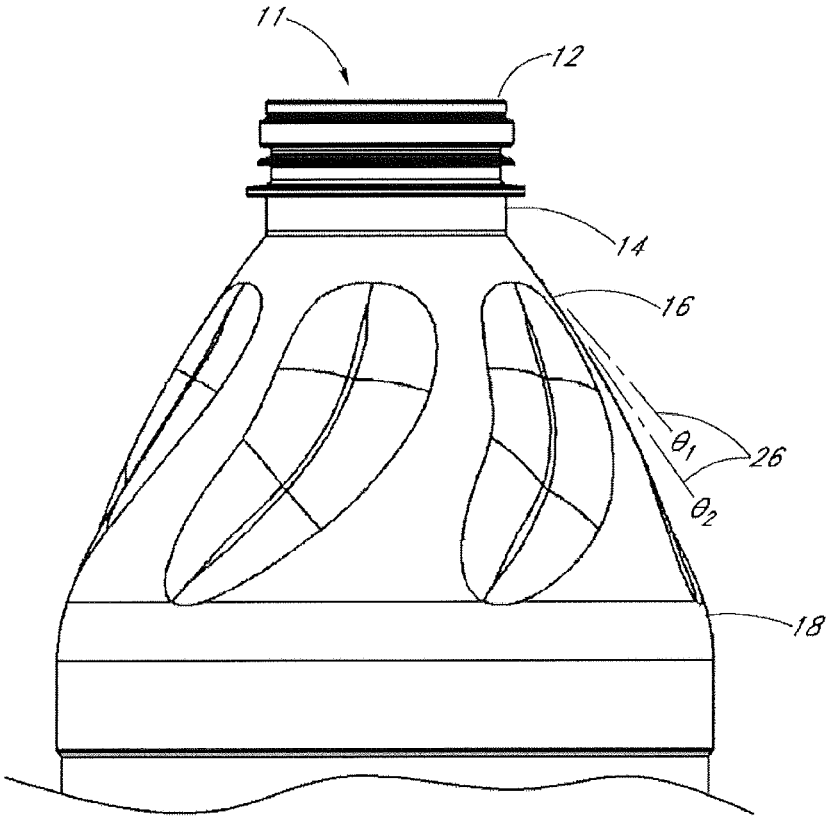
FIG. 27 illustrates an embodiment showing angles of a bell.

Referring to FIG. 27, the bell 16 may have various bell angles 26 as measured from the vertical wall of the finish 12 to the downward sloping wall of the bell 16. The bell angle 26 may be obtuse, varying from 120 to 175 degrees, including 122, 125, 127, 130, 132, 135, 137, 140, 142, 145, 147, 150, 152, 155, 157, 160, 162, 165, 167, 170, or 172 degrees, including ranges bordered and including the foregoing values. The bell angle 26 represented by 02 is larger than the bell angle 26 represented by 01. The wall of bell 16 with 02 bell angle 26 is steeper than the wall of bell 16 with 01 bell angle 26. A steeper wall of bell 16 can increase the top load capacity of the bottle 1 while maintaining the same or even decreasing bell 16 wall thickness. A steeper bell angle 26 aids in resin of a preform to touch the preform mold more quickly (relative to a less steep angle) during the blow molding process. When the resin touches the preform mold more quickly, more of resin is quenched earlier to remain in the sidewalls of the bottle, leading to thicker sidewalls. Thicker sidewalls can help increase top load and pressure resistance performance as discussed herein.

Figure 28:
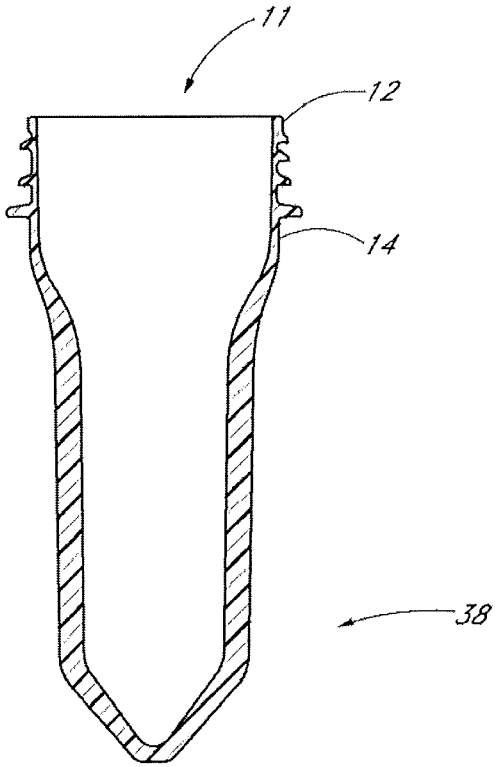
FIG. 28 illustrates a preform of a bottle.

Referring to FIG. 28, an embodiment of the bottle 1 may use a preform 38 with a thin wall finish 12 and a thin wall neck 14 to form a lightweight bottle. A thin wall neck 14 improves the ability to blow efficient, lightweight bottles. A thin wall neck 14 is a feature that aids in protecting critical dimensions of the bottle and stabilizing the production blowing process. A thin wall neck 14 can also utilize less resin while achieving the desired mechanical performance resulting in a reduction in the use of petroleum products by the industry. A thin wall neck 14 of preform 38 can aid in forming bottles 1 with larger bell angles 26 and/or steeper bell 16 walls as discussed above. As also discussed above, steeper, but relatively thinner, bell 16 walls can support greater top load forces, which can be transferred to the base 24 via the recessed columns. Thus, embodiments disclosed herein may incorporate thicker base 24 designs and/or thicker sidewall designs to withstand greater top load forces even when damaged, while using the same or less amount of resin. Achieving a thicker base 24 and/or thicker sidewalls is aided by a thin wall neck 14 and thin bell 16 walls.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the following disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" or "one of the A, B, or C," etc. is used, in general such a construction is intended in the sense one having skill in the art would understand the convention (e.g., "a system having at least one of A, B, and C (or one of the A, B, or C)" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

The invention claimed is:

1. A plastic container configured to hold a liquid and resist deformation, comprising:

a base portion comprising a hemispherical configuration and comprising a plurality of strap ribs extending from a central portion of the base to a circular perimeter, a plurality of load ribs disposed between adjacent strap ribs, and a plurality of feet formed between the strap ribs and the load ribs, the plurality of feet comprising a resting surface of the plastic container;

a sidewall comprising a grip portion extending from the base to a label panel which extends to a shoulder, the grip portion comprising a grip portion perimeter and one or more circumferentially positioned angulating grip portion ribs ranging between 1 rib and 30 ribs disposed and constrained within a linear distance of 10 centimeters, the grip portion ribs comprising a plurality of sections varying in depth including a deep rib section that transitions to a shallow rib section, and the label panel comprising a label portion perimeter and one or more label panel ribs;

wherein a periphery of the sidewall is substantially perpendicular to a central axis of the interior; and a bell comprising a diameter which decreases as the bell extends from the shoulder to a neck; and a finish connected to the neck and configured to receive a closure, the neck and finish defining an opening to an interior of the container.

2. The plastic container of claim 1, wherein the one or more label panel ribs comprises a number of label panel ribs ranging between 1 rib and 30 ribs disposed within a linear distance of 10 centimeters.

3. The plastic container of claim 1, wherein the plurality of strap ribs comprises three strap ribs that are equally spaced around a circumference of the base.

4. The plastic container of claim 3, wherein the plurality of load ribs comprises six load ribs, and wherein two load ribs are equally spaced between adjacent strap ribs.

5. The plastic container of claim 1, wherein the plurality of strap ribs extends to a height along the base which is greater than a height of the plurality of load ribs.

6. The plastic container of claim 1, wherein the plurality of strap ribs extends to a height along the base which is substantially equal to a height of the plurality of load ribs.

7. The plastic container of claim 1, wherein the plurality of strap ribs extends from the base into the sidewall, thereby subdividing the base rib into a plurality of equally-sized segments.

8. The plastic container of claim 1, wherein the base further comprises a gate centered on a central axis of the container and a wall extending from the gate toward the resting surface of the plastic container.

9. The plastic container of claim 8, wherein the wall comprises a dome surrounding the gate which slopes more steeply toward the resting surface than a portion of the wall surrounding the dome.

10. The plastic container of claim 8, wherein the plurality of strap ribs extend from locations surrounding the periphery of the gate.

11. The plastic container of claim 8, wherein the plurality of strap ribs extend from the periphery of the gate.

12. The plastic container of claim 1, wherein each of the plurality of strap ribs comprises two rib side walls that extend smoothly into surrounding portions of the base.

13. The plastic container of claim 1, wherein each of the plurality of strap ribs has a depth into the base which is greater than a depth of the plurality of load ribs.

14. The plastic container of claim 1, wherein each of the plurality of strap ribs is substantially parallel to the resting surface near the central portion of the base and then extends along an upward curved path toward the sidewall of the container.

15. The plastic container of claim 14, wherein the upward curved path comprises at least a first curve and a second curve, both of the first and second curves having an increasingly positive slope.

16. The plastic container of claim 14, wherein a first straight portion is disposed between the first curve and the second curve, and a second straight portion is disposed between the second curve and a terminal end of the strap rib.

17. The plastic container of claim 16 wherein the first curve comprises a first radius, and the second curve comprises a second radius, both of the first and second radii being selected to give the upward curved path a spherical configuration, such that the container better accommodates internal pressure.

* * * * *